US005610689A

United States Patent [19]

Kamiya et al.

[11] Patent Number: 5,610,689

[45] Date of Patent: Mar. 11, 1997

[54] IMAGE FORMING APPARATUS HAVING FAILURE DIAGNOSING FUNCTION

[75] Inventors: Yuji Kamiya, Yokohama; Atsushi Takeda; Toru Katsumi, both of Kawasaki, all of Japan

[73] Assignee: Canon Kabushiki Kaisha

[21] Appl. No.: 591,109

[22] Filed: Jan. 25, 1996

Related U.S. Application Data

[63] Continuation of Ser. No. 174,458, Dec. 28, 1993, abandoned.

[30] Foreign Application Priority Data

Dec. 28, 1992 [JP] Japan ..... 4-361308
Jan. 13, 1993 [JP] Japan ..... 5-003915

[51] Int. Cl.[6] ..... G03G 21/00

[52] U.S. Cl. ..... 399/31; 395/900; 399/42

[58] Field of Search ..... 355/208, 204, 355/207, 221, 246, 273; 364/274.6, 275.2, 275.1; 395/900

[56] References Cited

U.S. PATENT DOCUMENTS 5,029,314 7/1991 Katsumi et al. ..... 355/208
5,142,332 8/1992 Osawa et al. ..... 355/208
5,231,452 7/1993 Murayama et al. ..... 355/208
5,262,833 11/1993 Fukushima et al. ..... 355/208 X
5,307,118 4/1994 Morita ..... 355/208
5,321,468 6/1994 Nakane et al. ..... 355/208
5,386,271 1/1995 Maekawa et al. ..... 355/204

FOREIGN PATENT DOCUMENTS 5-95668 4/1993 Japan .

*Primary Examiner*—Nestor R. Ramirez
*Attorney, Agent, or Firm*—Fitzpatrick, Cella, Harper & Scinto

[57] ABSTRACT

A detector for detecting status quantities in processes of an image forming apparatus and a correction mechanism for changing parameters are connected to a controller. By virtue of this arrangement, the amount of current associated with a primary charging device in a latent-image process, the surface potential of a photoreceptor drum and a voltage correction coefficient are fed into the controller as status quantities. By using the entered status quantities as well as membership functions and fuzzy rules that have been stored in an internal memory of the controller, the controller executes fuzzy reasoning and outputs a signal indicating the failure rate or rate of erroneous setting of each processing element.

65 Claims, 47 Drawing Sheets

FIG. 6

| CONDITION PART (INPUT STATUS QUANTITY) | | OPERATION PART |
|---|---|---|
| $I_P$ | $V_D$ | $NG_P$ |
| L | L | M |
| | M | L |
| | H | L |
| M | L | H |
| | M | L |
| | H | L |
| H | L | H |
| | M | M |
| | H | L |

FIG. 13

| CONDITION PART (INPUT STATUS QUANTITY) | | | OPERATION PART | |
|---|---|---|---|---|
| $V_L$ | $\Delta V_{LAMP}$ | $R_{LAMP}$ | $NG_{LAMP}$ | $NG_{RL}$ |
| L | L | L | LL | LL |
| | | M | LL | LL |
| | | H | LL | LL |
| | M | L | LL | LL |
| | | M | LL | LL |
| | | H | LL | LL |
| | H | L | ML | LL |
| | | M | MM | LL |
| | | H | MM | LL |
| M | L | L | LL | LL |
| | | M | LL | LL |
| | | H | LL | LL |
| | M | L | LL | LL |
| | | M | LL | LL |
| | | H | LM | LL |
| | H | L | HL | LL |
| | | M | HM | LL |
| | | H | HM | LL |
| H | L | L | MH | HH |
| | | M | HL | HL |
| | | H | HL | LL |
| | M | L | HL | HH |
| | | M | HM | MH |
| | | H | HM | LL |
| | H | L | HL | HH |
| | | M | HM | MH |
| | | H | HM | LL |

| CONDITION PART (INPUT STATUS QUANTITY) | | OPERATION PART | |
|---|---|---|---|
| $V_{DEV}$ | $Q_T$ | $NG_{RD}$ | $NG_{TN}$ |
| L | L | LM | MH |
| | M | LL | MM |
| | H | LM | HH |
| M | L | MM | HL |
| | M | LH | LH |
| | H | LH | HM |
| H | L | HH | HH |
| | M | HM | MM |
| | H | HH | HH |

FIG. 20

| CONDITION PART (INPUT STATUS QUANTITY) | | | OPERATION PART | |
|---|---|---|---|---|
| ITE | CV | HD | NGTE | NGRT |
| L | L | L | LL | LL |
| | | M | LH | MM |
| | | H | HL | HM |
| | M | L | LH | LL |
| | | M | MM | MH |
| | | H | HM | HH |
| | H | L | MM | LM |
| | | M | HM | MH |
| | | H | HH | HH |
| M | L | L | LL | ML |
| | | M | LH | LL |
| | | H | ML | HM |
| | M | L | ML | ML |
| | | M | ML | LL |
| | | H | MM | HM |
| | H | L | HL | MM |
| | | M | MH | LL |
| | | H | HL | HH |
| H | L | L | LM | HL |
| | | M | LL | MH |
| | | H | LL | MH |
| | M | L | MM | HM |
| | | M | ML | MH |
| | | H | MM | MH |
| | H | L | HM | HM |
| | | M | HL | HL |
| | | H | HL | HL |

FIG. 27

| STATUS QUANTITY | | | FAILURE RATE | | | |
|---|---|---|---|---|---|---|
| ΔVH | ΔDH | ΔDH' | LATENT-IMAGE DEVICE | DEVELOPER | TRANSFER CHARGING DEVICE | |
| L | L | L | L | L | L | --- RULE 1 |
| | | M | L | L | MH | --- RULE 2 |
| | | H | L | L | HH | --- RULE 3 |
| | M | L | L | ML | ML | |
| | | M | L | MM | L | |
| | | H | L | MM | MH | |
| | H | L | L | HL | HL | |
| | | M | L | HM | MH | |
| | | H | L | HH | L | --- RULE 9 |
| M | L | L | ML | ML | L | |
| | | M | ML | ML | MH | |
| | | H | ML | ML | HH | --- RULE 11 |
| | M | L | MM | L | MM | |
| | | M | MM | L | L | |
| | | H | MM | L | MH | --- RULE 15 |
| | H | L | MM | ML | HL | |
| | | M | MM | MM | MH | |
| | | H | MM | MH | L | |
| H | L | L | HL | HL | L | |
| | | M | HL | HL | MH | |
| | | H | HL | HL | HH | |
| | M | L | HM | MM | ML | |
| | | M | HM | MH | L | |
| | | H | HM | MH | MM | |
| | H | L | HH | L | HH | |
| | | M | HH | L | HL | |
| | | H | HH | L | L | --- RULE 27 |

| STATUS QUANTITY | | | FAILURE RATE | | |
|---|---|---|---|---|---|
| ΔVD | ΔVH | HUMIDITY | CHARGING DEVICE | EXPOSURE UNIT | PHOTO-SENSITIVE DRUM |
| L | M | L | L | M | L |
| | | M | L | M | L |
| | | H | L | M | L |
| | H | L | L | H | L |
| | | M | L | H | L |
| | | H | L | H | L |
| M | M | L | MH | L | L |
| | | M | MM | L | ML |
| | | H | ML | L | MH |
| | H | L | HL | M | ML |
| | | M | MH | M | MM |
| | | H | ML | M | HL |
| H | M | L | HM | M | ML |
| | | M | HL | M | MM |
| | | H | ML | M | HM |
| | H | L | HH | L | MM |
| | | M | HM | L | MH |
| | | H | MM | L | HH |

FIG. 37

| STATUS QUANTITY | | | FAILURE RATE | |
|---|---|---|---|---|
| ΔDL | N | HUMIDITY | PHOTO-SENSITIVE DRUM | DEVELOPING SLEEVE |
| L | L | L | L | L |
| | | M | L | L |
| | | H | L | L |
| | M | L | L | L |
| | | M | L | L |
| | | H | L | L |
| | H | L | L | L |
| | | M | L | L |
| | | H | L | L |
| M | L | L | L | H |
| | | M | L | H |
| | | H | L | L |
| | M | L | M | H |
| | | M | M | M |
| | | H | M | L |
| | H | L | H | M |
| | | M | H | L |
| | | H | H | L |
| H | L | L | L | H |
| | | M | L | H |
| | | H | L | L |
| | M | L | M | H |
| | | M | M | M |
| | | H | M | L |
| | H | L | H | M |
| | | M | H | L |
| | | H | H | L |

FIG. 43

| No. | CONDITION PART | | | OPERATION PART | | |
|---|---|---|---|---|---|---|
| | MIXTURE RATIO | SEPARATION DIFFERENCE-CURRENT ADJUSTMENT VALUE | SEPARATION DIFFERENCE-CURRENT OUTPUT VALUE | FAULTY SEPARATION DIFFERENCE-CURRENT ADJUSTMENT | FAULTY SEPARATION CHARGING DEVICE | FAULTY TRANSFER MATERIAL |
| 1 | L | L | L | MH | LH | LL |
| 2 | L | L | M | MM | MH | LL |
| 3 | L | L | H | ML | HM | LM |
| 4 | L | M | L | MM | ML | LL |
| 5 | L | M | M | ML | MH | LL |
| 6 | L | M | H | LH | HM | LM |
| 7 | L | H | L | LH | HL | LL |
| 8 | L | H | M | LM | HM | LM |
| 9 | L | H | H | LL | HH | LH |
| 10 | H | L | L | HH | LL | MM |
| 11 | H | L | M | HM | ML | MH |
| 12 | H | L | H | HL | MH | HL |
| 13 | H | M | L | HM | LH | MH |
| 14 | H | M | M | HL | ML | HL |
| 15 | H | M | H | MH | MH | HM |
| 16 | H | H | L | HL | ML | HL |
| 17 | H | H | M | MH | MM | HM |
| 18 | H | H | H | MM | HL | HH |

FIG. 47

| No. | CONDITION PART | | | OPERATION PART | | |
|---|---|---|---|---|---|---|
| | MIXTURE RATIO | SEPARATION DIFFERENCE-CURRENT ADJUSTMENT VALUE | SEPARATION DIFFERENCE-CURRENT OUTPUT VALUE | FAULTY SEPARATION DIFFERENCE-CURRENT ADJUSTMENT | FAULTY SEPARATION CHARGING DEVICE | FAULTY TRANSFER MATERIAL |
| 1 | L | L | L | MM | HL | HH |
| 2 | L | L | M | MH | MM | HM |
| 3 | L | L | H | HL | ML | HL |
| 4 | L | M | L | MH | MH | HM |
| 5 | L | M | M | HL | ML | HL |
| 6 | L | M | H | HM | LH | MH |
| 7 | L | H | L | HL | MH | ML |
| 8 | L | H | M | HM | ML | MH |
| 9 | L | H | H | HH | LL | MM |
| 10 | H | L | L | LL | HH | LH |
| 11 | H | L | M | LM | HM | LM |
| 12 | H | L | H | LH | HL | LL |
| 13 | H | M | L | LH | HM | LM |
| 14 | H | M | M | ML | MH | LL |
| 15 | H | M | H | MM | ML | LL |
| 16 | H | H | L | ML | HM | LM |
| 17 | H | H | M | MM | MH | LL |
| 18 | H | H | H | MH | LH | LL |

FIG. 50

| No. | CONDITION PART | | | OPERATION PART | |
|---|---|---|---|---|---|
| | MIXTURE RATIO | TRANSFER CURRENT ADJUSTMENT VALUE | CUMULATIVE NUMBER OF COPIES | FAULTY TRANSFER CURRENT ADJUSTMENT | FAULTY TRANSFER CHARGING DEVICE |
| 1 | L | L | L | HH | LL |
| 2 | L | L | M | HL | ML |
| 3 | L | L | H | MH | HL |
| 4 | L | M | L | HM | LM |
| 5 | L | M | M | MM | MM |
| 6 | L | M | H | LH | HM |
| 7 | L | H | L | LH | LH |
| 8 | L | H | M | LM | MH |
| 9 | L | H | H | LL | HH |
| 10 | H | L | L | MH | LL |
| 11 | H | L | M | MM | LM |
| 12 | H | L | H | ML | LH |
| 13 | H | M | L | MM | LL |
| 14 | H | M | M | ML | LM |
| 15 | H | M | H | LH | LH |
| 16 | H | H | L | ML | LL |
| 17 | H | H | M | LH | LM |
| 18 | H | H | H | LM | LH |

IMAGE FORMING APPARATUS HAVING FAILURE DIAGNOSING FUNCTION

This application is a continuation of application Ser. No. 08/174,458, filed Dec. 28, 1993, now abandoned.

BACKGROUND OF THE INVENTION

1. Field of the Invention

This invention relates to the diagnosing of faults in an image forming apparatus.

2. Description of the Related Art

When a component part in an image forming apparatus using electrophotography develops a fault or undergoes a decline in durability, the image formed loses density and develops fogging and density unevenness. For example, with regard to uneven density, it is required that a photosensitive drum be charged or electrified uniformly by corona discharge in a charging step and de-electrified uniformly in an exposure step in order to obtain a uniform reproduction image. However, the corona charging device is electrified unevenly owing to contamination by stray developer in the apparatus, and a non-uniformity in the amount of exposing light is produced by deterioration of the exposure lamp through aging. When these phenomena occur, the potential distribution on the photosensitive drum becomes non-uniform and is a cause of uneven density. Further, it goes without saying that the charging step, the deterioration of the exposure lamp and malfunctions are a cause of lighter density and fogging.

To discriminate the cause of lighter density, fogging and uneven density, a serviceman performing maintenance makes a judgment upon observing the image formed on recording paper. Further, self-diagnosis is carried out by using a density monitor and potential sensor to monitor the density of the toner image on the photosensitive drum as well as the potential of the latent image. A method of self-diagnosis involves providing a threshold value for the status quantity of each process element within the apparatus and determining the location of a fault using this threshold value as a reference.

In the conventional technique for diagnosing the location of a fault, the status quantity for specifying the cause of the fault and the fault location are in 1:1 correspondence, and whether or not a fault is present is judged by measuring the status quantity that is the cause of the fault. In order to make this judgment, the method used involves providing a threshold value for each status quantity and judging that a fault has occurred only if the prescribed threshold value is exceeded. However, in fault diagnosis, such as in control management of output-image density, for a case in which malfunction and/or aging of each process element takes place comparatively gradually, there are instances in which the diagnostic results are erroneous or in which extreme results are outputted when the conventional diagnostic technique is used. Furthermore, owing to the 1:1 correspondence between the status quantity for specifying the cause of the fault and the fault location in accordance with the conventional diagnostic technique, it is difficult to diagnose a plurality of fault locations while observing interrelationships using a plurality of status quantities.

By way of example, the cause of uneven density involves a variety of factors and these factors are interrelated in complex ways. Accordingly, in judging cause, it is required that the serviceman have a high level of knowledge and experience. There is also the risk of erroneous judgments being made. In addition, in order to perform self-diagnosis associated with each of the sensors, it is required that a complicated decision program be written based upon a large quantity of experimental data. Since there are many causes of uneven density, as mentioned above, it is necessary to experimentally obtain the relationship between a change in the degree of deterioration of each part that is a cause candidate and a change in uneven density in order to create the aforementioned program. More specifically, a voluminous experimental-data table is required before the program is written, and compiling the table necessitates a large amount of time and labor. In actual practice, therefore, often only the especially important candidates among the large number thereof are taken into consideration.

In order to satisfy the need for an improvement in the reliability of an image forming apparatus, it is required that judgment be automated instead of relying upon the aforementioned visual judgment of the image. In addition, it is necessary that information regarding a large number of status quantities be taken into account and that the method of judgment be one based upon a simple decision program.

Pre-transfer, transfer and corona charging for separation in an image forming apparatus involves processes for externally applying electric charge to the toner image on a photosensitive drum, transferring the toner image to transfer paper and peeling off the transfer paper from the photosensitive drum. In a high-speed machine, adjustment values in each of the processes are important and delicate quantities that influence the performance of the apparatus. Accordingly, in conventional practice, such factors as the characteristics of the toner on the photosensitive drum (namely the amount of electric charge on the toner), the quantity of toner (which is dependent upon the state of the original), the type of transfer paper, the water content of the transfer paper, the conveyance speed of the main body of the apparatus, the contamination of each of the charging devices and the differences between machines are taken into account, and the set values of the charging devices are obtained by the repetition of complicated experiments.

In general, however, deviations in the above-mentioned factors cannot be covered by a single set value, and it is necessary to change over the output level by a service man, to make adjustments, to perform maintenance of the charging devices and the like and to check the transfer paper.

However, in the case of malfunctions and problems related to transfer and separation, a variety of causes are conceivable and it is required that the serviceman possesses a high-degree of knowledge and experience. In addition, apparatus downtime is prolonged and locations different from those that are faulty may be adjusted inadvertently.

SUMMARY OF THE INVENTION

An object of the present invention is to provide an image forming apparatus and a failure diagnosing method devoid of the drawbacks described above.

Another object of the present invention is to provide an image forming apparatus and a failure diagnosing method through which it is possible to surmise the cause of a deterioration in image quality in an image forming process by using status quantities relating to processes associated with image quality.

A further object of the present invention is to provide an image forming apparatus and a failure diagnosing method through which failure diagnosis can be performed easily and accurately by deciding the failure rate or erroneous setting rate of each process element by means of fuzzy reasoning based upon status quantities related to processes associated with the quality of an image formed on a recording medium as well as inferential information quantitatively correlating each status quantity with the failure rate or erroneous setting rate of the process.

Still another object of the present invention is to provide an image forming apparatus and a failure diagnosing method in which a cause of transfer separation failure can be subjected to fuzzy reasoning using status quantities relating to transfer separation failure.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 6 is a diagram showing fuzzy rules according to the first embodiment;

FIG. 13 is a diagram showing fuzzy rules according to the second embodiment;

FIG. 20 is a diagram showing fuzzy rules according to the fourth embodiment;

FIG. 27 is a diagram showing fuzzy rules used in the fifth embodiment;

FIG. 37 is a diagram showing fuzzy rules according to the seventh embodiment;

FIG. 43 is a diagram showing fuzzy rules according to the eighth embodiment;

FIG. 47 is a diagram showing fuzzy rules according to a ninth embodiment;

FIG. 50 is a diagram showing fuzzy rules according to the tenth embodiment.

DESCRIPTION OF THE PREFERRED EMBODIMENTS

<First Embodiment>

Figure 1:
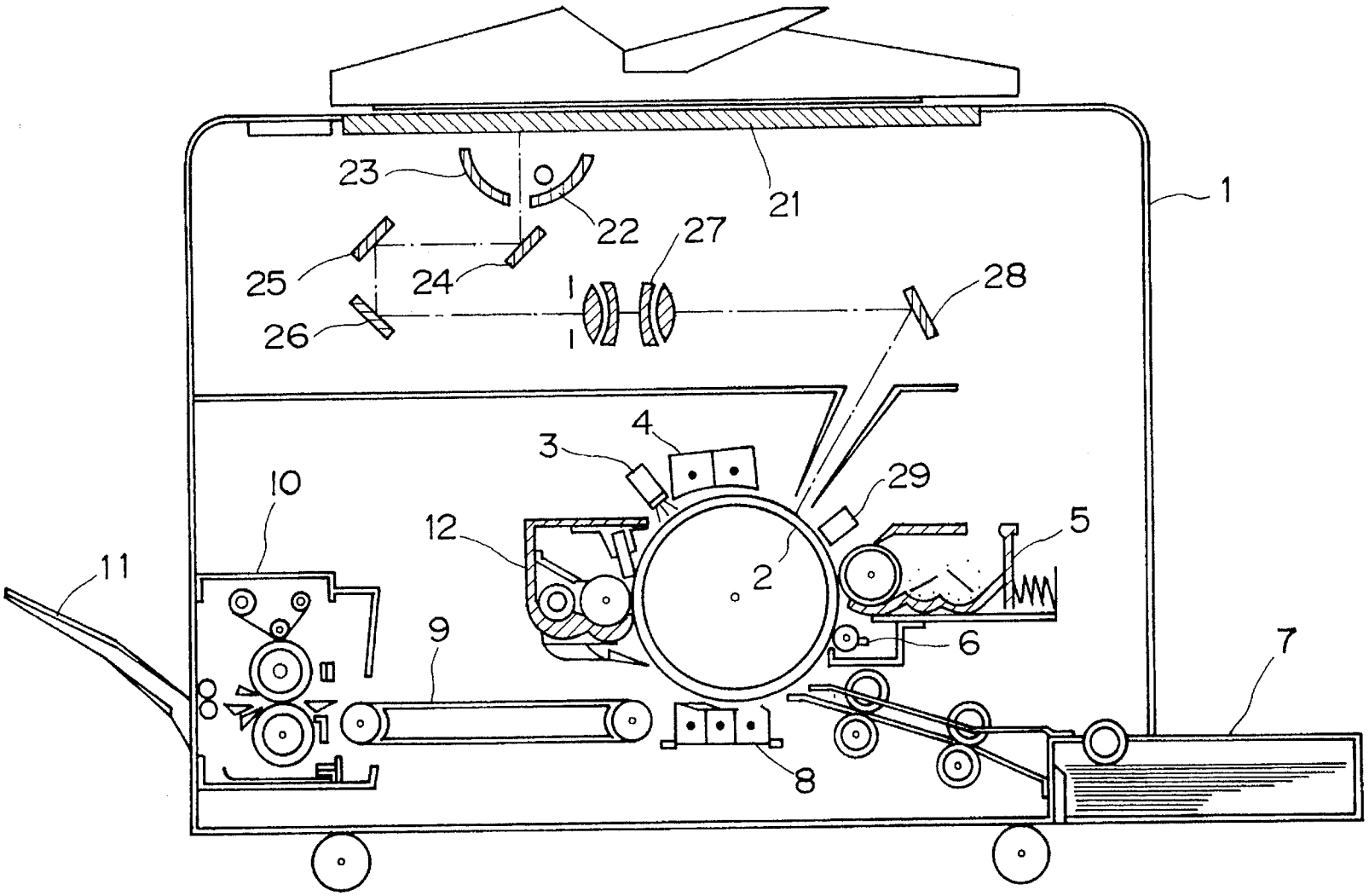
FIG. 1 is a side sectional view illustrating the general configuration of an image forming apparatus according to first through fourth embodiments of the invention.

FIG. 1 is a side sectional view showing the general configuration of an image forming apparatus according to the first embodiment of the present invention. Numeral 1 denotes the image forming apparatus, which forms a visible image on a recording medium using electrophotographic process. The image forming apparatus 1 is used in copiers, printing machines, facsimile machines and printers, etc. The apparatus 1 includes a photosensitive drum serving as the image carrier along the periphery of which are arranged a corona de-charging device 3 for removing potential from the receptor drum 2, a primary corona charging device 4 for charging the photosensitive drum, a developing device 5 for developing a latent image on the photosensitive drum by means of toner, a scraping roller 6 for removing excess toner from non-imaging areas of the photosensitive drum, a transfer separation charging device 8 for affixing toner to a transfer member, and a cleaning unit 12 for removing residual toner. Toner is transferred by the transfer separation charging device 8 to the recording medium conveyed from a feed-paper deck 7. The transfer member to which the toner has been transferred arrives at a fixed unit 10 via a conveyor belt 9. The fixing unit 10 fixes the toner on the transfer member, after which the transfer member is discharged into a discharged-paper tray 11.

An original placed upon a glass platen 21 is irradiated by an original irradiating lamp 22 and a reflector 23. The reflected light from the original is reflected by mirrors 24, 25, 26, passes through an enlargement/reduction lens 27 and impinges upon a projecting mirror 28, whereby the image of the original is projected upon the receptor drum 2.

Figure 2:
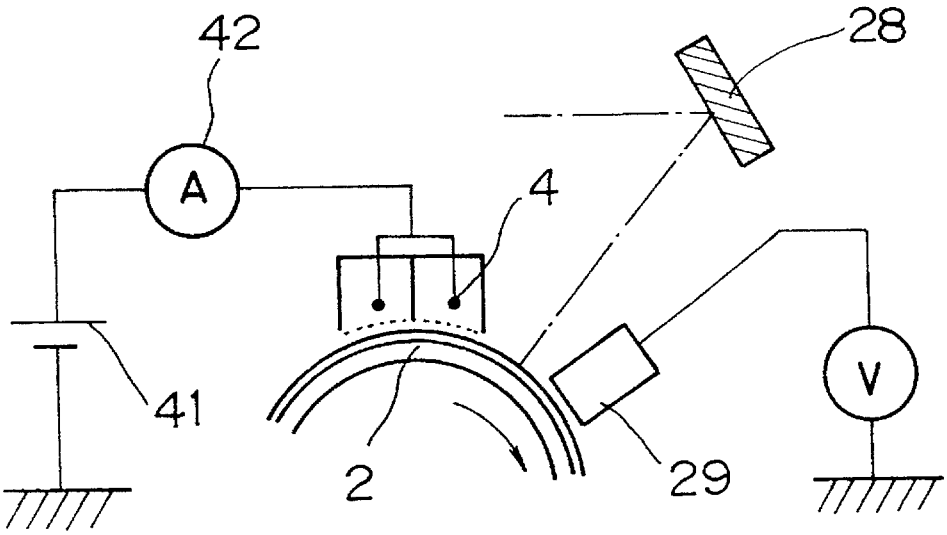
FIG. 2 is an electrical schematic view of a primary corona charging device and an exposure system.

FIG. 2 is an electrical schematic view illustrating the primary charging device 4 and an exposure system. A DC power supply 41 applies a positive voltage to the electrodes of the primary charging device 4 in order to positively charge the photosensitive drum 2 by corona discharge. The photosensitive drum 2 carrying this potential is rotated clockwise in FIG. 2, whereby the photosensitive drum is exposed by the light, which has been reflected from the original, incident thereon via the projecting mirror 28. This causes a latent image to be formed. This is followed by the developing process. When surface potential controlling is performed, a potential sensor 29 measures the surface potential on the photosensitive drum after exposure of a light image for measurement purposes, and a current varying mechanism (not shown) within the DC power supply 41 is varied based upon the measured surface potential, thereby adjusting the surface potential to the optimum value. Further, an ammeter 42 monitors the amount of current consumed by the primary charging device 5.

Figure 3:
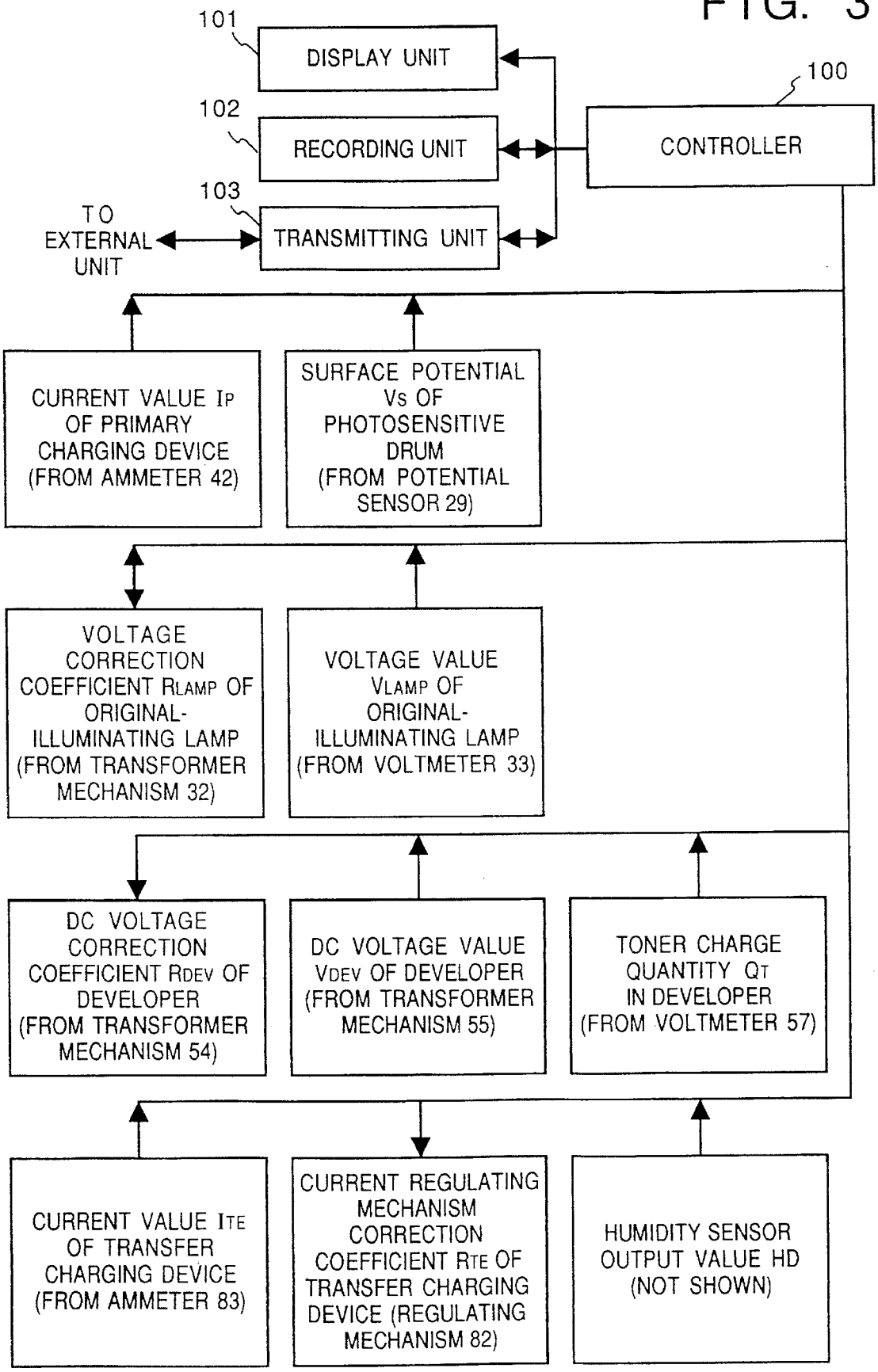
FIG. 3 is a block diagram illustrating the control configuration of a fault diagnosing unit for executing fault diagnosis.

FIG. 3 is a block diagram illustrating the general configuration of a fault diagnosing unit for executing fault diagnosis according to this embodiment. FIG. 3 shows not only the ammeter 42 and the potential sensor 29 but also status quantities to be entered and detectors for detecting these status quantities or correction mechanisms for changing parameters in each of the embodiments described below. Each detector or correction mechanism is connected to a controller 100 that executes fuzzy reasoning. Also connected to the controller 100 are a display unit 101 for displaying inferential results or detection data, a recording unit 102 for executing recording of various data on a floppy disk or printer, and a transmitting unit 103 for remotely transferring various data.

Figure 4:
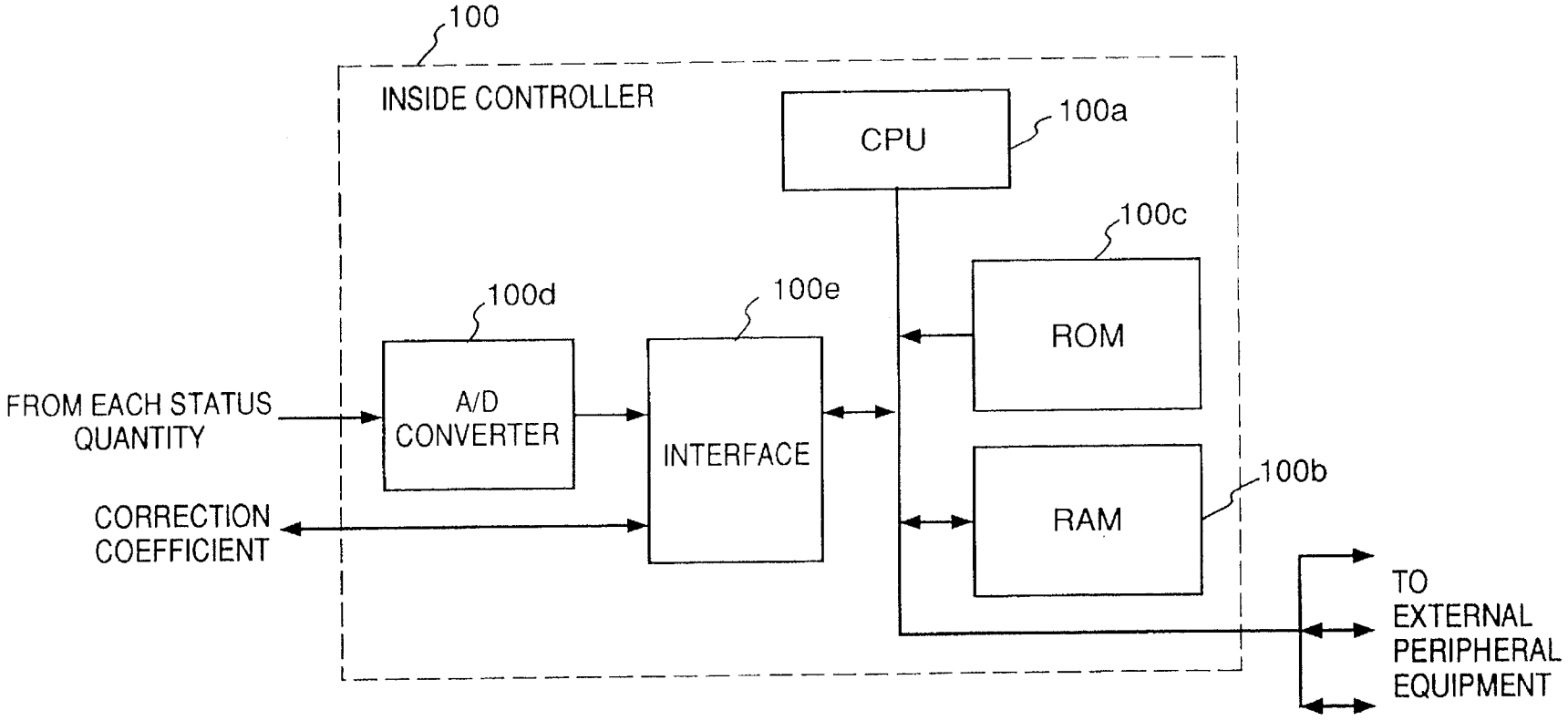
FIG. 4 is a block diagram illustrating the general configuration in a controller of the fault diagnosing unit.

FIG. 4 is a block diagram illustrating the general configuration internally of the controller 100. The controller 100 includes a CPU 100*a* that executes processing for performing fuzzy reasoning, described below, a RAM 100*b* for storing various status quantities and the like, a ROM 100*c* in which various membership functions, fuzzy rules and a reasoning program has been stored. The RAM and ROM are connected to the CPU 100*a*. Also included are an A/D converter 100*d* for accepting data representing status quantities from each of the detectors and converting this data into digital data, and an interface IC 100*e*, to which digital data representing status quantities from the A/D converter 100*d* is applied, for transferring this digital data to the CPU 100*a*. Also applied to the interface IC 100*e* are correction coefficients from each of the correction mechanisms. It should be noted that since the correction coefficients in the correction mechanisms are capable of being changed, it is possible for these to be outputted from the controller 10 as well. Further, in order to perform display, recording and transmission, the CPU bus is connected also to external peripheral equipment.

In the present embodiment, use is made of the CPU 100*a*, which is an ordinary digital processor. However, it is permissible to use an IC exclusively for fuzzy reasoning. In addition, the above-described fault diagnostic unit may be incorporated in the image forming apparatus 1 or may be connected as an external device.

Abnormal situations in density management, which is the object of fault diagnosis in this embodiment, are of two types. One is a serious situation in which the image becomes all black or all white, and the other is a situation in which the abnormality proceeds gradually with time, as in the manner of a lightening in density or the occurrence of fogging. The former or serious situation is caused by a sudden failure such as disconnection of the original illuminating lamp or pull-out of the connector of an charging device. Accordingly, as in the prior art, a predetermined threshold value is set for each status quantity, and it will suffice to judge that an abnormality has occurred only when the threshold value is exceeded.

In the latter situation in which density diminishes and fogging occurs, gradual deterioration and fluctuation of each process element are causes and therefore it is difficult to judge abnormalities using the conventional diagnostic techniques. Furthermore, in other than extreme cases, evaluation is difficult to perform even if a plurality of status-quantity inputs are used to make judgment. Accordingly, in the first embodiment of the invention, a plurality of status quantities are adopted as inputs, failure rate regarding a process element is adopted as an output, and processing for outputting failure rate is executed by fuzzy reasoning. In the first embodiment, a reasoning method is described below for judging the failure rate of the primary charging device 4, which is one process element related to a state in which density becomes too light.

First, as input status quantities, use is made of a current value $I_P$, of the primary charging device, outputted by the ammeter 42, and a voltage value $V_S$ outputted by the potential sensor 29. With regard to $V_S$, potential can take on a value between a surface potential, namely a dark-area potential $V_D$, which prevails when the exposure lamp is turned off (or when a black image is exposed), and a surface potential, namely a light-area potential $V_L$, which prevails when the exposure lamp exposes a white image. Here the dark-area potential $V_D$ is adopted as the input status quantity.

Let a deterioration rate $NG_P$ of the primary charging device 4 be a process element to be judged. This deterioration mainly is caused by contamination of the primary charging device 4 and the periphery thereof and proceeds gradually as time in use lengthens. Consequently, discriminating failure by making a comparison with an abnormal value as in the prior art is difficult.

Figure 5A:
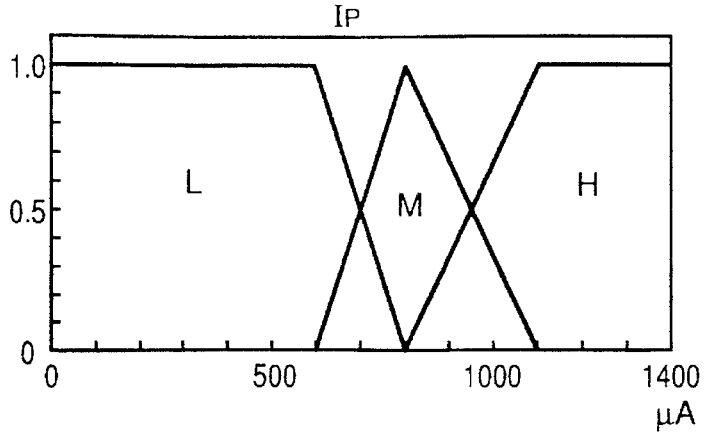
FIGS. 5A to 5C are diagrams showing membership functions of input status quantities and output inferential quantities in the first embodiment.
Figure 5B:
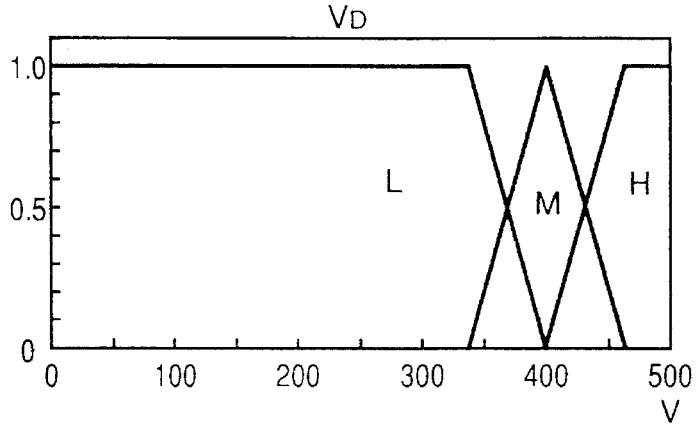
Figure 5C:
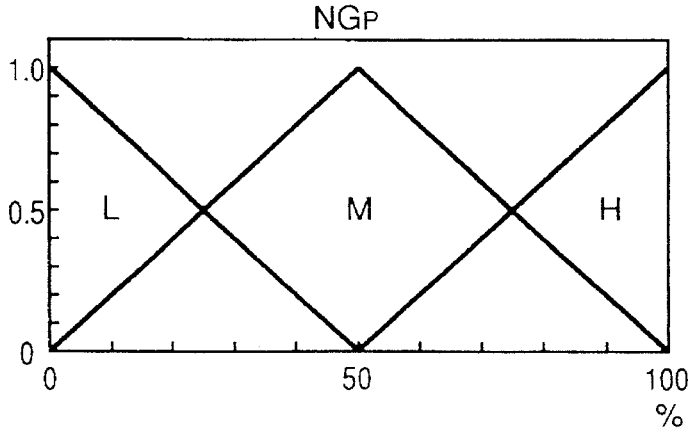

FIGS. 5A to 5C are diagrams showing membership functions of input status quantities and output inferential quantities in the first embodiment. Here in FIG. 5A illustrates membership functions regarding the current value $I_P$ of the primary charging device. The current value $I_P$ of the primary charging device 4 takes on values from 0 μA, which is that at which the primary charging device is not being energized, to 1400 μA, which is that at which a limiter mechanism is actuated. Since the ordinary current value is on the order of 800 μA, the membership function of a medium level M in this vicinity is assigned a triangular shape, and the low and high levels are represented by L and H, respectively, thereby defining a total of three types of membership functions.

Membership functions regarding the dark-area potential $V_D$ are illustrated in FIG. 5B. Here the surface potential takes on values from 0 V, which is when the photosensitive drum has no potential, to a maximum of 500 V. Thus, 0 to 500 V is the charging region. Since the ordinary dark-area potential is on the order of 400 V, the membership function of a medium level M in this vicinity is assigned a triangular shape, and the low and high levels are represented by L and H, respectively, thereby defining a total of three types of membership functions.

Furthermore, FIG. 5C illustrates membership functions regarding the deterioration rate $NG_P$ of the primary charging device 4, which is the output of this fuzzy reasoning operation. Three types of membership functions for L, M and H are defined in order starting from the low level. These are defined in such a manner that the deterioration rate will be 0% if there is no deterioration and 100% if deterioration is so severe as to require immediate replacement.

Fuzzy rules serve as important initial conditions in terms of performing fuzzy reasoning. FIG. 6 is a diagram showing fuzzy rules according to the first embodiment. In this embodiment there are two input status quantities $I_P$ and $V_D$, and three types of levels are defined for each status quantity. Accordingly, there are a total of nine types of states. These are the condition parts (antecedents) of "If ~, then ~" statements, which are rules for implementing fuzzy reasoning. The output is the deterioration rate $NG_P$ of the primary charging device 4. This is the operation part (consequent). The level of the condition part is decided based upon experience. In the case of the first embodiment, a fuzzy rule is defined in such a manner that there will be a tendency for the deterioration rate $NG_P$ to increase when $I_P$ increases and to increase even when $V_D$ declines.

As an example of a fuzzy rule, we may write

"IF $I_P$=H AND $V_D$=L, THEN $NG_P$=H"

in a case where $I_P$=H, $V_D$=L, $NG_P$=H. In this first embodiment, nine types of such "If ~, then ~" statements exist, as shown in FIG. 6.

By executing fuzzy reasoning using the membership functions and fuzzy rules defined as set forth above, it is possible to judge the degree of deterioration of the primary charging device 4 in relation to a state in which density becomes too light.

Figure 7:
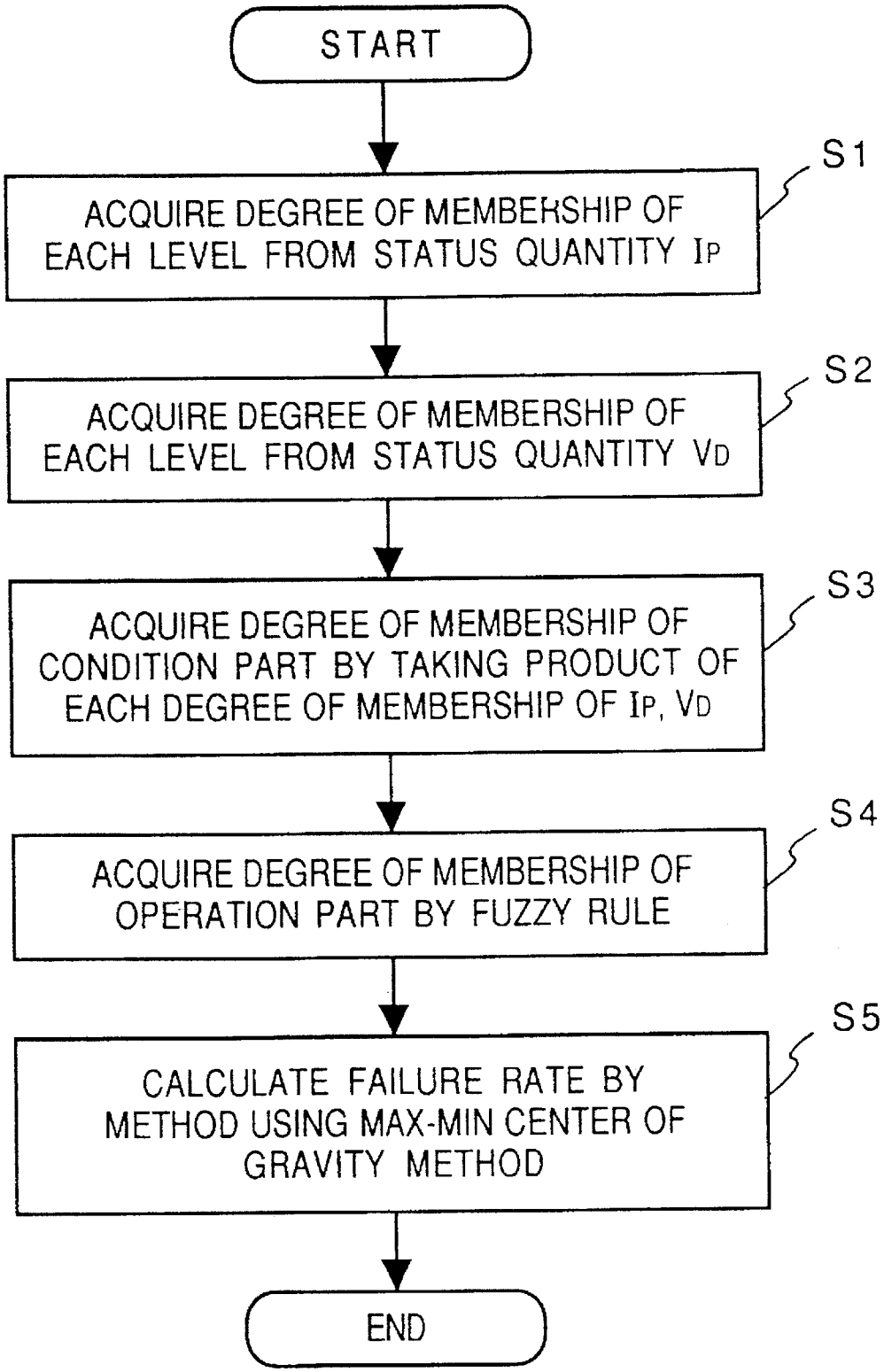
FIG. 7 is a flowchart illustrating the procedure of fuzzy reasoning according to the first embodiment.

In the first embodiment, the method of fuzzy reasoning performed by the controller 100 is as follows: Specifically, FIG. 7 is a flowchart showing the procedure of fuzzy reasoning according to the first embodiment. First, at step S1, the current value $I_P$ of the primary charging device 4 is used as the input status quantity to find the degree of membership in each level (L, M, H) of the membership functions shown in FIG. 5A. Similarly, at step S2, the dark-area potential $V_D$ is used as the input status quantity to find the degree of membership in each level of the membership functions shown in FIG. 5B. Step S3 is processing for finding the product of every combination of two degrees of membership obtained from each of the quantities $I_P$, $V_D$ and adopting the product as the degree of membership of each condition part.

Next, at step S4, degree of membership of the operation part with respect to each condition part is found in accordance with the fuzzy rule of FIG. 6 using the degree of membership of each condition part, obtained at step S3, and the degree of membership of $NG_P$ [FIG. 5C]. Next, at step S5, an operation is performed with regard to the calculated degree of membership of each operation part using a MAX-MIN center of gravity method, and an output inferential quantity is obtained.

Figure 8:
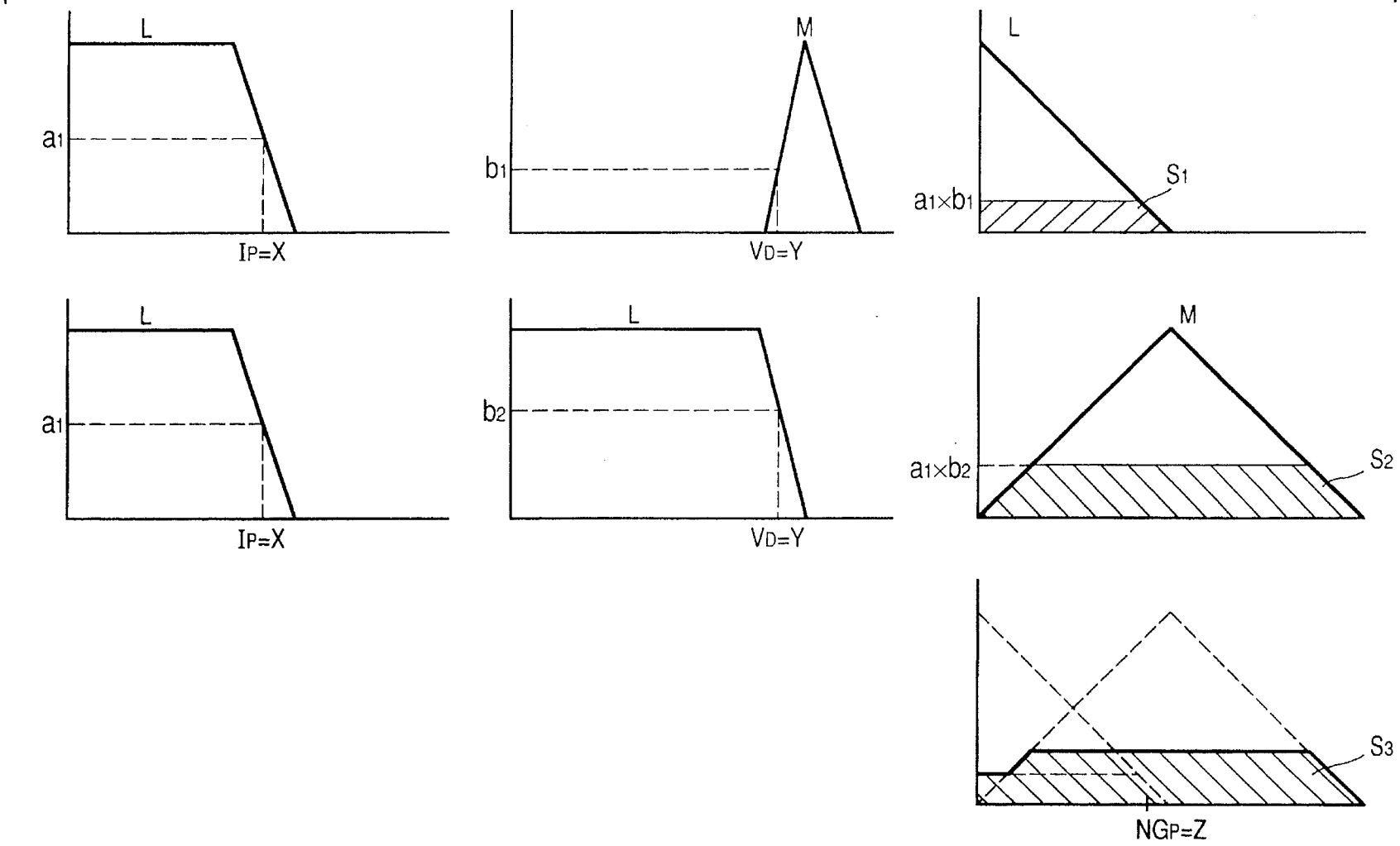
FIG. 8 is a diagram for describing the procedure of fuzzy reasoning according to the first embodiment.

The procedure for fuzzy reasoning will be described in greater detail with reference to FIG. 8. In a case where x is entered as the status quantity $I_P$ and y as the status quantity $V_D$, $a_1$ is obtained as the degree of membership of level L from the membership function of $I_P$. Further, $b_1$ is obtained as the degree of membership of level M and $b_2$ as the degree of membership of level L from the membership function of $V_D$. Accordingly, by subjecting the membership function of the $NG_P$=L level to a MAX operation, as in the manner $a_1 \times b_1$, with respect to the fuzzy rule "IF $I_P$=L AND $V_D$=M, THEN $NG_P$=L" for example, the shaded portion $S_1$ in FIG. 8 is obtained as the degree of membership of the operation part. Similarly, the shaded portion $S_2$ is obtained in relation to the fuzzy rule "IF $I_P$=L AND $V_D$=L, THEN $NG_P$=M". By subjecting the thus obtained inferential results (the shaded portions $S_1$, $S_2$) of each level to MAX composition and determining the centroid z of this compositional portion, inferential results are obtained. In the description set forth above, two fuzzy rules are discussed. In actuality, however, inferential results of each level unit are acquired and these are subjected to MAX synthesis by a similar method with regard to all of the other fuzzy rules.

Figure 9:
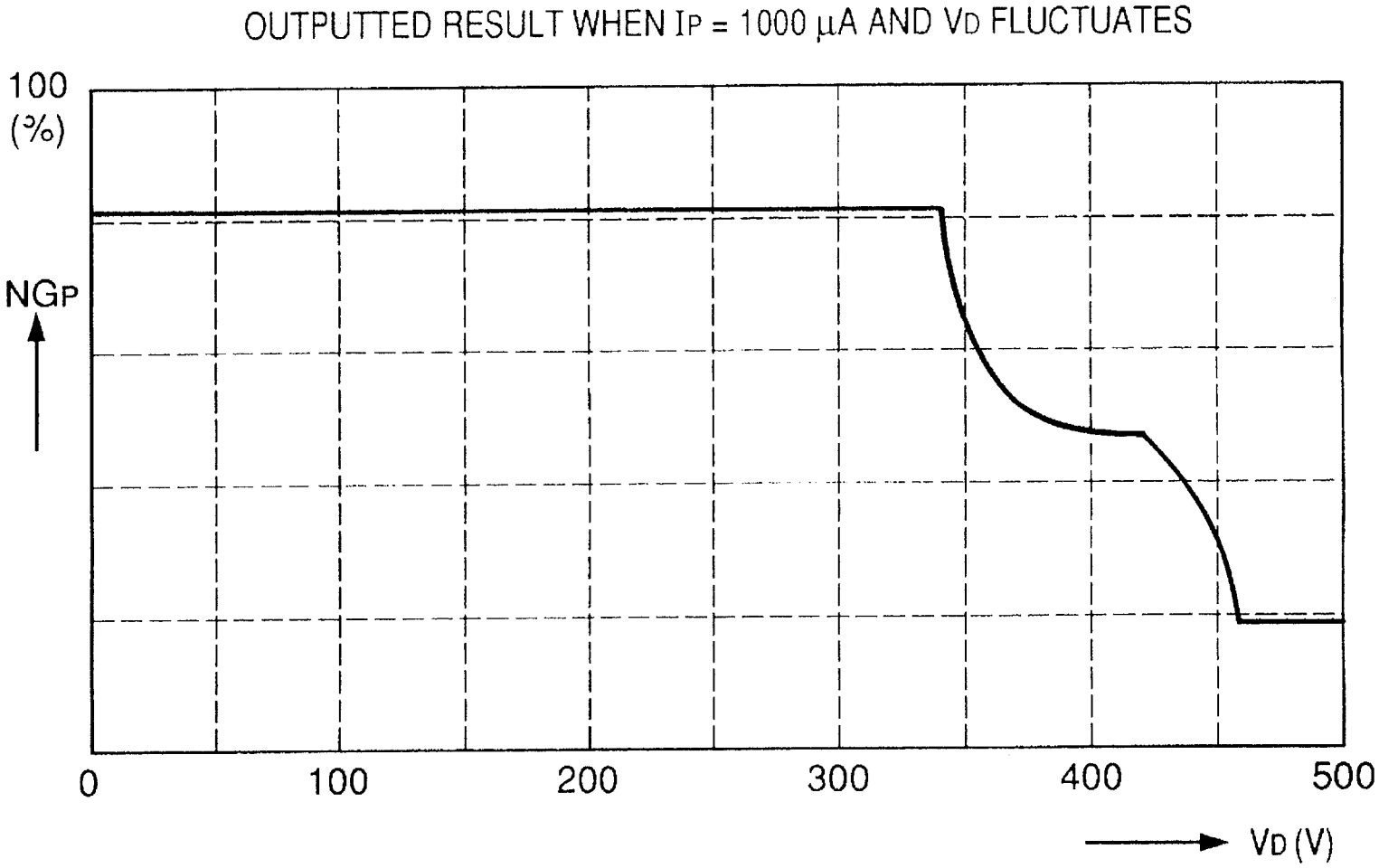
FIG. 9 is a diagram showing an example of the output of fuzzy reasoning according to the first embodiment.

FIG. 9 illustrates output results in a case where the input value $I_P$ is fixed at 1000 μA and the input value $V_D$ is varied. The input value VD is plotted along the horizontal axis, and the rate of deterioration $NG_P$ of the primary charging device is plotted along the vertical axis. In particular, when $V_D$ is less than 400 V, the rate of deterioration $NG_P$ of the primary charging device rises. Thus, it will be understood that the relationship between $I_P$, $V_D$ entered based upon experience and the output NGP is smoothly expressed by fuzzy reasoning. By storing this failure rate in memory or outputting it by means of a display unit, the user or serviceman is capable of closely ascertaining the state of deterioration of a process element.

According to the first embodiment, a fuzzy reasoning method is described for judging the failure rate of the primary charging device 4 in relation to a state in which the density becomes too light. However, it is possible to judge faults with regard to fogging as well by changing the fuzzy rule while the input status quantities remain the same. In such case, the membership functions of the input status quantities may be identical or may be defined separately.

<Second Embodiment>

In the first embodiment set forth above, the description relates to a method of fuzzy reasoning for judging failure rate of the primary charging device 4 in relation to a lightening of density. A second embodiment described below deals with fuzzy reasoning for judging the failure rate of the lamp that irradiates the original as well as an erroneous setting of the correction mechanism for this lamp. The second embodiment relates to fogging as the problem to be dealt with through control of density.

Figure 10:
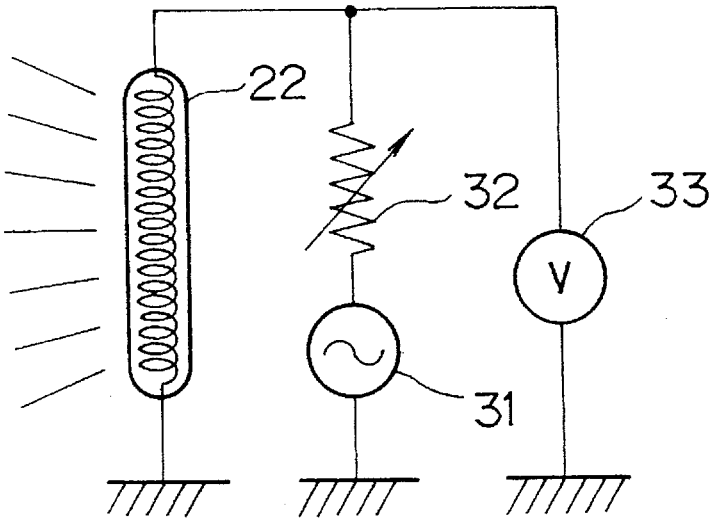
FIG. 10 is an electrical schematic view of the exposure system.

FIG. 10 is an electrical schematic view of the exposure system. The system includes the original-illuminating lamp 22, an AC power supply 31, a transformer mechanism 32 for controlling the voltage applied to the original-illuminating lamp 22, and a voltmeter 33 for monitoring the voltage value. As shown in FIG. 3, the transformer mechanism 32 and the voltmeter 33 are connected to the controller 100 that executes fuzzy reasoning, and the correction coefficient and voltage value thereof are used as input status quantities.

There are three input status quantities, namely light-area potential $V_L$ (potential in a case where the exposure system exposes a white image) obtained by the potential sensor 29 described in the first embodiment, a voltage value $V_{LAMP}$ outputted by the voltmeter 33, and a correction coefficient $R_{LAMP}$ for setting the transformer mechanism 32. There are two process elements to be judged, namely deterioration rate $NG_{LAMP}$ of the original-illuminating lamp and erroneous setting rate $NG_{RL}$ of the correction coefficient of the transformer mechanism.

Figure 11A:
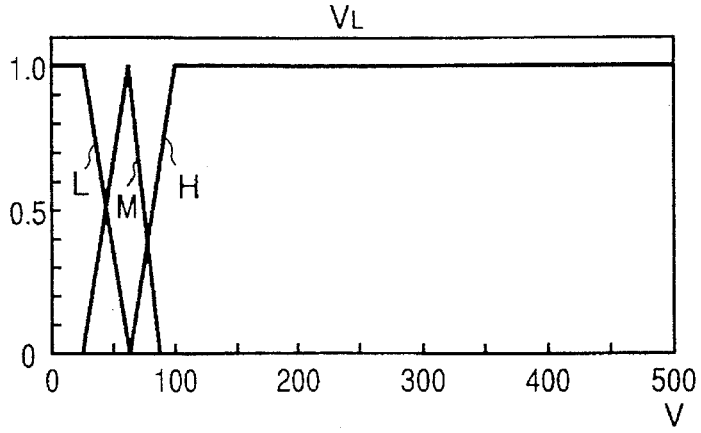
FIGS. 11A to 11C are diagrams showing membership functions of input status quantities in the second embodiment.
Figure 11B:
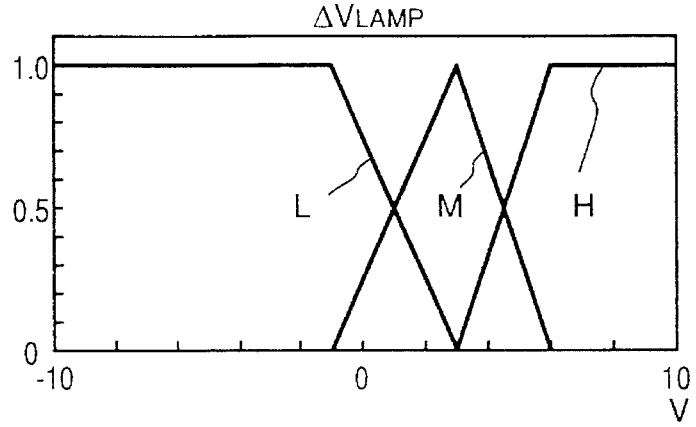
Figure 11C:
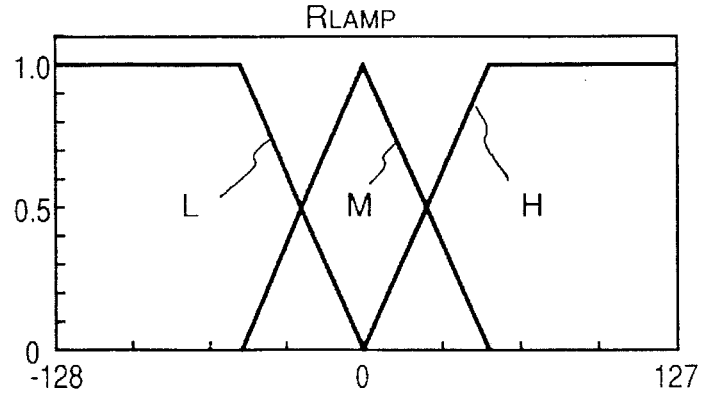

FIGS. 11A to 11C are diagrams showing membership functions of the input status quantities in the second embodiment. Membership functions regarding the light-area potential $V_L$ of the photosensitive drum are illustrated in FIG. 11A. Here the surface potential of the photosensitive drum takes on values from 0 V, which is when the photosensitive drum has no potential, to a maximum of 500 V. Thus, 0 to 500 V is the charging region. Since the ordinary light-area potential is on the order of 60 V, the membership function of a medium level M in this vicinity is assigned a triangular shape, and the low and high levels are represented by L and H, respectively, thereby defining a total of three types of membership functions.

Membership functions regarding the voltage value $V_{LAMP}$ outputted by the voltmeter 33 are illustrated in FIG. 11B. Here the voltage value takes on values from 0 V, which is when the lamp is not being supplied with current, to a maximum of 100 V. However, the usual value is specific to the particular lamp and there is considerable variance from one value to another. In the second embodiment, therefore, (voltage value $V_{LAMP}$)−(reference value) is plotted along the horizontal axis as $\Delta V_{LAMP}$, and the region of fluctuation is assumed to be ±10 V. The membership function of a medium level M in this vicinity is assigned a triangular shape, and the low and high levels are represented by L and H, respectively, thereby defining a total of three types of membership functions. It should be noted that the reference value is a potential necessary for obtaining a suitable amount of exposure and is measured whenever the power supply is turned on. Thereafter, $V_{LAMP}$ is measured upon whenever the suitable amount of exposure is measured and calculated and a maximum value of $V_{LAMP}$ is adopted as $\Delta V_{LAMP}$. Thus, with regard to a process element for which the status quantity exhibits a large variance, stable results can be expected if the amount of fluctuation from the process element itself is adopted as an input.

Membership functions regarding the correction coefficient $R_{LAMP}$ for setting the transformer mechanism 32 are illustrated in FIG. 11C. This correction coefficient is capable of being set over a range of from −128 to 127. The more the coefficient is increased, the more $V_{LAMP}$ rises. Since the coefficient ordinarily is 0, the membership function of a medium level M in this vicinity is assigned a triangular shape, and the low and high levels are represented by L and H, respectively, thereby defining a total of three types of membership functions.

Figure 12A:
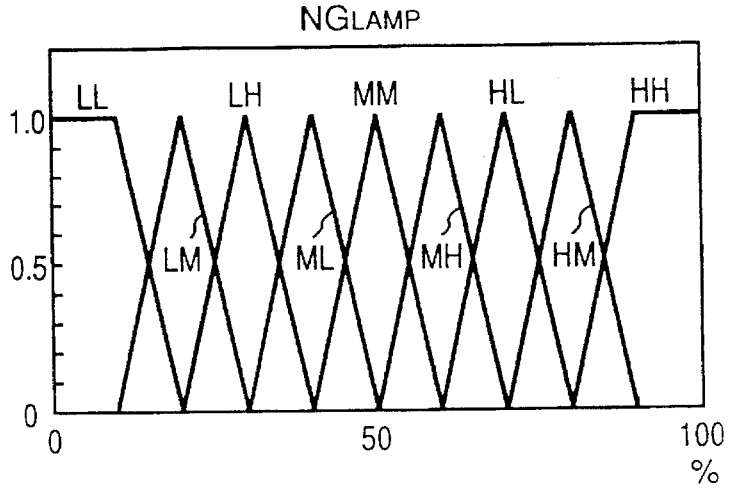
FIGS. 12A and 12B are diagrams showing membership functions of inferential output quantities in the second embodiment.
Figure 12B:
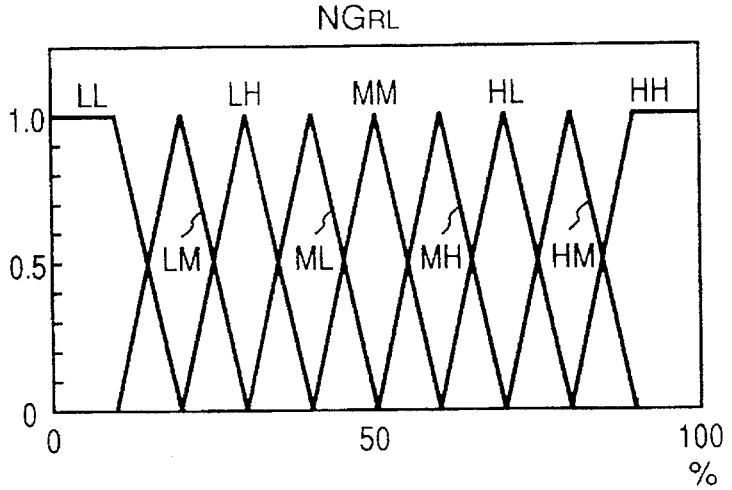

FIGS. 12A and 12B are diagrams showing membership functions of inferential output quantities in the second embodiment. FIG. 12A illustrates membership functions regarding the outputted deterioration rate $NG_{LAMP}$ of the original-illuminating lamp. Nine types of membership functions LL, LM, LH, ML, MM, MH, HL, HM, HH are defined in order starting from the low level. These are defined in such a manner that the deterioration rate will be 0% if there is no deterioration and 100% if deterioration is so severe as to require immediate replacement.

FIG. 12B illustrates membership functions regarding the outputted erroneous setting rate $NG_{RL}$ of the correction coefficient of the transformer mechanism. Nine types of membership functions LL, LM, LH, ML, MM, MH, HL, HM, HH are defined in order starting from the low level. These are defined in such a manner that the erroneous setting rate will be 0% in the absence of an erroneous setting and 100% if immediate resetting is required.

FIG. 13 is a diagram showing fuzzy rules according to the second embodiment. In this embodiment there are three input status quantities, namely $V_L$, $\Delta V_{LAMP}$ and $R_{LAMP}$, and three levels (L, M, H) are defined for each status quantity. Accordingly, there are a total of 27 types of states. These are the condition parts (antecedents) of "If ~, then ~" statements, which are rules for implementing fuzzy reasoning. The outputs are the deterioration rate $NG_{LAMP}$ of the original-illuminating lamp and the erroneous setting rate $NG_{RL}$ of the correction coefficient of the transformer mechanism. These are independent of each other and become the operation parts (consequents).

The levels of these condition parts are decided based upon experience. In the case of the second embodiment, and with regard to the deterioration rate $NG_{LAMP}$ of the original-illuminating lamp, a fuzzy rule is defined in such a manner that there will be a tendency for the deterioration rate to increase if $V_L$ increases, to increase even if $\Delta V_{LAMP}$ increases, and to increase even if $R_{LAMP}$ increases. With regard to the erroneous setting rate $NG_{RL}$ of the correction coefficient of the transformer mechanism, a fuzzy rule is defined in such a manner that there will be a tendency for the erroneous setting rate to increase if $V_L$ increases and to increase even if $R_{LAMP}$ decreases. The increase or decrease in $\Delta V_{LAMP}$ is set so as not to have much effect upon $NG_{RL}$.

When fuzzy reasoning is executed as in the above-described first embodiment using the membership functions and fuzzy rules defined as set forth above, it is possible to judge the extent of the deterioration rate of the original-illuminating lamp in relation to fogging as well as the rate of erroneous setting of the lamp transformer mechanism in relation to fogging. With regard to the rate of erroneous setting, a self-recovery function can be obtained by feeding this back in a direction that will result in correction.

In a case where two or more decisions are made as outputs as in the case of the second embodiment, it is possible to define membership functions separately even when identical input status quantities are used.

According to the second embodiment, a fuzzy reasoning method is described for judging the failure rate of the original-illuminating lamp and the rate of erroneous decisions of the correction mechanism in relation to fogging. However, it is possible to make judgments with regard to a lightening of density as well by changing only the fuzzy rule while using these input status quantities. In such case, the membership functions for inputs may be identical or may be defined separately.

<Third Embodiment>

In the first and second embodiments set forth above, the description relates to a method of fuzzy reasoning for judging failure rate or erroneous setting rate with regard to the process elements of charging and exposure. A third embodiment described below deals with fuzzy reasoning for judging erroneous setting of applied voltage, deterioration of toner and mechanical irregularity of the developer in the development process. As in the first embodiment, this embodiment relates to lightening of density as the problem to be dealt with through control of density.

Figure 14:
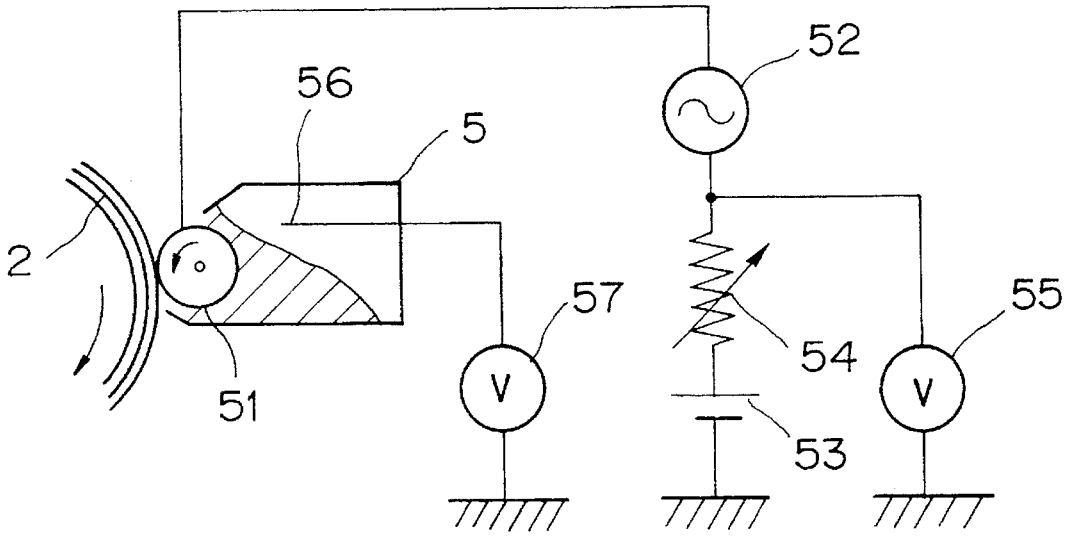
FIG. 14 is an electrical schematic view of a developer.

FIG. 14 is an electrical schematic view of the developer 5. Arranged within the developer 5 is a developer sleeve 51 for affixing toner to the photosensitive drum 2. The sleeve 51 rotates in the same direction as the photosensitive drum. In order to affix the toner, DC and AC voltages are applied to the developer sleeve 51. An AC power supply 52, a DC power supply 53 and a transformer mechanism 54 for adjusting the DC voltage are connected as the power source. A voltmeter 55 monitors the DC voltage value. Furthermore, a voltage detector 56 is installed within the developer as means for ascertaining deterioration of the toner. A voltmeter 57 monitors the amount of electric charge possessed by the toner.

There are two input status quantities in the third embodiment, namely applied DC voltage $V_{DEV}$ outputted by the voltmeter 55 and toner charge quantity $Q_T$ outputted by the voltmeter 57. There are three process elements to be judged, namely erroneous setting rate $NG_{RD}$ of the correction coefficient of the transformer mechanism 54 that adjusts the applied DC voltage, toner deterioration rate $NG_{TN}$ and mechanical irregularity of the developer.

Figure 15A:
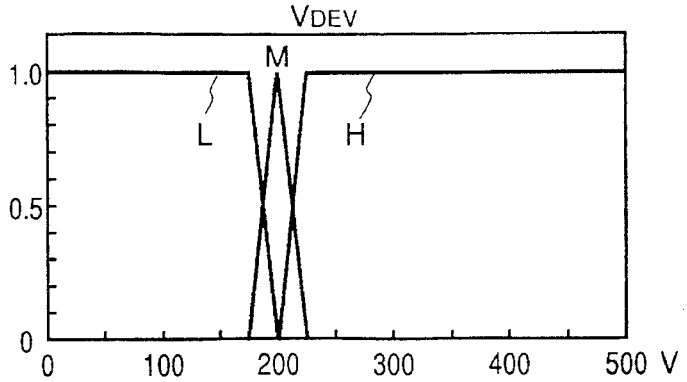
FIGS. 15A to 15D are diagrams showing membership functions of input status quantities and output inferential quantities in the third embodiment.

FIGS. 15A to 15D are diagrams showing membership functions of the input status quantities and output inferential quantities in the third embodiment. Membership functions regarding the applied DC voltage $V_{DEV}$ outputted by the voltmeter 55 are illustrated in FIG. 15A. Here the applied DC voltage takes on values from a minimum of 0 V to a maximum of 500 V. Thus, 0 to 500 V is the voltage region. Since the ordinary applied DC voltage is on the order of 200 V, the membership function of a medium level M in this vicinity is assigned a triangular shape, and the low and high levels are represented by L and H, respectively, thereby defining a total of three types of membership functions.

Figure 15B:
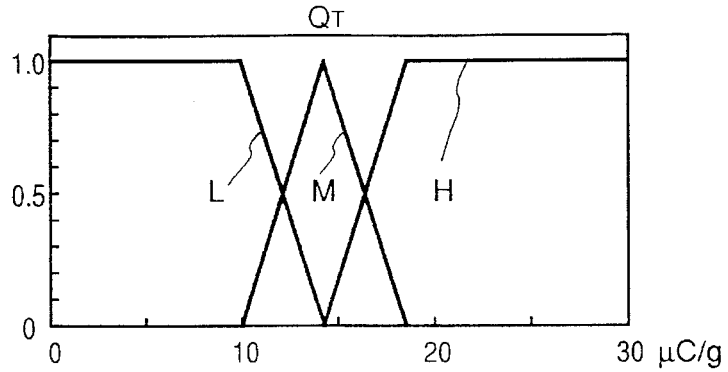

Membership functions regarding the toner charge $Q_T$ outputted by the voltmeter 57 are illustrated in FIG. 15B. Here the toner charge possesses a charge region of from 0 μC/g, which is when there is no supplied current, to a maximum of 30 μC/g. Since the electric charge of the toner used in the third embodiment ordinarily is on the order of 15 μC/g, the membership function of a medium level M in this vicinity is assigned a triangular shape, and the low and high levels are represented by L and H, respectively, thereby defining a total of three types of membership functions.

Figure 15C:
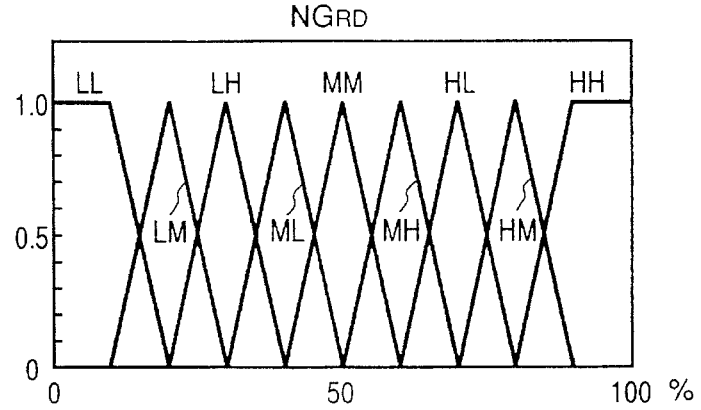

FIG. 15C illustrates membership functions regarding the erroneous setting rate $NG_{RD}$, which is an output quantity, of the correction coefficient of the transformer mechanism. Nine types of membership functions LL, LM, LH, ML, MM, MH, HL, HM, HH are defined in order starting from the low level. These are defined in such a manner that the erroneous setting rate will be 0% in the absence of an erroneous setting and 100% if immediate resetting is required.

Figure 15D:
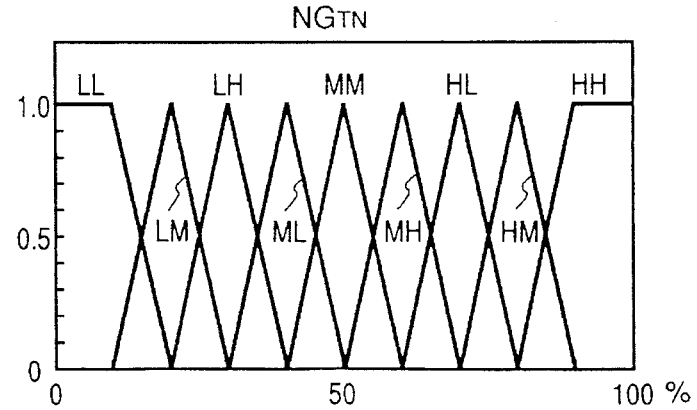

FIG. 15D illustrates membership functions regarding the toner deterioration rate $NG_{TN}$, which is an output. Nine types of membership functions LL, LM, LH, ML, MM, MH, HL, HM, HH are defined in order starting from the low level. These are defined in such a manner that the deterioration rate will be 0% if there is no deterioration and 100% if deterioration is so severe as to require immediate replacement.

Failure rate resulting from mechanical irregularity of the developer will be described later.

Figures 16, 17:
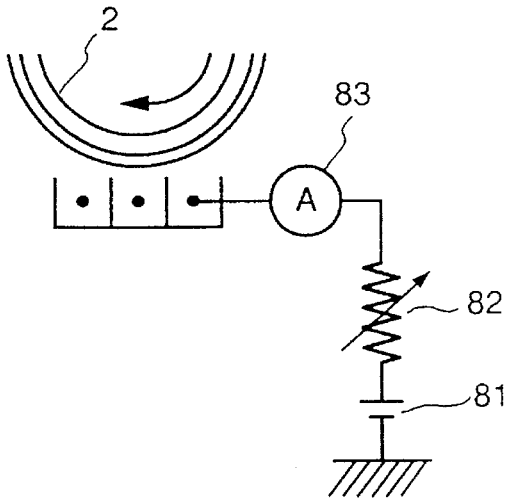
FIG. 16 is a diagram showing fuzzy rules according to the first embodiment.
FIG. 17 is an electrical schematic view related to a corona charging device (hereinafter referred to as a transfer charging device) on the transfer side of a transfer separating charging device.

FIG. 16 is a diagram showing fuzzy rules according to the third embodiment. In this embodiment there are two input status quantities, namely $V_{DEV}$ and $Q_T$, and three levels (L, M, H) are defined for each status quantity. Accordingly, there are a total of nine types of states. These are the condition parts (antecedents) of "If ~, then ~" statements, which are rules for implementing fuzzy reasoning. The outputs are the erroneous setting rate $NG_{RD}$ of the correction coefficient of the transformer mechanism and the deterioration rate $NG_{TN}$ of the toner. These are independent of each other and form the operation parts (consequents). The levels of these condition parts are decided based upon experience. In the case of the third embodiment, and with regard to the erroneous setting rate $NG_{RD}$ of the correction coefficient of the transformer mechanism, a fuzzy rule is defined in such a manner that there will be a tendency for the erroneous setting rate to increase sharply if $V_{DEV}$ increases and to increase even if $Q_T$ decreases. With regard to the toner deterioration rate $NG_{TN}$, a fuzzy rule is defined in such a manner that there will be a tendency for the deterioration rate to increase if $V_{DEV}$ increases and to increase sharply in a case where $Q_T$ is not the usual value.

When fuzzy reasoning indicated by the first embodiment is thus executed using the defined membership functions and fuzzy rules, it is possible to judge the extent of the rate of erroneous setting of the transformer mechanism and the deterioration rate of the toner in relation to a lightening of density. With regard to the rate of erroneous setting, a self-recovery function can be obtained by feeding this back in a direction that will result in correction. When common input status quantities are used in a case where two or more decisions are made as outputs as in the case of the second embodiment, it is possible to define membership functions separately. Further, according to the third embodiment, a fuzzy reasoning method is described for judging the erroneous setting rate $NG_{RD}$ of the transformer mechanism and the toner deterioration rate $NG_{TN}$ in relation to lightening of density. However, it is possible to make judgments with regard to fogging as well by changing only the fuzzy rule and leaving the input status quantities as they are. In such case, the membership functions for the input status quantities used may be identical or may be defined separately.

A method of calculating failure rate owing to mechanical irregularity of the developer 5 will now be described. Mechanical irregularity of the developer refers to a condition in which the position of the developing sleeve 51 within the developer 5 relative to the photosensitive drum 2 fluctuates in comparison with the usual position, or in which foreign matter penetrates into the interior of the developer and causes thinning or the toner layer on the developing sleeve 51 or agglutination of the toner. Lighter density is caused when the distance between the developing sleeve 51 and photosensitive drum 2 is greater than a prescribed value or when the toner layer on the sleeve 51 becomes thinner than usual. Conversely, fogging is caused when the distance between the developing sleeve 51 and photosensitive drum 2 becomes too small or when the toner layer agglutinates. However, it is difficult to incorporate input status quantities for the purpose of ascertaining such mechanical irregularities of the developer. In other words, installing sensors for sensing mechanical irregularity of the developer 5 is difficult in terms of cost and accuracy.

Accordingly, in the third embodiment, the failure rate or erroneous setting rate of a process element that has not been inferred is computed from the failure rate or erroneous setting rate of a process element that has already been inferred. That is, the failure rate or erroneous setting rate of a process element is obtained in accordance with the formula $$\text{(failure rate or erroneous setting rate of process element not been inferred)}=100\% - \max(\text{all } NGx)$$

where NGx represents the failure rate or erroneous setting rate of each process element that has been inferred, and max(all NGx) represents the maximum value of NGx among all values thereof.

The above described operation is executed in a case where an abnormality in density control, namely lightening of density in the third embodiment, is reported by the user or discovered in advance by sensing means inside or outside the machine. The operation is used in order to calculate the failure rate of a process element that has not been inferred.

Each NGx is judged independently. Accordingly, it is desired that each NGx outputted have the same meaning in a case where the degree to which replacement of a process element or resetting of a process condition is required is identical. To this end, it is necessary to optimize the membership functions and fuzzy rules.

In a case where there are a plurality of process elements that have not been inferred, the above-described operation cannot be executed by distinguishing among the process elements. Accordingly, in the third embodiment, when it is judged that there is no possibility of failure or no necessity for resetting, failure rate or erroneous setting rate regarding a processing element not yet inferred is calculated except for process elements and process conditions that have been discriminated by the first, second and third embodiments and by a fourth embodiment, which will be described later. Thus, the failure rate owing to mechanical irregularity of the developer 5 is calculated and judged by the above-described arithmetic method. More specifically, in a case where all NGx have been inferred to be on the low side, the failure rate owing to the remaining mechanical irregularity is judged to be on the high side. If even one NGx is estimated to be high, then the failure rate owing to the remaining mechanical irregularity is estimated to be on the low side.

<Fourth Embodiment>

The fourth embodiment is described in connection with a lightening of density in density control with regard to fuzzy reasoning for judging a deterioration in a transfer charging device and erroneous setting of the correction mechanism of the transfer charging device.

FIG. 17 is an electrical schematic view related to a corona charging device (hereinafter referred to as a transfer charging device) for transfer in the transfer separating charging device 8. In a case where toner electrified by a negative electrode is affixed to the photosensitive drum 2, the transfer charging device causes the toner on the photosensitive drum to become attached to the transfer paper by positive charging. A DC power supply 81 serves as the power supply for the transfer charging device, and the voltage value thereof is controlled by a current regulating mechanism 82. An ammeter 83 monitors the current value.

There are three input status variables, namely a current value $I_{TE}$ outputted by the ammeter 83, an accumulated copy number CV and an output value HD of a humidity sensor (not shown). The CV value is saved in a non-volatile part of the RAM **100*b*** within the controller. Though the CV value may be replaced by the amount of accumulated time the transfer charging device has been in use, resetting must be performed when the transfer charging device is cleaned or replaced. There are two types of process elements to be judged, namely deterioration rate $NG_{TE}$ of the transfer charging device and erroneous setting $NG_{RT}$ of the correction coefficient of the current regulating mechanism.

Figure 18A:
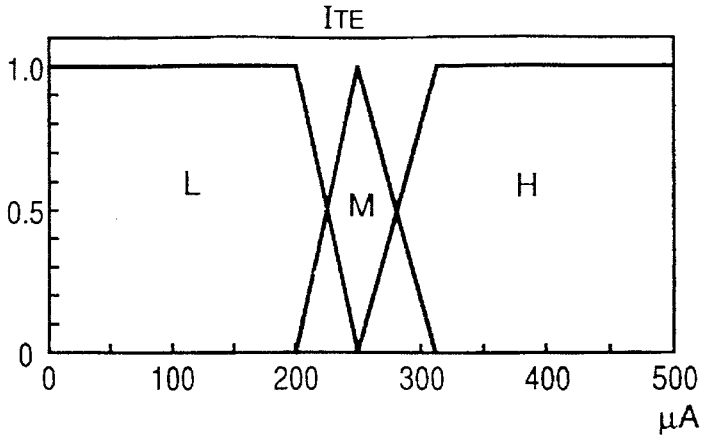
FIGS. 18A to 18C are diagrams showing membership functions of input status quantities in the fourth embodiment.
Figure 18B:
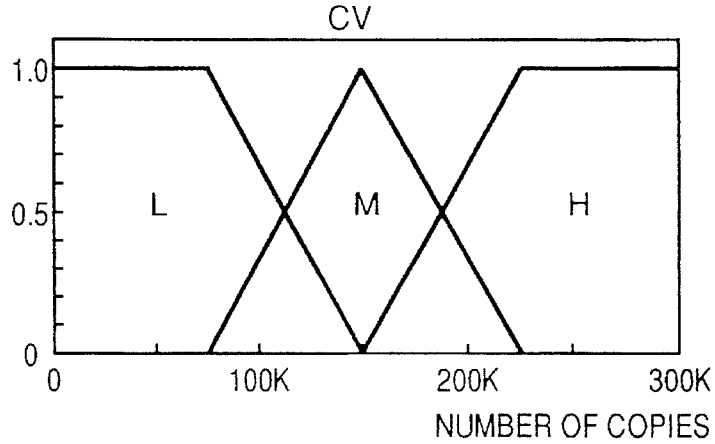
Figure 18C:
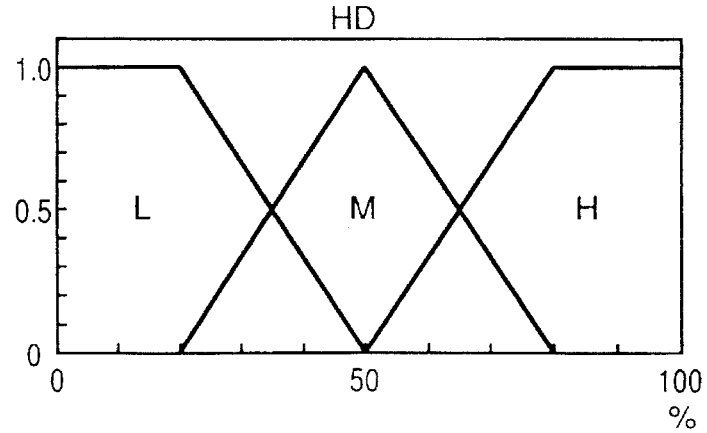

FIGS. 18A to 18C are diagrams showing membership functions of input status quantities in the fourth embodiment. Here in FIG. 18A illustrates membership functions regarding the current value $I_{TE}$ outputted by the ammeter 83. The current value $I_{TE}$ takes on values from 0 μA, which when there is no current being supplied, to 500 μA, which is that at which a limiter mechanism is actuated. Since the ordinary current value is on the order of 300 μA, the membership function of a medium level M in this vicinity is assigned a triangular shape, and the low and high levels are represented by L and H, respectively, thereby defining a total of three types of membership functions.

FIG. 18B illustrates membership functions regarding the number CV of copies outputted. A yardstick of 300,000 copies is the maximum value at which the transfer charging device is cleaned or replaced. A membership function of a medium level M in the vicinity of 150,000 copies is assigned a triangular shape, and the low and high levels are represented by L and H, respectively, thereby defining a total of three types of membership functions. It should be noted that programming is performed in such a manner that 300,000 is adopted as the input value when the figure of 300,000 copies is exceeded, FIG. 18C illustrates membership functions regarding the output value HD from the humidity sensor. The humidity sensor within the main body of the apparatus outputs a parameter for roughly ascertaining the water content of the transfer paper. The value HD has a range of from 0 to 100%. A membership function of a medium level M in the vicinity of 50% is assigned a triangular shape, and the low and high levels are represented by L and H, respectively, thereby defining a total of three types of membership functions.

Figure 19A:
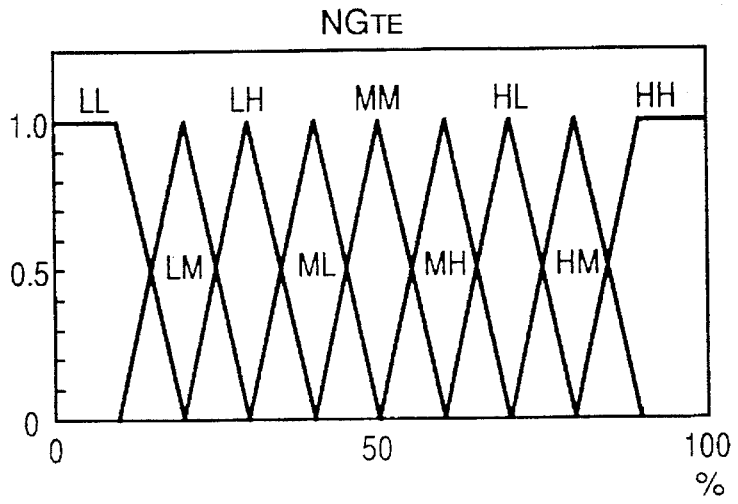
FIGS. 19A and 19B are diagrams showing membership functions of inferential output quantities in the fourth embodiment.
Figure 19B:
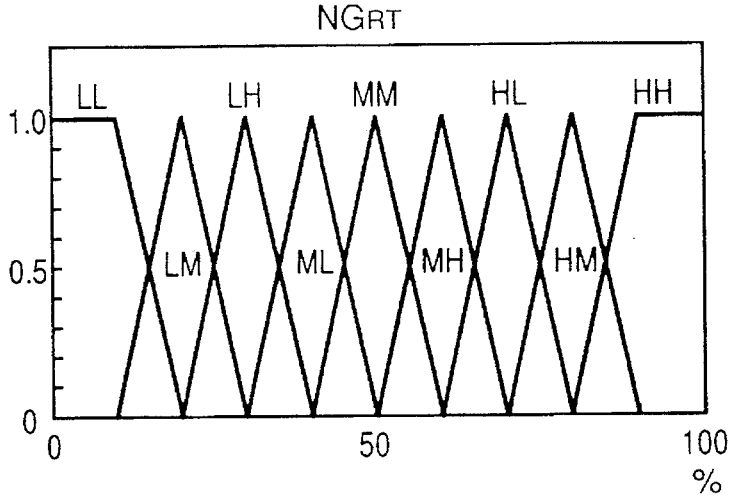

FIGS. 19A and 19B are diagrams showing membership functions of inferential output quantities in the fourth embodiment. FIG. 19A illustrates membership functions regarding the deterioration rate $NG_{TE}$, which is an inferential output quantity, of the transfer charging device. Nine types of membership functions LL, LM, LH, ML, MM, MH, HL, HM, HH are defined in order starting from the low level. These are defined in such a manner that the deterioration rate will be 0% if there is no deterioration and 100% if deterioration is so severe as to require immediate replacement.

FIG. 19B illustrates membership functions regarding the erroneous setting rate $NG_{RT}$, which is an output, of the correction coefficient of the current adjusting mechanism. Nine types of membership functions LL, LM, LH, ML, MM, MH, HL, HM, HH are defined in order starting from the low level. These are defined in such a manner that the erroneous setting rate will be 0% if there is no erroneous setting and 100% if immediate resetting is required.

FIG. 20 is a diagram showing fuzzy rules according to the fourth embodiment. In this embodiment there are three input status quantities, namely $I_{TE}$, $CV_P$ and HD, and three levels (L, M, H) are defined for each status quantity. Accordingly, there are a total of 27 types of states. These are the condition parts (antecedents) of "If ~, then ~" statements, which are rules for implementing fuzzy reasoning. The outputs are the deterioration rate $NG_{TE}$ of the transfer charging device and the erroneous setting rate $NG_{RR}$ of the correction coefficient of the current regulating mechanism. These are independent of each other and form the operation parts (consequents). The levels of these condition parts are decided based upon experience. In the case of the fourth embodiment, and with regard to the failure rate $NG_{TE}$ of the transfer charging device, a fuzzy rule is defined in such a manner that there will be a tendency for the failure rate to increase if $I_{TE}$ decreases, to increase even if CV increases, and to increase even if HD increases. With regard to the erroneous setting rate $NG_{RT}$ of the correction coefficient of the current regulating mechanism, a fuzzy rule is defined in such a manner that there will be a tendency for the erroneous setting rate to increase if $I_{TE}$ decreases, to increase even if CV decreases and to increase even if HD increases.

When fuzzy reasoning similar to that of the first embodiment is thus executed using the defined membership functions and fuzzy rules, it is possible to judge the extent of deterioration of the transfer charging device in relation to lightening of density as well as the rate of erroneous setting of the current regulating mechanism in relation to lightening of density. With regard to the rate $NG_{RT}$ of erroneous setting, self-recovery is possible by feeding this back in a direction that will result in correction. When common input status quantities are used to make two or more decisions as outputs as in the case of the fourth embodiment, it is permissible to define membership functions separately in conformity with the respective inferential quantities. Further, according to the fourth embodiment, a fuzzy reasoning method is described for judging the failure rate of the transfer charging device and the erroneous setting rate of the correction mechanism in relation to lightening of density. However, it is possible to make judgments with regard to fogging as well by changing the fuzzy rule and using identical input status quantities. In such case, the membership functions for input may be identical or may be defined separately.

In accordance with the first through fourth embodiments as described above, status quantities within an image forming apparatus are entered and fuzzy reasoning is executed in order to discriminate deteriorated process elements in density control for dealing with a lightening of density and fogging, the deterioration of which proceeds gradually with time. As a result of this reasoning, it is possible to output the status of deterioration in the form of failure rate or rate of erroneous judgment. The status quantities can be parameters specific to the process elements as well as parameters for executing reasoning such as the environmental status of the apparatus, time in use (time in use since the last repair or replacement), time for replenishment of developing agent or number of output copies. By virtue of this fuzzy reasoning, it is possible not only to discriminate whether the apparatus is malfunctioning or not but also to judge apparatus malfunction more flexibly in the form of failure rate. Further, judgment can be made with ease even with respect to a plurality of status quantities. By notifying the user or serviceman of the failure rate or rate of erroneous judgments after a judgment has been made, it is possible to issue a warning or to ascertain the status of the malfunction.

<Fifth Embodiment>

Figure 21:
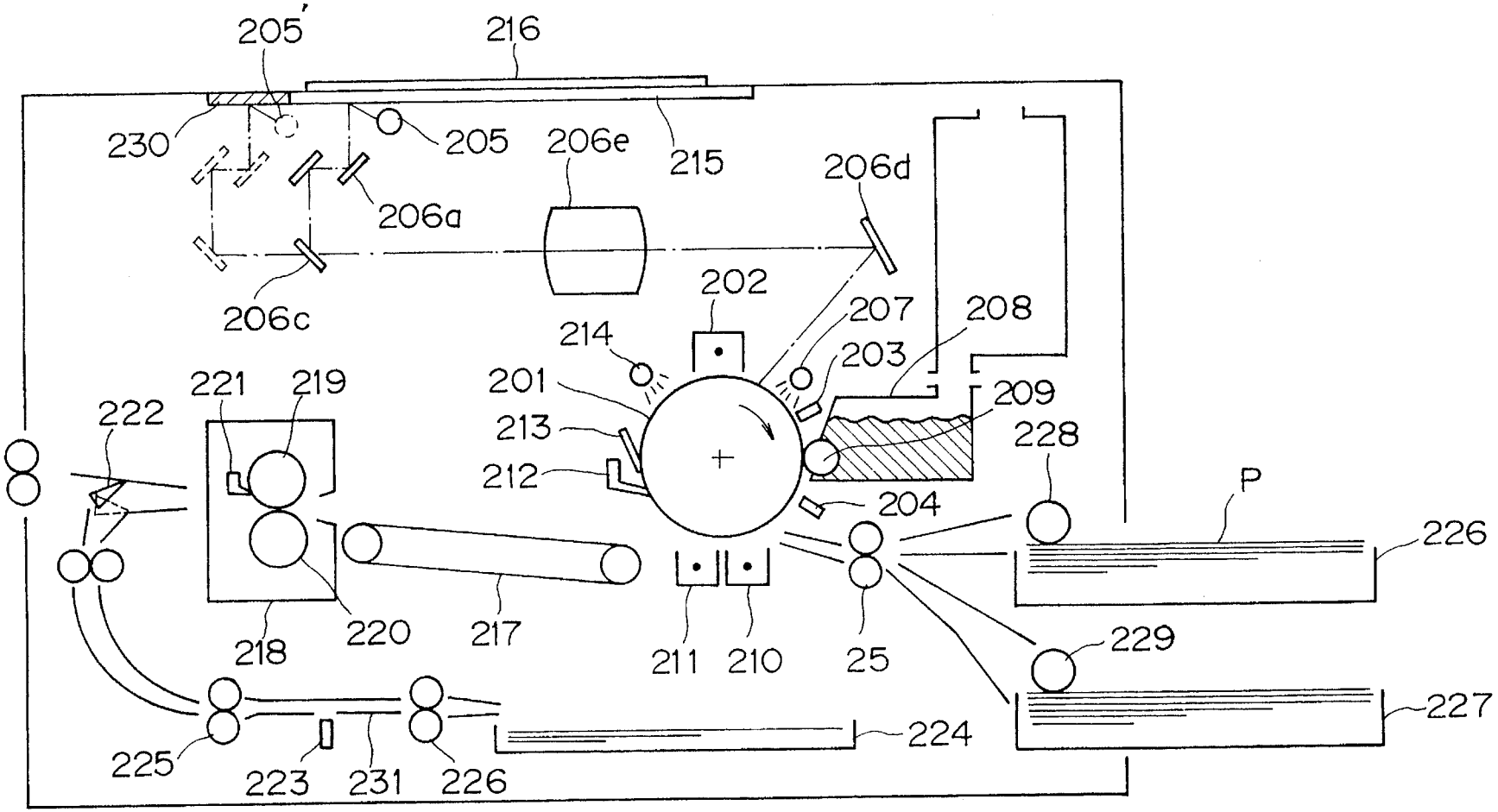
FIG. 21 is a side sectional view illustrating the configuration of an image forming apparatus according to a fifth embodiment of the invention.

A fifth embodiment will be described next. FIG. 21 is a side sectional view illustrating the configuration of an image forming apparatus according to the fifth embodiment of the invention. Though the image forming apparatus of the fifth embodiment has a construction substantially similar to that of the first through fourth embodiments, the overall image forming apparatus will be described afresh as there are some differences.

FIG. 21 shows the entirety of the image forming apparatus. The apparatus includes a glass platen 215 on which an original is placed, an illuminating lamp (exposure lamp) 205 for illuminating the original, first, second and third scanning reflective mirrors (scanning mirrors) 206*a*, 206*b*, 206*c*, respectively, for changing the optical path of light reflected from the original, a lens 206*e* having a focusing and zoom function, a fourth reflective mirror 206*d* for changing the optical path, a photosensitive drum 201, an charging device 202, a blank lamp 207 for removing (erasing) electric charge from a non-image area, a developer 208, a carrier 209 for developing agent (toner), a transfer charging device 210, a separation charging device 211, a separating finger 212 for assisting in separation, a cleaning device 213, a charge removing (discharging) lamp 214, an upper cassette 226, a lower cassette 227, paper-feed rollers 228 and 229, a resist roller 225, a conveyor belt 217 for conveying transfer paper, on which an image has been recorded, to a fixing device, and the fixing device 218 for thermally fixing the transfer paper conveyed thereto.

The surface of the photosensitive drum 201 comprises a seamless photosensitive body that employs a photoconductor. The drum 201, which is axially supported so as to be capable of rotating, starts rotating in the direction of the arrow in FIG. 21 in response to depression of a copy starting key on the control panel. Next, when control for prescribed rotation of the drum 201 and processing (pre-processing) for controlling potential end, an original 216 placed upon the glass platen 215 is illuminated by the illuminating lamp 205, which is arranged as an integral part of the first scanning mirror 206*a*, and light reflected from the original 216 forms an image on the drum 201 via the first scanning mirror 206*a*, second scanning mirror 206*b*, third scanning mirror 206*c*, lens 206*e* and fourth scanning mirror 206*d*.

The drum 201 is corona-charged by the charging device 202. Thereafter, the image of the original is exposed through a slit by the illuminating lamp 2105 so that an electrostatic latent image is formed on the drum 201 by the well-known Carlson process. The illuminating lamp 205, scanning mirrors and lenses 206*a*~206*d*, charging device 202 and photosensitive drum 201 that take part in forming the latent image shall be referred to collectively as a latent-image device.

Next, the electrostatic latent image on the photosensitive drum is developed by the developer 208 so that the image is rendered visible in the form of a toner image, the latter is transferred from the transfer charging device 210 to the transfer paper and the transfer paper is then peeled from the photosensitive drum by the separation charging device 211.

More specifically, transfer paper P in the upper cassette 226 or lower cassette 227 is fed into the inside of the apparatus by the paper-feed roller 228 or 229 so that the leading edge of the toner image and leading edge of the transfer paper will coincide. The transfer paper subsequently passes between the transfer charging device 210 and the drum 201 and then between a heating roller 219 and a pressurizing roller 220 that are in pressured contact with each other, whereby the toner image is thermally fixed. The transfer paper is then ejected from the apparatus. Numeral 221 denotes a fixing separation finger that prevents the transfer paper from becoming wound upon the heating roller 219.

The drum 201 continues rotating after the image transfer so that its surface may be cleaned off by the cleaning device 213. Residual electric charge on the drum 201 is removed by the charge removing lamp 214. Numeral 222 denotes a deflecting plate that changing the traveling path of the transfer paper. The deflecting plate 222 can be changed over to eject the transfer paper from the apparatus or guide it to a discharged-paper tray 224. Numeral 203 designates a potential measuring unit for measuring the potential of the latent image, and 204 a density measuring unit for measuring the density of the toner image. The potential measuring unit 203 and density measuring unit 204 can be moved along the axis of rotation of the photosensitive drum. Numeral 223 denotes a density measuring unit for measuring the density of the transfer paper after fixing. This measuring unit also can be moved along the rotational axis of the drum.

Numeral 205' represents the position of the illuminating lamp 205 when it has been moved to the location of a standard density plate 230. The latter is uniformly coated to a half tone having an optical density of, say, 0.4. Various status quantities for estimating failure rate are obtained by executing a copying operation using the plate 230.

Figure 22:
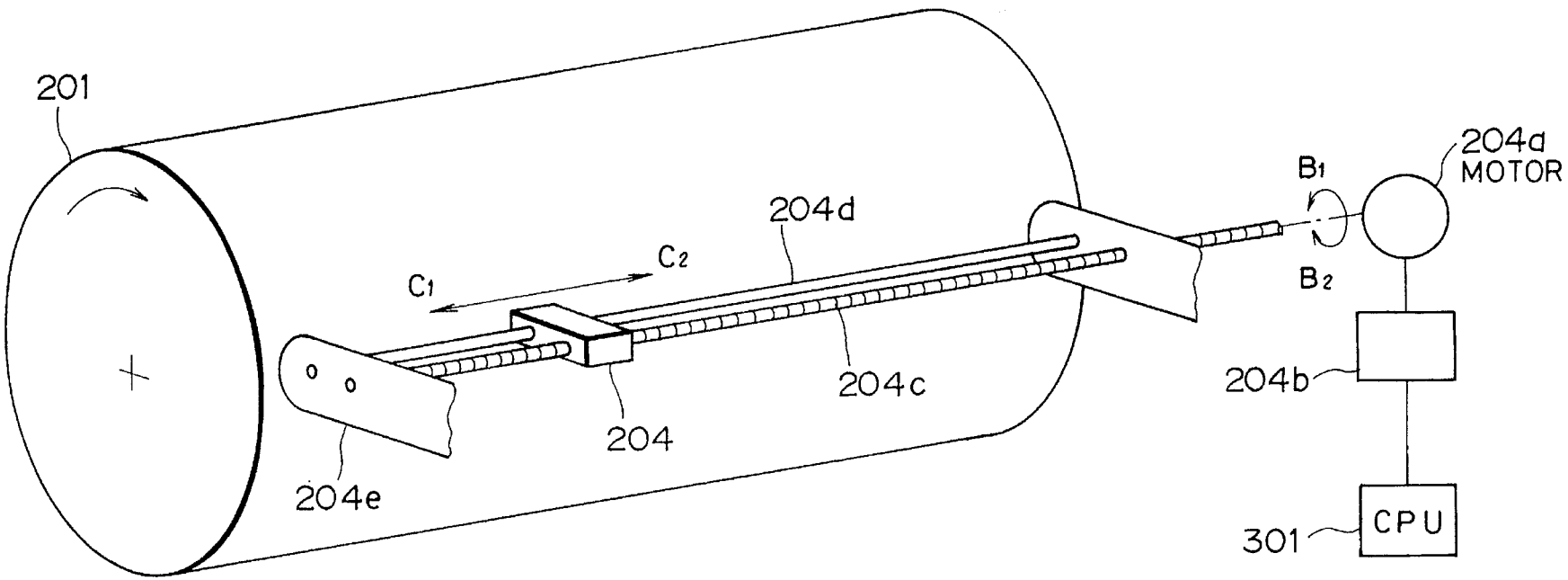
FIG. 22 is a diagram illustrating a method of driving a density measuring unit.

FIG. 22 is a diagram illustrating a method of driving the density measuring unit 204. A driving power supply 204*b* of a motor 204*a* produces a driving voltage in response to a signal from a CPU 301, described later, thereby rotating the motor 204*a*. The latter is connected to a threaded rod 204*c* supported so as to lie parallel to the rotational axis of the photosensitive drum 201. The density measuring unit 204 is connected to the threaded rod 204*a*. The structure is such that the density measuring unit 204 is moved in the direction of arrow C1 or C2 by rotation of the threaded shaft 204*c* in the direction of arrow B1 or B2 owing to rotation of the motor 204*a*. Numeral 204*d* denotes a guide rod and 204*e* a supporting plate that secures the threaded rod 204*c* and the guide rod 204*e*. It should be noted that the potential measuring unit 203 and density measuring unit 223 are driven by a similar method.

Figure 23:
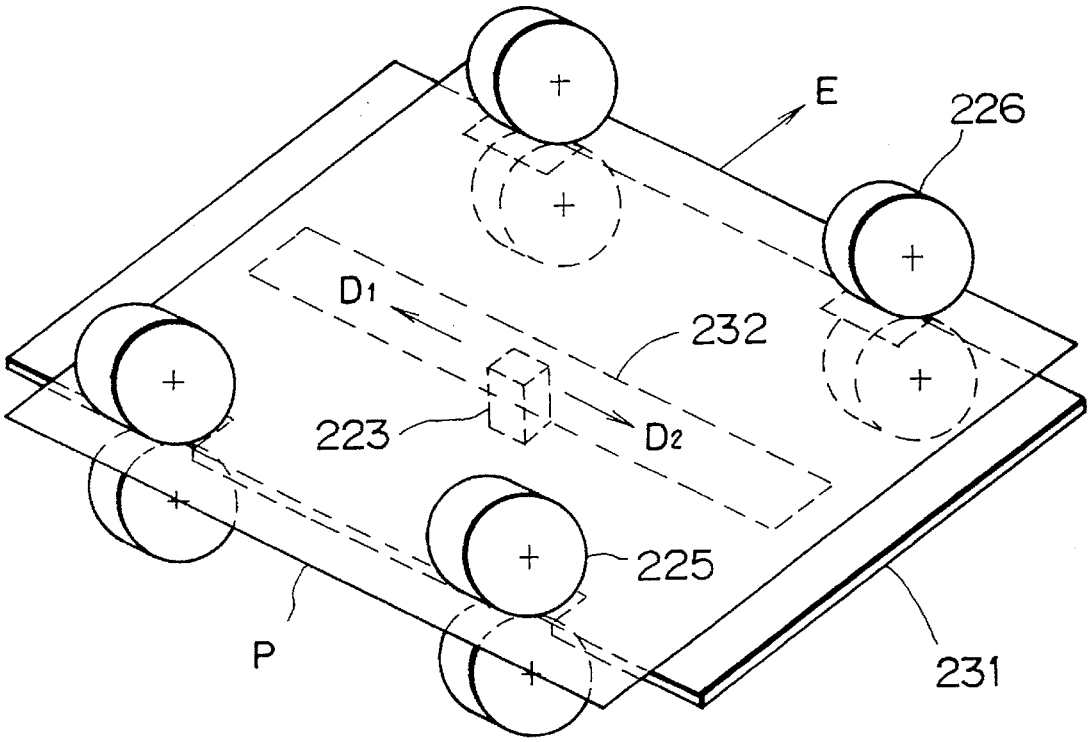
FIG. 23 is a perspective view illustrating components in the vicinity of a density measuring unit.

FIG. 23 is a perspective view illustrating components in the vicinity of a density measuring unit 223. The latter can be moved in the direction of arrow D1 or D2 by a drive method similar to that shown in FIG. 22. The image density of the transfer paper P is measured from a slit 232 provided in a guide plate 231. The conveyor rollers 225, 226 are driven in steps so that the transfer paper P is shifted incrementally in the direction of arrow E. Each time the transfer paper P is shifted, the density measuring unit 223 is moved in the directions D1, D2, thereby making it possible to measure density at each position of the transfer paper P.

Figure 24:
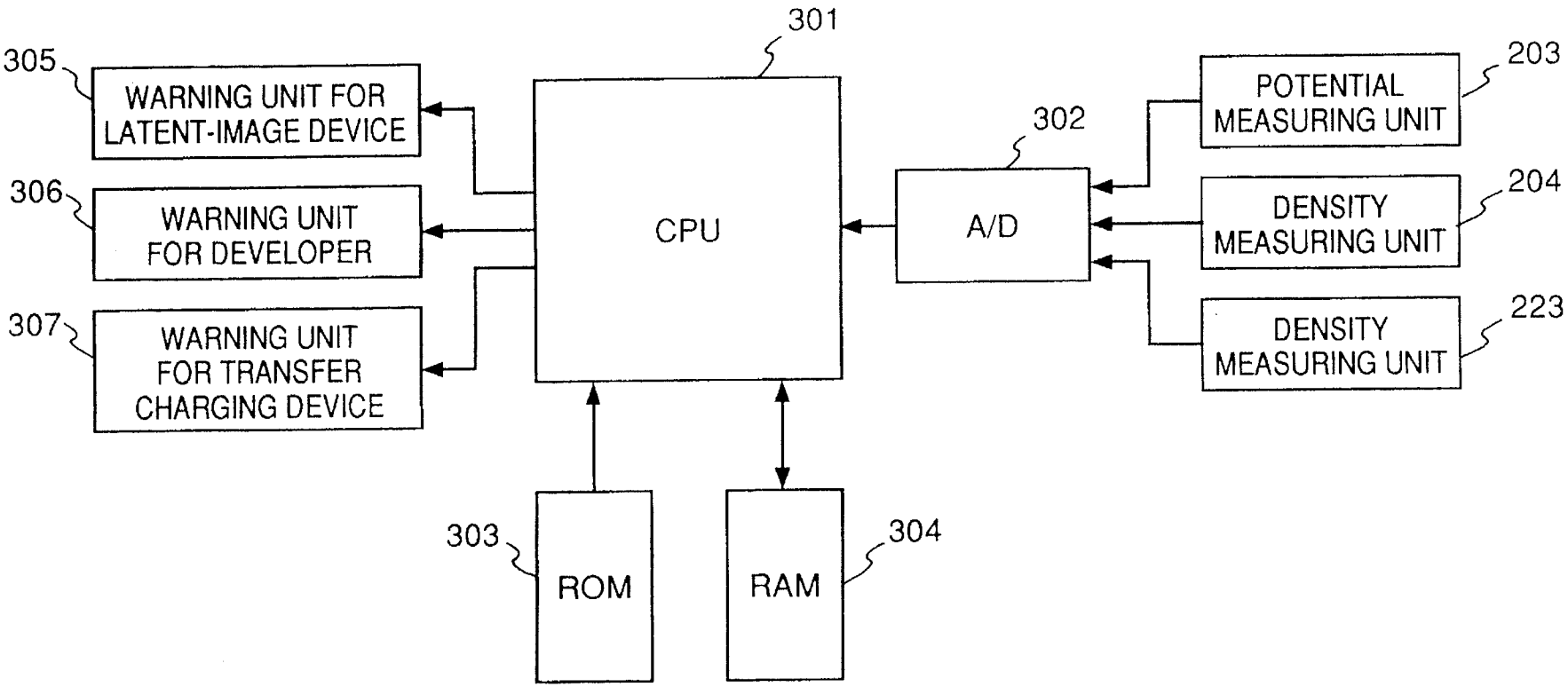
FIG. 24 is a block diagram illustrating the general control configuration of a fault diagnosing unit according to the fifth embodiment.

FIG. 24 is a block diagram illustrating the general control configuration of a fault diagnosing unit according to the fifth embodiment. The fault diagnosing unit may be incorporated in the main body of the image forming apparatus or may be connected to the image forming apparatus as an external device.

Numeral 301 in FIG. 24 denotes a CPU for performing various control operations of the image sensing apparatus and executing fuzzy reasoning through a procedure described later. The CPU 301 is connected to an A/D converter 302 for converting, into digital signals, outputs accepted from the potential measuring unit 203 and density measuring units 204, 223. A ROM 303 stores various control programs, which are run by the CPU 301, as well as a program for fuzzy reasoning, described below. Also stored in the ROM 303 are membership functions and fuzzy rules, described below, for execution of fuzzy reasoning. A RAM 304 has a work area for temporarily storing data and the like when the CPU 301 executes various processing.

Numeral 305 designates a warning unit for the latent-image device. Specifically, when the failure rate of the latent-image device obtained by reasoning processing, described below, exceeds a predetermined value, the unit 305 so informs the user or serviceman. A warning unit 306 and a warning unit 307 perform similar functions for the developer and transfer charging device, respectively.

A method will now be described for inferring the failure rates of various fault locations, which are candidates for causes of uneven density, in the image forming apparatus having the construction set forth above.

As is well known, fuzzy reasoning involves setting fuzzy rules representing the relationship between entered status quantities and outputted inferential quantities (failure rates in this example), representing the status variables and inferential quantities by fuzzy sets, which are referred to as membership functions, and calculating an inferential quantity having the highest possibility with regard to an entered status quantity based upon the fuzzy rules and membership functions.

The following are used as status quantities:

(1) voltage ripple;

(2) density ripple on the photosensitive drum; and (3) density ripple on the transfer paper.

The following are inferential quantities:

(4) failure rate of the latent-image device;

(5) failure rate of the developer; and (6) failure rate of the transfer charging device.

More specifically, since failure of the latent-image device, developer and transfer charging device may be cited as examples of candidates for causes of uneven density, (4)~(6) above are adopted as the inferential quantities. Further, since the extent of potential distribution on the photosensitive drum and the extent of unevenness of the density distribution on the photosensitive drum and transfer paper may be mentioned as examples of information for inferring (4)~(6) above, (1)~(3) are adopted as the status quantities.

The conspicuousness of uneven density differs depending upon the density of the original. Unevenness is most conspicuous when the density of the original is composed of half tones. Accordingly, in order to facilitate the sensing of uneven density, density ripple mentioned in (2) and (3) above is determined from the density distribution on the photosensitive drum and transfer paper that prevails when an original whose optical density is an average of 0.4 is copied.

Further, potential ripple cited in (1) above is found from the potential distribution on the photosensitive drum 201 at the time of the above-mentioned copying operation. This potential distribution is measured by the potential measuring unit 203. This potential ripple, which is represented by $\Delta V_H$, is the difference between the maximum and minimum values of potential distribution measured along the axis of rotation of the photosensitive drum. Furthermore, density ripples $\Delta D_H$, $\Delta D_H'$ cited in (2), (3) above are the differences between the maximum and minimum values of density distributions on the photosensitive drum 201 and transfer paper P measured by the density measuring units 204, 223, respectively.

Figure 25A:
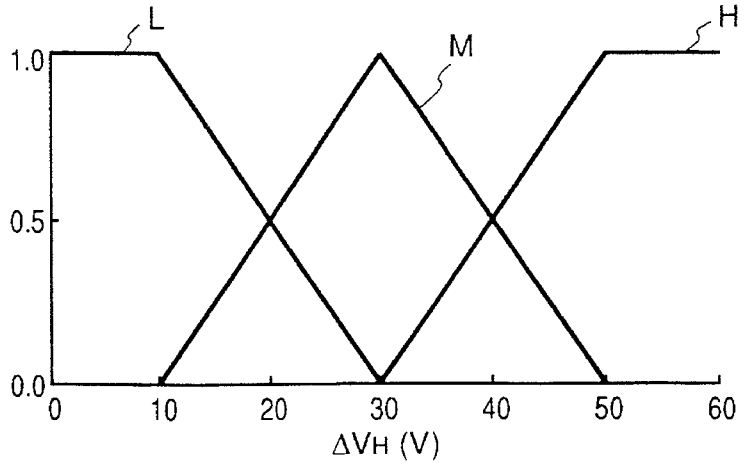
FIGS. 25A to 25C are diagrams showing membership functions of input status quantities in the fifth embodiment.
Figure 25B:
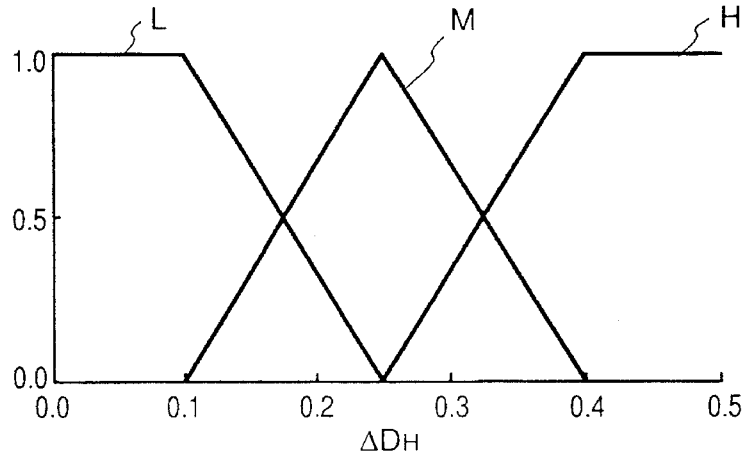
Figure 25C:
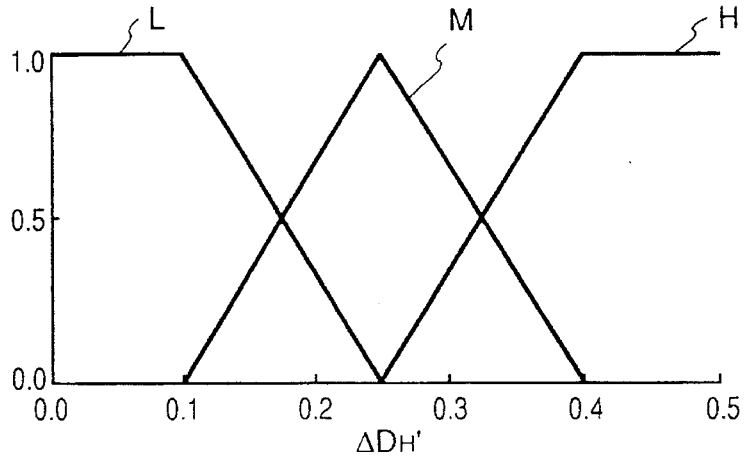
Figure 26:
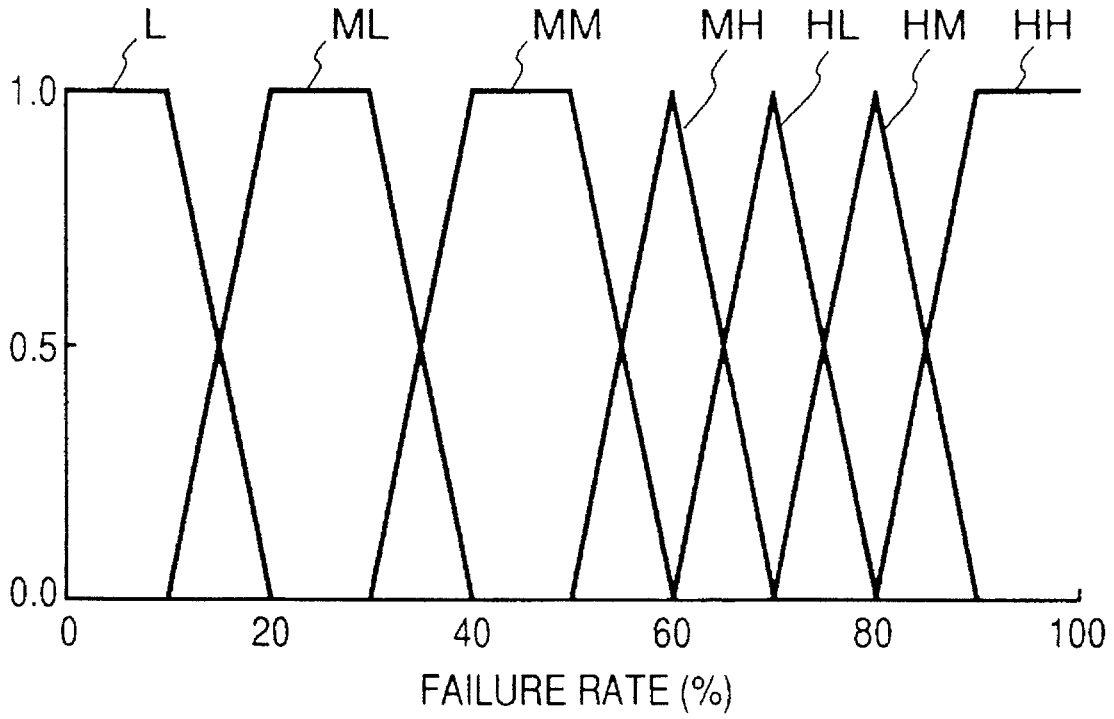
FIG. 26 is a diagram showing membership functions of inferential output quantities in the fifth embodiment.

FIGS. 25A to 25C are diagrams showing membership functions of input status quantities (1)~(3). Specifically, FIG. 25A illustrates membership functions of potential ripple $\Delta V_H$, FIG. 25B illustrates membership functions of density ripple $\Delta D_H$ on the photosensitive drum and FIG. 25C illustrates membership functions of density ripple $\Delta D_H'$ on the transfer paper. Further, FIG. 26 is a diagram showing membership functions of inferential quantities (4)~(6). In this embodiment, the inferential quantities of (4)~(6) all have identical membership functions.

The membership functions of potential ripple in FIG. 25A will be described by way of example. The value of potential ripple is plotted along the horizontal axis and values of 0 to 1 are plotted along the vertical axis. The values of potential ripple are classified broadly into three sets L, M and H. The contents of these sets are as follows:

L (Low): potential ripple is small;

M (Middle): potential ripple is medium; and

H (High): potential ripple is large.

For example, if the potential ripple is 20 V, then the degree to which this value belongs (the degree of membership thereof) to the set L is 0.5, the degree to which it belongs to the set M is 0.5 and the degree to which it belongs to the set H is 0. This indicates that the percentage that the potential ripple of 20 V will be judged to be "small" is about fifty-fifty, that the percentage that the potential ripple of 20 V will be judged to be "medium" is about fifty-fifty, and that the percentage that the potential ripple of 20 V will be judged to be "large" is zero. The judgment that 20 V is "small" or "intermediate" is vague in that neither judgment is certain. Thus, the membership functions express to which of "small", "medium" and "large" the value of potential ripple belongs, as well as the degree (percentage) of such belonging (the degree of membership). The same is true with regard to the membership functions of FIGS. 25B and 25C.

Failure rate is plotted along the horizontal axis of the membership functions of FIG. 26. A failure rate of 0% is adopted in a case where the failure does not contribute to uneven density at all, and a failure rate of 100% is adopted in a case where the failure is the entire cause of uneven density. Failure rate is divided into seven sets, the contents of which are as follows (where the sets are indicated in ascending order of failure rate):

L (Low): failure rate is low;

ML (Low Middle): failure rate is lower medium;

MM (Middle Middle): failure rate is medium;

MH (High Middle): failure rate is higher medium;

HL (Low High): failure rate is lower high;

HM (Middle High): failure rate is high; and

HH (High High): failure rate is very high.

FIG. 27 shows the fuzzy rules used in the fifth embodiment. This shows the relationship between three input status quantities (potential ripple $\Delta V_H$, density ripple $\Delta D_H$ and density ripple $\Delta D_H'$) and inferential quantities (each of the failure rates of the latent-image device, developer and transfer charging device). Depending upon which of the sets L, M and H the status quantities $\Delta V_H$, $\Delta D_H$ and $\Delta D_H'$ belong to, there are a total of 27 rules. For example, Rules 9 and 15 are as follows:

Rule 9:

If $\Delta V_H$=L and $\Delta D_H$=H and $\Delta D_H'$=H
then failure rate of latent-image device=L,
failure rate of developer=HH,
failure rate of transfer charging device=L Rule 15:

If $\Delta V_H$=M and $\Delta D_H$=M and $\Delta D_H'$=H
then failure rate of latent-image device=MM,
failure rate of developer=L,
failure rate of transfer charging device=MH The rules are set based upon experience. Specifically, the image forming process is carried out in the following order, as mentioned above: formation of the latent image, development and transfer. Accordingly, the larger potential ripple after image formation, the large density ripple will be after development and after transfer. The chief cause of uneven density in this case is the latent-image device; the developer and transfer charging device contribute little. If the density ripple is large after development and after transfer even though potential ripple is small, the chief cause of uneven density is the developer; the latent-image device and transfer charging device contribute little. Thus, by comparing the magnitude of ripple of the process on the upstream side with the magnitude of ripple of the process on the downstream side, the process which is likely to be the cause of uneven density may be inferred.

Though there is a case in which ripple of the process on the downstream side is smaller than that on the upstream side, there are cases in which ripple that cancels out the ripple of the process on the upstream side is produced in the process on the downstream side. In terms of the degree of failure, this is a case in which identical failures have occurred in both the upstream and downstream processes.

In the example of Rule 9, potential ripple is small and density ripple after development and after transfer is large. Therefore, this indicates that the failure rate of the developer is high and the failure rates of the latent-image device and transfer charging device are low. In the example of Rule 15, potential ripple and the density ripple after development are both medium and the density ripple after transfer is large. Therefore, the failure rate of the developer is low and the failure rates of the latent-image device and transfer charging device are medium and higher medium.

Figure 28:
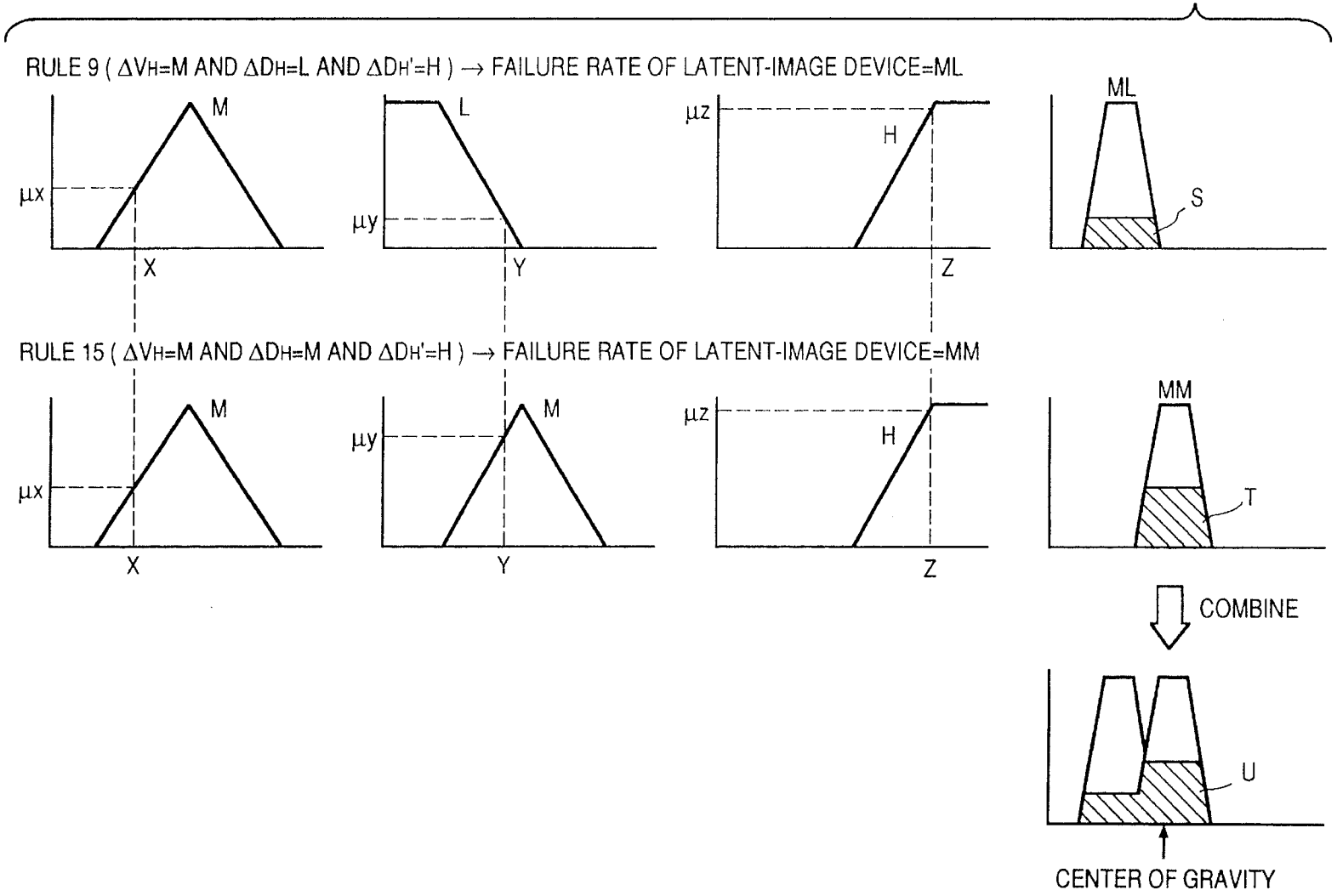
FIG. 28 is a diagram for describing a method of fuzzy reasoning for calculating failure rate according to the fifth embodiment.

FIG. 28 illustrates a method of calculating failure rate by fuzzy reasoning using Rules 11 and 15 of the fuzzy rules shown in FIG. 27. It should be noted, however, that the method of calculation shown in FIG. 28 deals only with failure rate of the latent-image device.

A case in which $\Delta V_H$=x, $\Delta D_H$=y, $\Delta D_H'$=z holds will be considered. The input x is contained in the set M at degree μx from the membership function of $\Delta V_H$; the input y is contained in the set L at degree μy from the membership function of $\Delta D_H$; and the input z is contained in the set H at degree μz from the membership function of $\Delta D_H'$. Thereafter, the minimum value of μx, μy, μz is taken and this value is adopted as a value representing the degree at which the condition part of Rule 11 is satisfied. When a MIN operation is performed between this value and the set ML of the membership function of the failure rate of the latent-image device, the result is a trapezoid indicated by the shaded portion S.

A similar calculation is performed with regard to Rule 15 as well, whereby a trapezoid indicated by the shaded portion T is obtained. Thereafter, a combined set of the sets S and T is taken to create a new set indicated by the shaded portion U. A value obtained by calculating the center of gravity of this set is decided as the failure rate of the latent-image device obtained by fuzzy reasoning. Though the calculations are performed here using only the Rules 11 and 15, in actuality failure rate is decided by performing similar calculations using all of the rules shown in FIG. 27.

The procedure of the fuzzy reasoning operation according to the fifth embodiment will now be described with reference to the flowchart of FIG. 29.

Step S201 of the flowchart calls for measurement of each ripple value ($\Delta V_H$, $\Delta D_H$, $\Delta D_H'$). The measurement procedure of step S201 will be described in greater detail.

Specifically, the exposure lamp 205 shown in FIG. 21 is moved to position 205' so that the photosensitive drum 201 electrified by the charging device 202 is exposed to light reflected from the standard density plate 230. The latter is coated uniformly to have a half-tone optical density of 0.4. In this state the processes for feeding the transfer paper P, developing the image and transferring the image are halted, the potential measuring device 203 is moved along the rotational axis of the photosensitive drum 203 and the potential distribution along the rotational axis is measured through the method described earlier.

Figure 30:
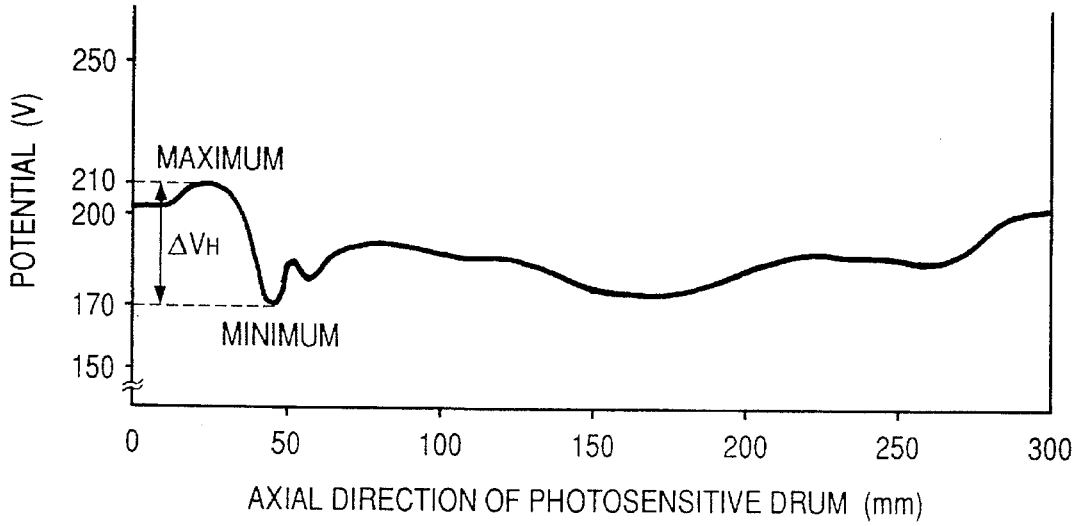
FIG. 30 is a diagram showing one example of the potential distribution of a latent image measured by a potential measuring unit.
Figure 31:
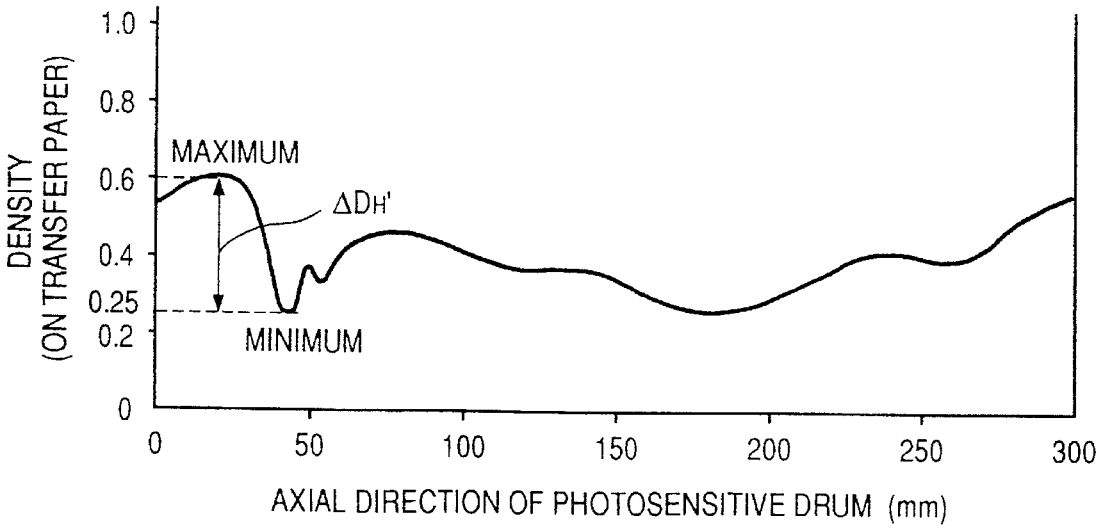
FIG. 31 is a diagram showing an example of the result of measuring density distribution on transfer paper.
Figure 32:
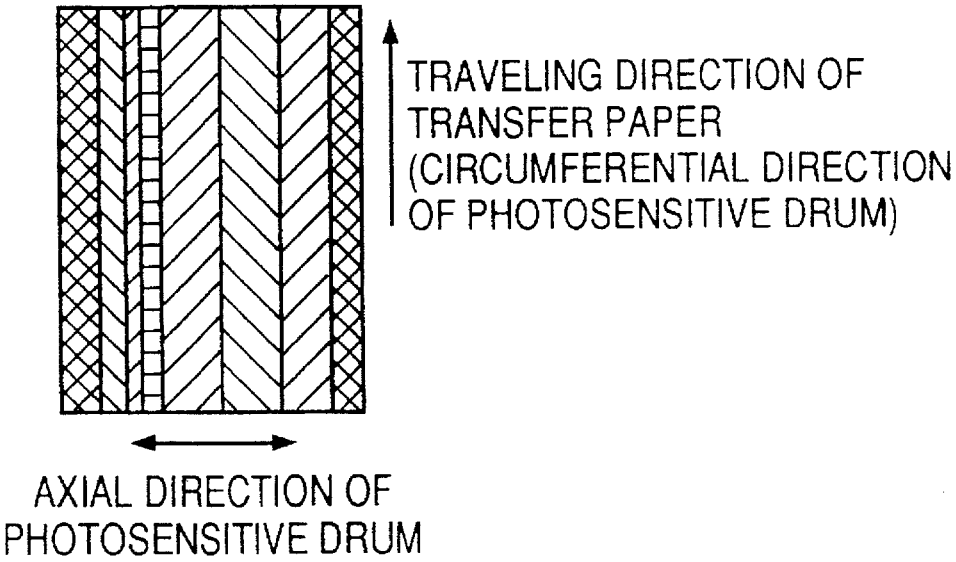
FIG. 32 is a diagram schematically showing uneven density produced on transfer paper.

FIG. 30 illustrates an example of the potential distribution of a latent image measured by the potential measuring device 203. Position along the rotational axis is plotted along the horizontal axis and potential is plotted along the vertical axis. In this case, the maximum value of potential is 210 V, the minimum value is 170 V and the potential ripple $\Delta V_H$ is 40 V. Next, development is carried out, after which the density measuring unit 204 is driven to measure the density distribution of the toner image on the drum through the method described above. The density ripple $\Delta D_H$ is obtained from the measured distribution density. This is followed by feeding the paper, transferring the toner image to the transfer paper, conveying the transfer paper, to which the image has been transferred, to the guide plate 231 and driving the density measuring unit 223 to measure the density distribution on the transfer paper. FIG. 31 is a diagram showing an example of the results of measuring the density distribution on the transfer paper. In this case, the maximum value of density is 0.6, the minimum value is 0.25 and the density ripple $D_H'$ is 0.35. FIG. 32 is a diagram schematically showing density unevenness that occurs on the transfer paper at this time.

Figure 29:
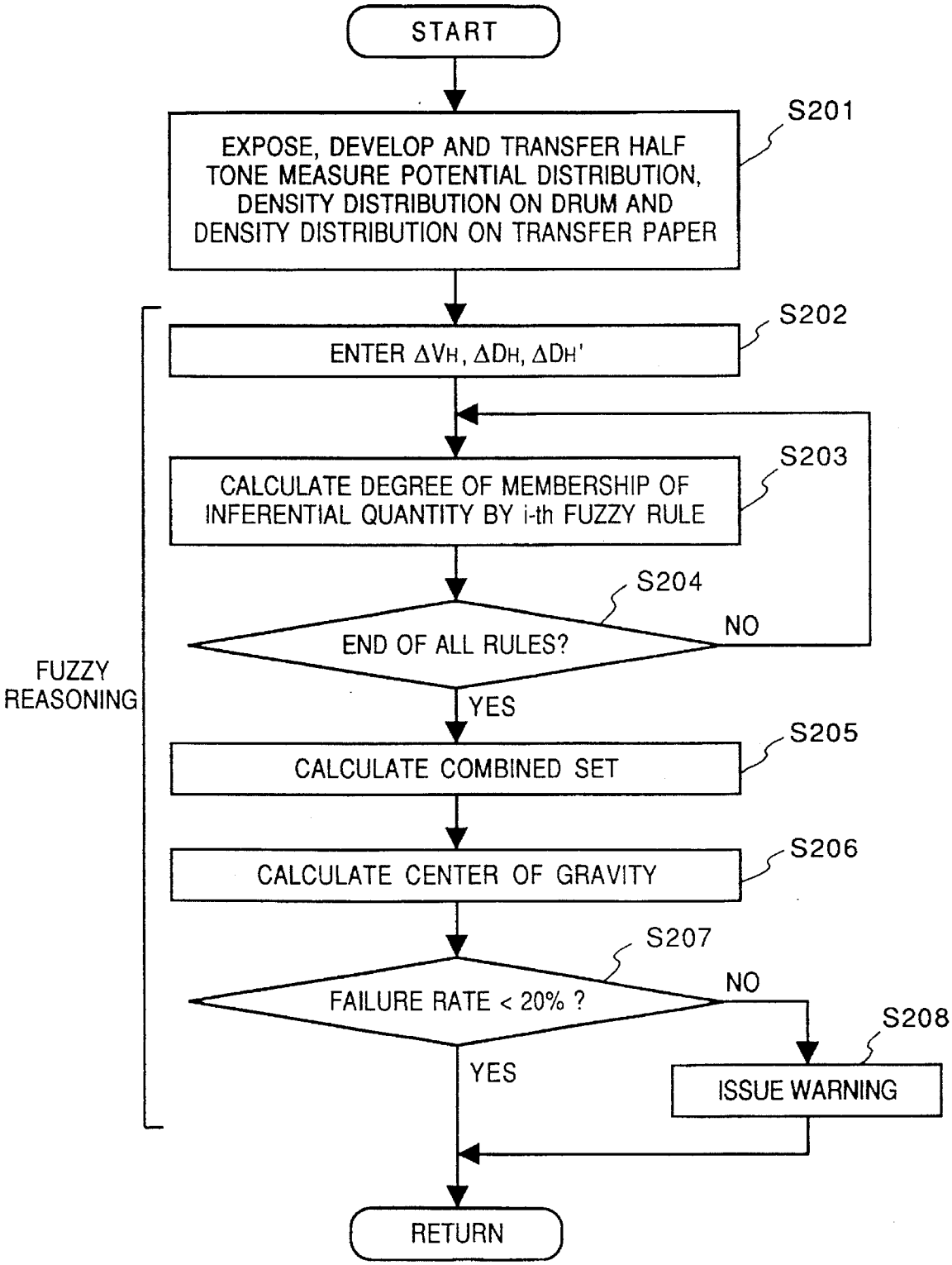
FIG. 29 is a flowchart illustrating the operating procedure of fuzzy reasoning according to the fifth embodiment.

Next, step S202 of the flowchart in FIG. 29 is processing for entering $\Delta V_H$, $\Delta D_H$ and $\Delta D_H'$, obtained at step S201, as status quantities for the purpose of fuzzy reasoning. This is followed by step S203, at which the membership of an inferential quantity in a membership function is obtained from the membership of a status quantity in a membership function in accordance with each fuzzy rule shown in FIG. 27. It is determined at step S204 whether processing has been concluded in relation to all fuzzy rules. If there is an unprocessed fuzzy rule, then the program proceeds to step S203 so that a computation may be performed with regard to the next fuzzy rule. If processing has been completed for all fuzzy rules, on the other hand, the program proceeds to step S205.

Step S205 calls for the calculation of a combined set of the degree of membership of an inferential quantity, obtained for each and every rule, in a membership function. The center of gravity of this combined set is then calculated at step S206. The failure rates of the latent-image device, developer and transfer charging device are thus calculated. It is then determined at step S207 whether each failure rate exceeds 20%. If there is a failure rate that exceeds 20%, then a warning is issued by the warning unit 305 for the latent-image device, the warning unit 306 for the developer or the warning unit 307 for the transfer charging device. Further, the serviceman observes the warning, ascertains the fault location and the degree of failure and performs maintenance. If none of the failure rates exceed 20% at step S207, processing is terminated.

If the status quantities are $\Delta V_H$=40 V, $\Delta D_H$=0.4 and $\Delta D_H'$=0.4, for example, in the method described above, then the failure rates of the latent-image device, developer and transfer charging device are inferred to be 64%, 24% and 11% respectively. This can be set to be inferential results that are correct based upon experience.

Accordingly, by incorporating the above-described method of inferring failure rate in an image forming apparatus, the serviceman is capable of ascertaining the location of a fault that is the cause of uneven density. This makes it possible to perform accurate and prompt maintenance. Further, in the method of inferring failure rate described above, failure rate is monitored constantly and a fault location is capable of being ascertained, based upon the degree of the rise in the failure rate, at an early stage before the uneven density becomes conspicuous on the image. This makes it possible to perform highly efficient maintenance.

In the example described above, attention has been directed to the latent-image device, developer and transfer charging device. However, in a case where uneven density remains even though these locations undergo maintenance, the cleaning device 213 is inspected. In a case where toner cannot be removed from the drum owing to malfunction of the cleaning device 213, uneven density will occur. Further, in a digital-type copier in which the image of an original is read photoelectrically and an image is formed based upon the resulting image signal, there are instances in which uneven density occurs owing to a failure in the device that reads the original. The reading device is inspected in such case. Thus, the burden of maintenance can be greatly alleviated since the causes of failures can be narrowed down in this manner.

<Sixth Embodiment>

A sixth embodiment of the invention will now be described. The fifth embodiment deals with the latent-image device, developer and transfer charging device as causes of uneven density. The cause of uneven density attributable to the latent-image device can be broken down further, as will now be described.

The latent-image device is constituted by the charging device 202, the photosensitive drum 201 and the exposure unit (the exposure lamp 205, mirrors and lenses **206*a*~206*e* and glass platen 215, etc.). If any of these components malfunction, an uneven potential is produced and gives rise to uneven density. If the developer 202 becomes contaminated with toner or discharge products become attached to the surface of the photosensitive drum 201**, uneven density is produced. Further, if the exposure unit becomes contaminated with dust or the like, an irregularity in the amount of exposing light develops along the rotational axis of the photosensitive drum. This also results in uneven potential.

In the method of inferring failure rate according to the fifth embodiment, it can be determined that the cause of uneven density is the latent-image device but the particular component of the latent-image device that is malfunctioning cannot be determined. In the sixth embodiment, a method will be described through which it is possible to infer which component of the latent-image device is the cause of uneven density.

In the sixth embodiment, the following are used as input status quantities:

(1) dark-area potential ripple: $\Delta V_D$;

(2) half-tone potential ripple: $\Delta V_H$; and (3) humidity.

The following are inferential quantities outputted:

(4) failure rate of the charging device 202;

(5) failure rate of the exposure unit; and (6) failure rate of the photosensitive drum 201.

Dark-area potential ripple, which is potential ripple that prevails when the exposure lamp 205 is not lit, represents uneven potential due to the charging device 202 and photosensitive drum 201, namely uneven potential in which the exposure unit does not take part. The half-tone potential ripple $\Delta V_H$ is as described in the fifth embodiment. Humidity is measured by a humidity sensor installed inside the machine (the sensor is not shown and there is no limitation upon the location of its installation).

Figure 33A:
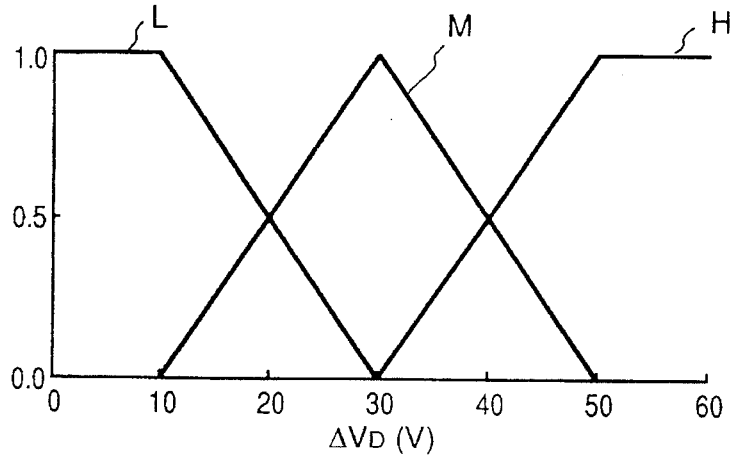
FIGS. 33A to 33C are diagrams showing membership functions of input status quantities and output inferential quantities in a sixth embodiment.
Figure 33B:
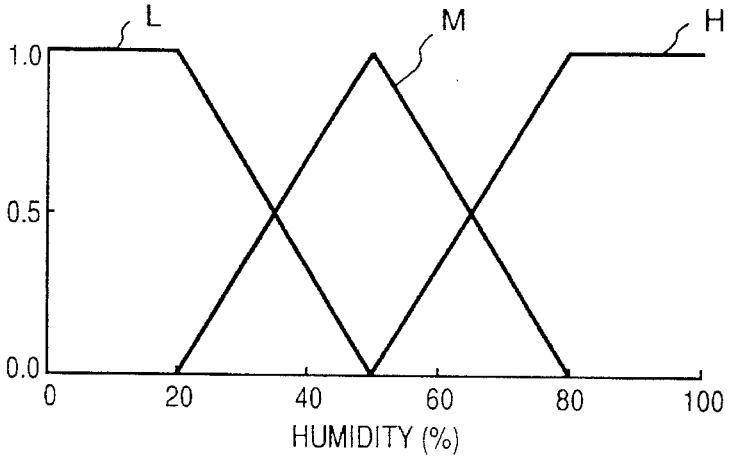
Figure 33C:
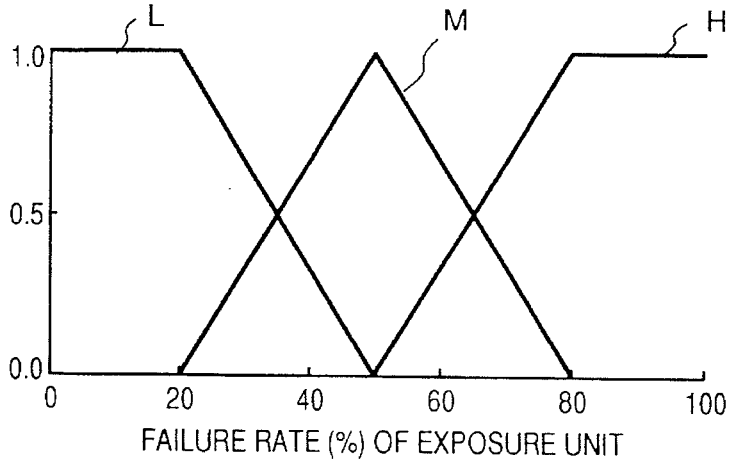

FIGS. 33A to 33C are diagrams showing membership functions of input status quantities and output inferential quantities according to the sixth embodiment. Specifically, FIG. 33A illustrates membership functions in which dark-area potential ripple $\Delta V_D$ is the status quantity, and FIG. 33B illustrates membership functions in which humidity is the status quantity. It should be noted that the half-tone potential ripple is identical with the potential ripple $\Delta V_H$ [FIG. 25A] of the fifth embodiment and need not be illustrated or described again. Further, FIG. 33C is a diagram showing membership functions of failure rate of the exposure unit. It should be noted that membership functions of the failure rates of the charging device 202 and photosensitive drum 201 are similar to those of FIG. 26 and need not be illustrated or described again.

Figures 34, 35:
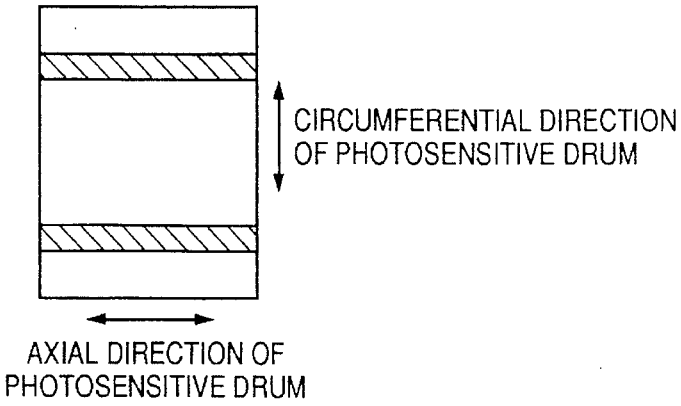
FIG. 34 is a diagram showing fuzzy rules according to the sixth embodiment.
FIG. 35 is a diagram schematically showing an image in which fogging has occurred.

FIG. 34 is a diagram showing the fuzzy rules of the sixth embodiment. The process for forming a latent image involves charging and exposure in the order mentioned. Therefore, in a case where potential ripple after charging, i.e., dark-area potential ripple $\Delta V_D$, is small and potential ripple after exposure (half-tone potential ripple) $\Delta V_H$ is large, the possibility that the exposure unit is the chief cause of uneven potential is high. Further, the lower the humidity, the easier it is for the charging device 202 to become contaminated. The higher the humidity, the more that discharge products that have attached themselves to the photosensitive drum 201 absorb moisture. This results in conductivity and tends to cause uneven potential. The fuzzy rules are established based upon these facts derived from experience. Since the reasoning in this example is carried out in a case where it is judged in the fifth embodiment that the chief cause of uneven density is the latent-image device, the reasoning is limited to a case in which the level of the half-tone potential ripple $\Delta V_H$ is M or H.

The failure rates of the charging device 202, exposure unit and photosensitive drum 201 can be calculated by the method of the fifth embodiment from the above-described membership functions of status quantities and inferential quantities and the fuzzy rules. This makes it possible to ascertain the causes of uneven density more finely.

<Seventh Embodiment>

A seventh embodiment of the invention will now be described. In the fifth and sixth embodiments, the cause of uneven density in the axial direction of the photoconductor drum 201 is inferred. In the seventh embodiment, however a method will be described in which the cause of uneven density in the circumferential direction of the photoconductor drum 201 is inferred.

During the repetition of a copying operation, there are instances in which resin and silica ($SiO_2$), which are ingredients of the developing agent, become attached to the surface of the photoconductor drum 201 and cause fogging at white background portions of the copied image.

FIG. 35 is a diagram schematically illustrating an image in which fogging has occurred. In this image there is no density unevenness along the rotational axis of the photoconductor drum 201 but density unevenness does occur in the circumferential direction of the drum 201. The adhesion of developing agent to the surface of the photoconductor drum 201 increases as the number of copies increases. In addition, when the layer of toner coating the toner carrier (the developing sleeve) 209 develops local coating unevenness, uneven density is produced in the circumferential direction. It is believed that coating unevenness occurs when the charge carried by the toner becomes excessive and the toner becomes affixed to the surface of the developing sleeve owing to a reflective force. The lower the humidity of the environment, the more easily coating unevenness occurs. A method will now be described for inferring the failure rates of fault locations that are the causes of uneven density in the circumferential direction.

In the seventh embodiment, the following are used as input status quantities:

(1) white-background density ripple (on the photoconductor drum 201): $\Delta D_L$;

(2) number of cumulative copying operations: N; and (3) humidity.

The inferential quantities used are as follows:

(4) failure rate of the photoconductor drum 201; and (5) failure rate of the developing sleeve.

Furthermore, the standard density plate 230 is uniformly coated to a white color. The photoconductor drum is exposed to light reflected from the standard density plate 230, thereby developing an image, the temperature measuring unit 204 is fixed at each position on the drum in the axial direction thereof, and the photoconductor drum 201 is rotated at each position so that the density distribution of the photoconductor drum 201 in the circumferential thereof may be measured. The density ripple $\Delta D_L$ of the white background is obtained from this density distribution. The density ripple $\Delta D_L$ is obtained at each position and the maximum value is adopted as a status quantity for reasoning.

The cumulative number N of copying operations is stored in a counter (not shown) and may be acquired at any time by reading the value out of the counter.

Figure 36:
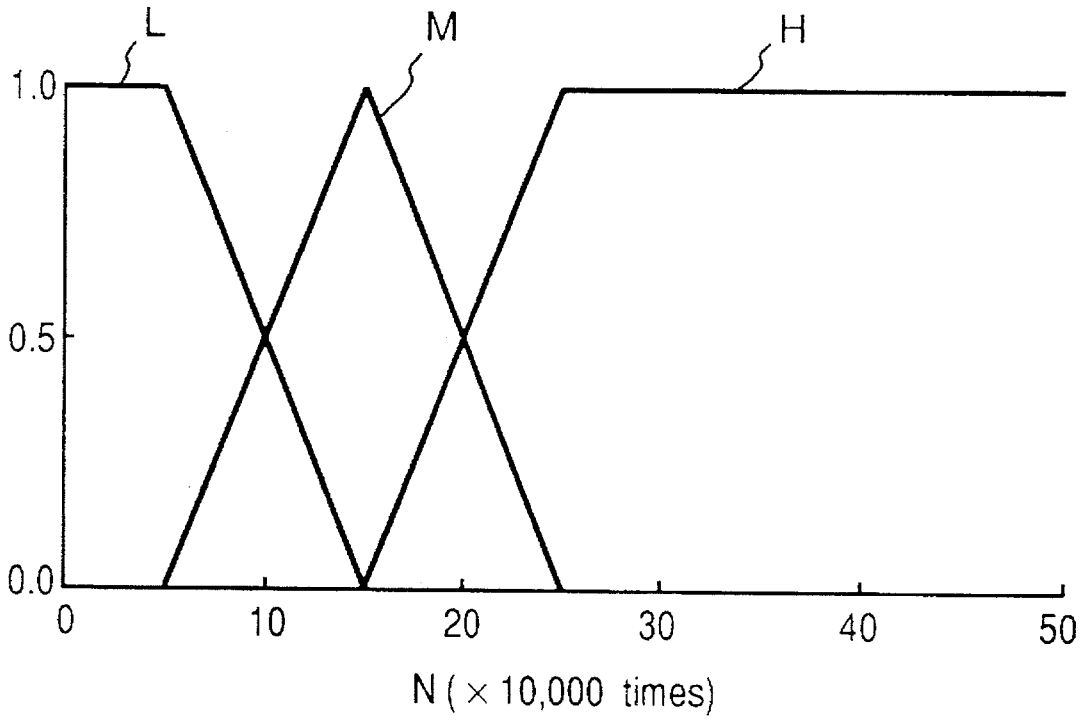
FIG. 36 is a diagram showing membership functions of a cumulative copy number N, which is one of the status quantities used in a seventh embodiment.

FIG. 36 is a diagram showing membership functions of the cumulative number N of copying operations, which is one of the status quantities used in the seventh embodiment. It should be noted that the membership functions of the white-background density ripple $\Delta D_L$ is the same as in FIG. 25B. Further, the membership functions of humidity are the same as in FIG. 25B. FIG. 37 is a diagram showing the fuzzy rules used in the seventh embodiment.

It is possible to precisely ascertain the cause of uneven density in the circumferential direction of the drum by performing fuzzy reasoning in accordance with the above-mentioned membership functions and fuzzy rules.

Thus, in accordance with the fifth through seventh embodiments of the invention, as described above, the failure rates of various fault locations can be inferred based upon a plurality of status quantities with regard to an image abnormality, such as uneven density, in which many causes of faults are conceivable and it is difficult to judge the fault locations. Accordingly, it is possible to automate judgment and simplify maintenance. Furthermore, judgment that takes various status quantities into consideration is possible by means of a simple program without performing many preparatory experiments.

In accordance with each of the embodiments, as described above, it is possible to accurately diagnose the failure rates or rates of erroneous setting of a plurality of process elements, which are fault locations, using a plurality of status quantities that are the causes of failure in density management. In other words, which locations have high failure rates are inferred automatically. This reduces the burden on the serviceman who must determine the locations of faults and allows the serviceman to perform maintenance quickly and easily. In addition, the relationship between status quantities and failure rates need only be stored as rules for revision purposes. As a result, causes of failure can be judged using a simple program for phenomena in which a number of causes are interrelated in a complicated manner, as in the case of lightening of density, fogging and uneven density in a copying machine.

<Eighth Embodiment>

An eighth embodiment of the invention will now be described. In this embodiment, the causes of faulty transfer separation are inferred.

An image forming apparatus according to this embodiment has a construction the same as that shown in FIG. 21.

Figure 38:
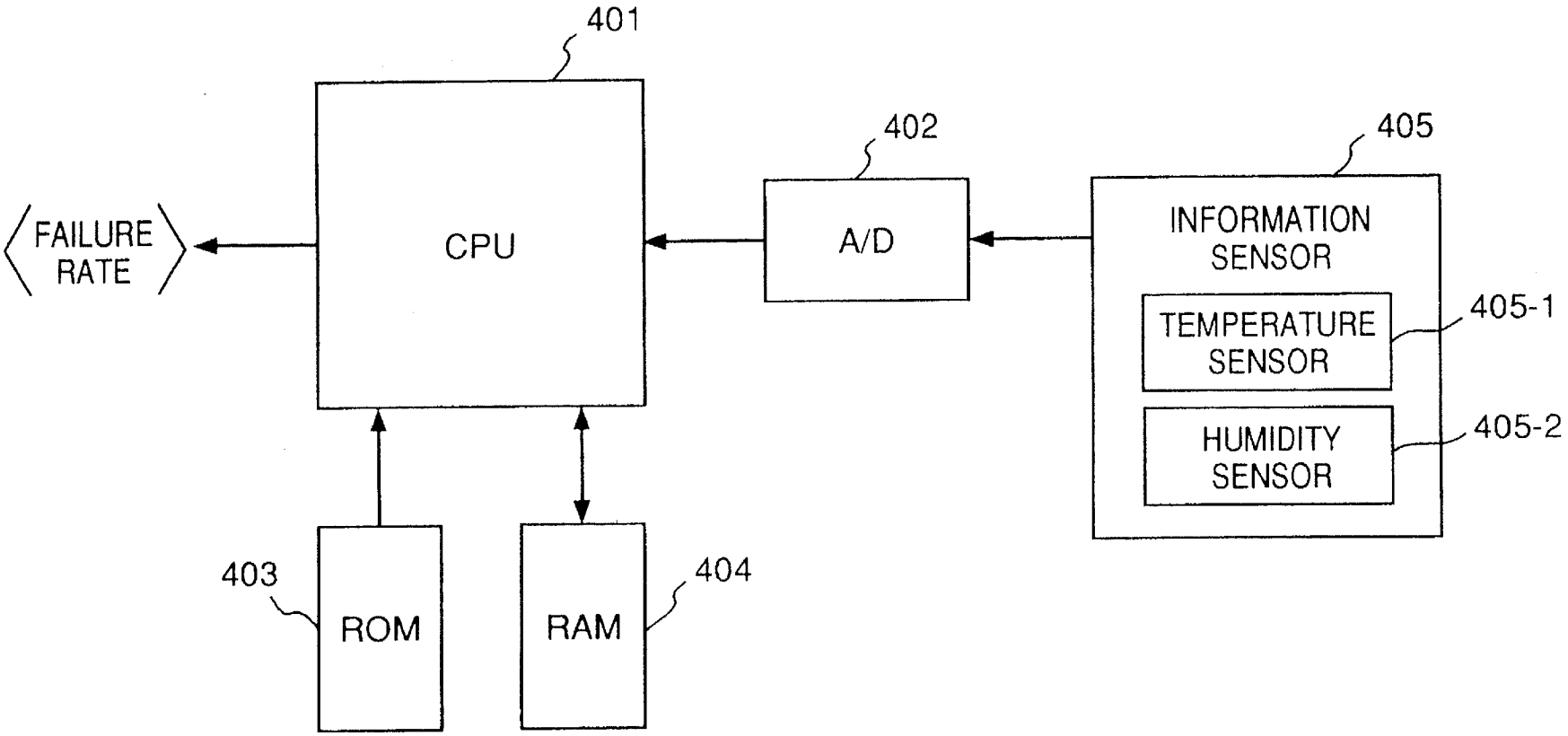
FIG. 38 is a block diagram showing the control configuration of a reasoning unit that performs fuzzy reasoning in an image forming apparatus according to eighth through tenth embodiments of the invention.

FIG. 38 is a block diagram illustrating the control mechanism of a reasoning unit that performs fuzzy reasoning in the image forming apparatus according to this embodiment. It should be noted that the reasoning unit may be provided as an external device connected to the image forming apparatus as a reasoning unit. Numeral 401 denotes a CPU for performing fuzzy reasoning in a manner described below. A ROM 403 stores fuzzy rules and membership functions, described later, as well as a control program for executing fuzzy reasoning based upon entered status quantities. A RAM 404 is a memory used as a work area when fuzzy reasoning is carried out. An A/D converter 402 converts an analog signal into a digital signal and is connected to an information sensor 105 for sensing various status quantities used in fuzzy reasoning. A temperature sensor 405-1 and a humidity sensor 405-2 are connected to the information sensor 405 and mixture ratio, which is one of status quantities, is obtained. The mixture ratio referred to here represents absolute humidity, namely the water content, in grams, present in one kilogram of air. Furthermore, a separation difference-current output value and a separation difference-current adjustment value are applied to the information sensor 405 as inputs. The separation difference-current output value and separation difference-current adjustment value will be described later.

A method of inferring failure rate according to the eighth embodiment will now be described. In this embodiment, reasoning is performed with regard to the causes of faulty transfer of the transfer paper from the photosensitive drum. That is, the failure rate of each fault location that is a candidate for cause of faulty separation is inferred.

The status quantities used in the eighth embodiment are (1) mixture ratio, (2) separation difference-current output value and (3) separation difference-current adjustment value. A DC voltage is impressed upon the AC voltage to produce an AC corona discharge in the separation charging device 211. Owing to offset of the AC voltage caused by the impressed DC voltage, a difference is produced between the absolute values of the positive and negative currents resulting from AC corona discharge. This difference is referred to as the separation difference-current value. The separation difference-current adjustment value changes the value of the separation difference current. Furthermore, the separation difference-current output value is a control signal from the CPU in the main body of the image forming apparatus. In this embodiment, (4) a faulty separation difference-current adjustment, (5) a faulty separation charging device and (6) a faulty transfer material are considered to be causes of faulty separation. These are the inferential quantities.

Figure 39:
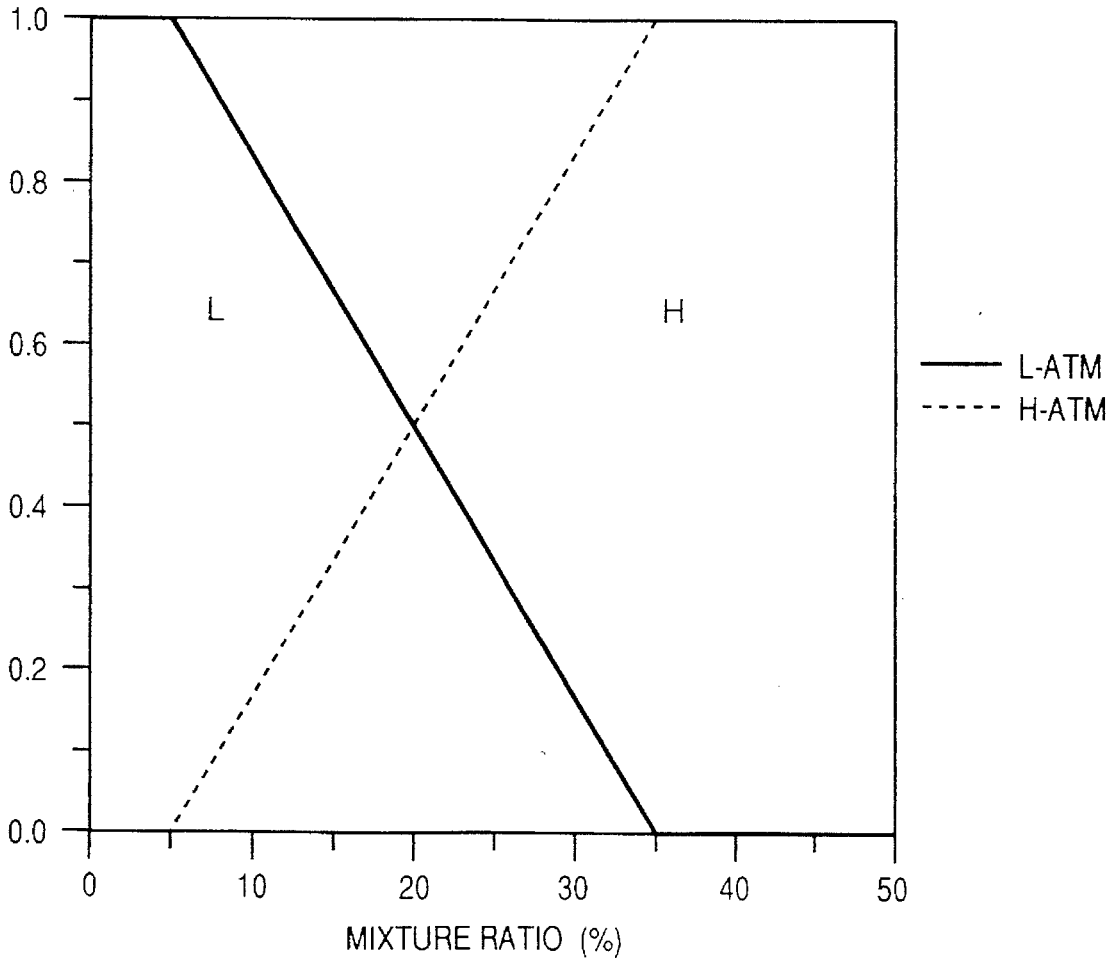
FIG. 39 is a diagram illustrating a membership function of mixture ratio, which is an input status quantity.
Figure 40:
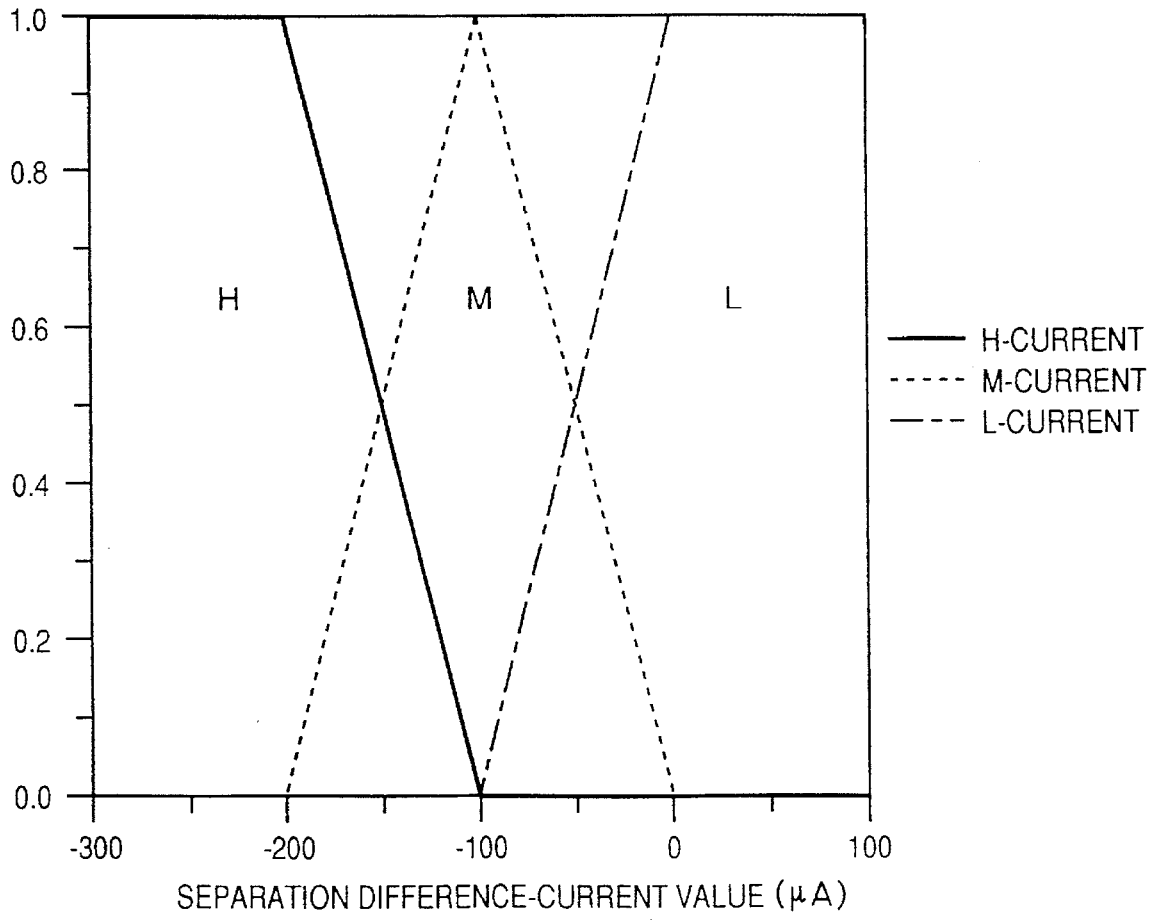
FIG. 40 is a diagram illustrating a membership function of the output value of a separation difference current, which is an input status quantity.
Figure 41:
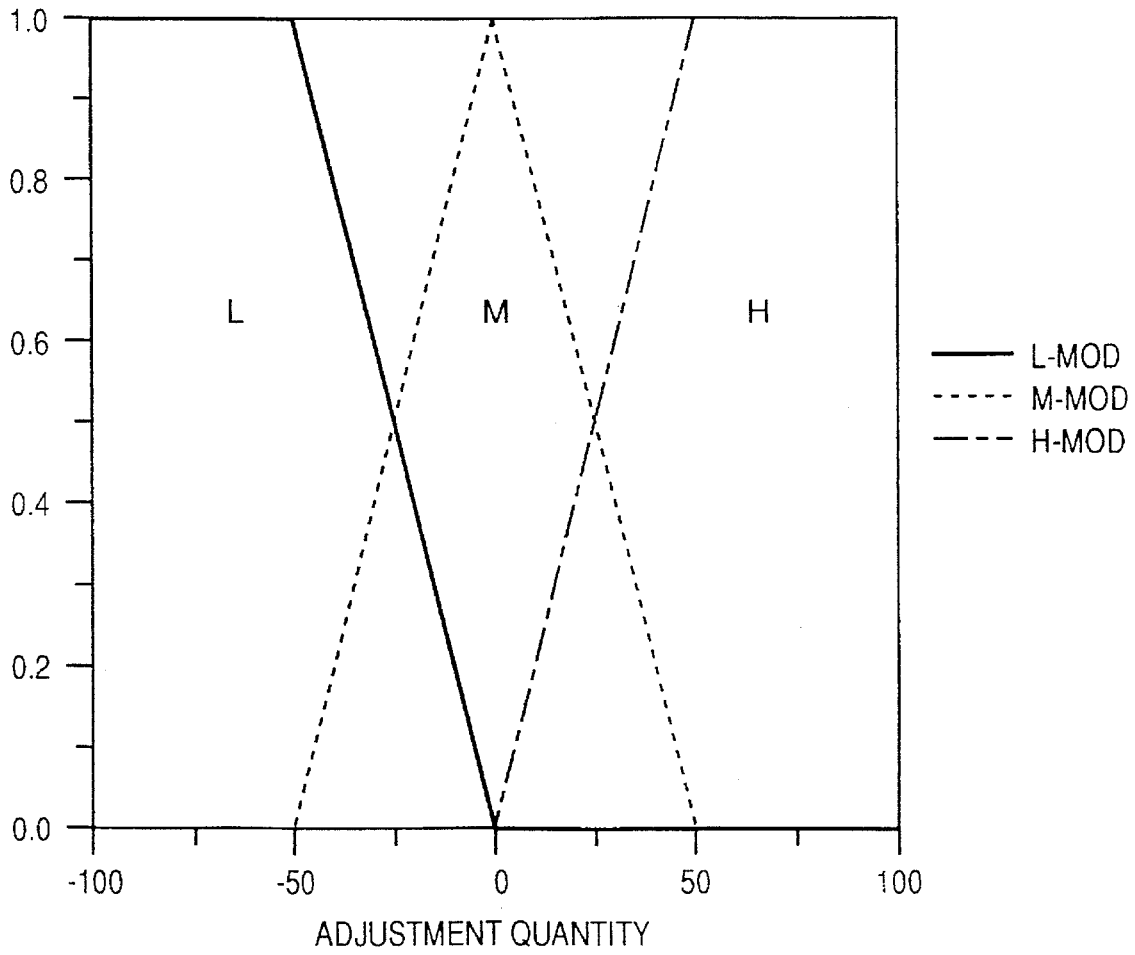
FIG. 41 is a diagram illustrating a membership function of the adjustment value of a separation difference current, which is an input status quantity.
Figure 42:
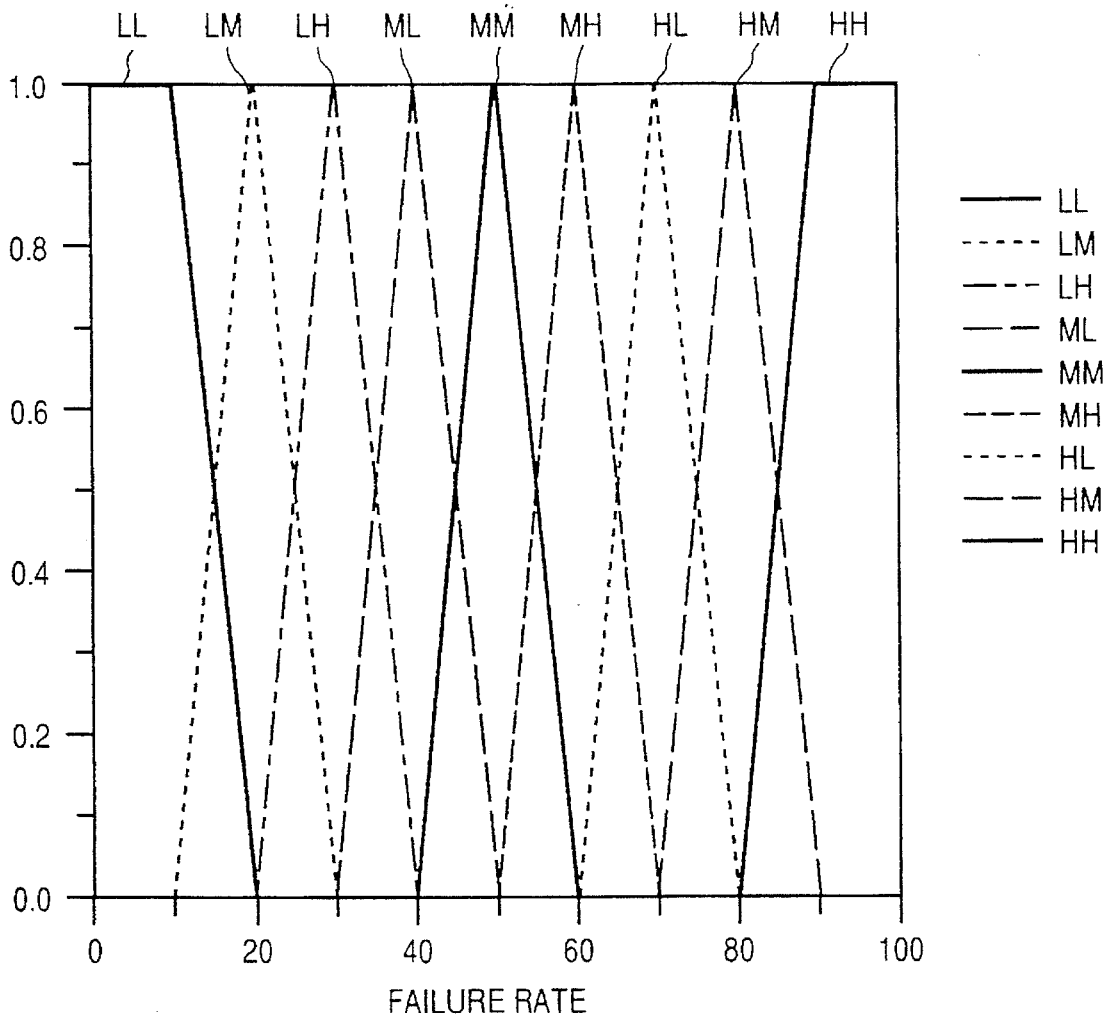
FIG. 42 is a diagram showing a membership function of an inferential quantity.

FIGS. 39 through 41 are diagrams illustrating the membership functions of input status quantities in this embodiment. FIG. 39 shows membership functions of mixture ratio, FIG. 40 the membership functions of the separation difference-current output value and FIG. 41 the membership functions of the separation difference-current adjustment value. FIG. 42 shows the membership functions of inferential quantities according to this embodiment. The membership functions for (4) faulty separation difference-current adjustment, (5) faulty separation charging device and (6) faulty transfer material are identical.

The membership functions of the separation difference-current output value will be described by way of example. The separation difference-current output value is plotted along the horizontal axis and values of 0 to 1 are plotted along the vertical axis as degree of membership. The separation difference-current output value is broadly classified into three sets L, M and H. The contents of these sets are as follows:

L (Low): separation difference-current output value is small (many positive current components)

M (Middle): separation difference-current output value is medium

H (High): separation difference-current output value is large (many negative current components)

By way of example, if the separation difference-current output value is −50 μA, the probability that this value belongs to the set H is 0.5, the probability that this value belongs to the set M is 0.5 and the probability that this value belongs to the set L is 0. In this case, the judgment that the value of −50 μA as the separation difference-current output is "large" or "medium" is vague in that neither judgment is certain. Thus, the membership functions express to which of "small", "medium" and "large" the separation difference-current value belongs, as well as the degree (percentage) of such belonging (the degree of membership). The same is true with regard to the membership functions of FIGS. 39 and 41 and these need not be described in detail for this reason.

Failure rate is plotted along the horizontal axis of the membership functions shown in FIG. 42. A failure rate of 0% is adopted in a case where the failure does not contribute to faulty separation at all, and a failure rate of 100% is adopted in a case where the failure is the entire cause of faulty separation. Failure rate is divided into nine sets, the contents of which are as follows:

LL (Low Low): failure rate is very low;

LM (Low Middle): failure rate is medium low;

LH (Low High): failure rate is higher low;

ML (Middle Low): failure rate is lower medium;

MM (Middle Middle): failure rate is medium;

MH (Middle High): failure rate is higher medium;

HL (High Low): failure rate is lower high;

HM (High Middle): failure rate is high; and

HH (High High): failure rate is very high.

FIG. 43 is a diagram showing the fuzzy rules according to the eighth embodiment. This shows the relationship between the three input status quantities, namely mixture ratio, separation difference-current adjustment value and separation difference-current output value, and the output inferential quantities, namely faulty separation difference-current adjustment, faulty charging device and faulty transfer material. There are a total of 27 rules. For example, Rule 9 is as follows:

Rule 9:

If mixture ratio=L, and separation difference-current adjustment value=H, and separation difference-current output value=H then faulty separation-current adjustment value=LL, and faulty separation charging device=HH, and faulty transfer material=LH The rules are set based upon experience. Specifically, if the mixture ratio is low, separation latitude is large and stabilization is achieved. Accordingly, the probability of faulty transfer material is low and, as long as the separation difference current is not adjusted so as to make the separation difference-current value fairly small, the probability of faulty separation is low. However, a cause of the occurrence of faulty separation under these circumstances is believed to be a high probability of abnormality in the separation charging device. In particular, in a case where the separation difference-current output value (the value of a control signal on the side of the controller) is large, this is a setting that is advantageous for separation performance; hence, the probability that the charging device is faulty is considered to be very high. Conversely, if the mixture ratio is high, the transfer material lacks firmness owing to abnormal absorption of moisture and the probability that faulty separation will occur rises. Further, when the separation difference-current value is small, the probability that faulty separation will occur rises. Consequently, if the separation difference current is adjusted to be on the low side, this may cause faulty separation.

Figure 44:
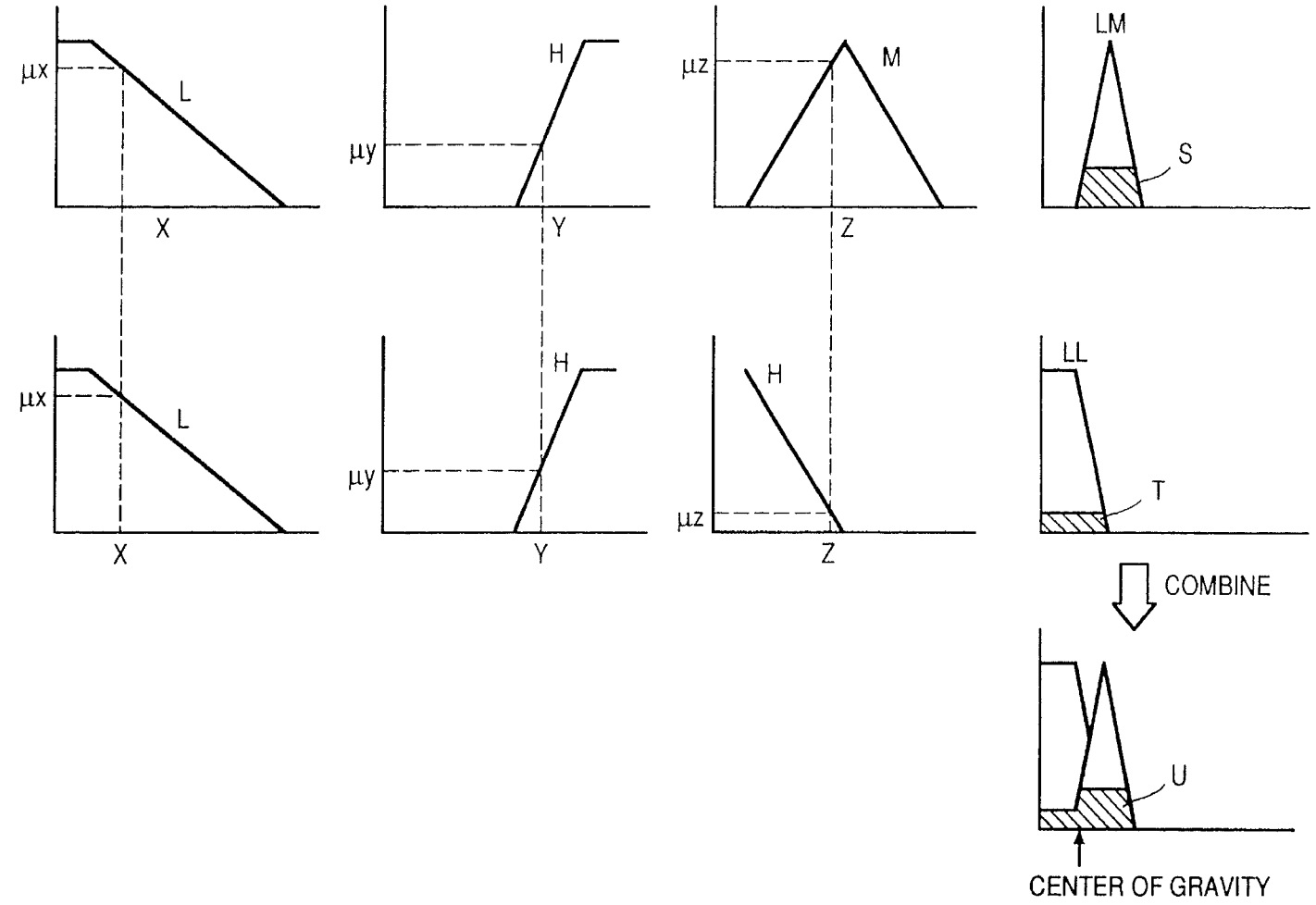
FIG. 44 is a diagram for describing a method of calculating failure rate by fuzzy reasoning.
Figure 45:
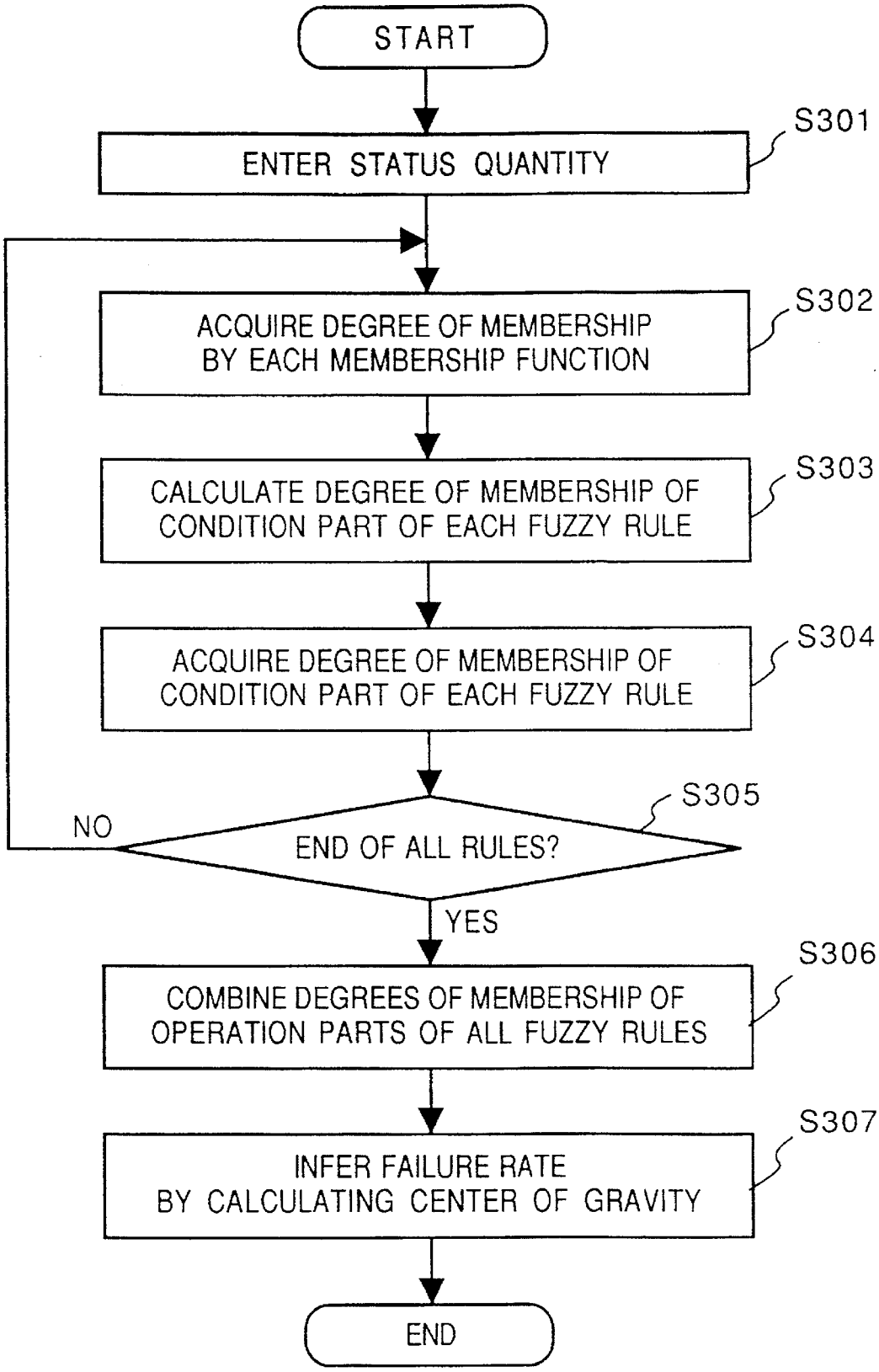
FIG. 45 is a flowchart showing the procedure of fuzzy reasoning.

FIG. 44 is a diagram for describing a method of calculating failure rate by fuzzy reasoning using Rules 8 and among the fuzzy rules of FIG. 43. FIG. 44 illustrates the calculation method solely for the failure rate of separation difference-current adjustment. FIG. 45 is a flowchart illustrating the fuzzy reasoning procedure. This procedure will be described using both FIGS. 44 and 45.

The status quantities for executing reasoning are entered at step S301 in FIG. 45. In this example, a case will be considered in which mixture ratio=x, separation difference-current adjustment value=y, separation difference-current output value=z. Next, at step S302, the membership functions of FIGS. 39~41 are used to obtain the degrees of membership in the respective sets. According to Rule 8 in FIG. 43, the input x is contained in set M at degree μx based upon the membership function of mixture ratio, the input y is contained in set L at degree μy based upon the membership function of separation difference-current adjustment value, and input z is contained in set H at degree μz based upon the membership function of separation difference-current output value. This is followed by step S303, at which the minimum value of μx, μy, μz is taken and this value is adopted as the degree at which the condition part of Rule 8 is satisfied. In this example, μy is the minimum value. When a MIN operation is performed between this value and the set LM of the membership function of the failure rate of the separation difference-current adjustment value, the result is a trapezoid indicated by the shaded portion S.

Next, at step S305, it is determined whether the degree of membership of the operation part has been calculated with regard to all of the fuzzy rules. If there is an unprocessed fuzzy rule, then the program proceeds to step S302 so that the foregoing processing is repeated. For example, a similar computation is performed with regard to Rule 9 to obtain a trapezoid indicated by the shaded portion T.

If the degree of membership of the operation part has been calculated with regard to all of the fuzzy rules, the program proceeds from step S305 to step S306. At this step a combined set of the sets S and T is taken to create a new set indicated by the shaded portion U. A value obtained by calculating the center of gravity of this set is decided as the failure rate of the separation difference-current adjustment value obtained by fuzzy reasoning. Though the calculations are performed using only the Rules 8 and 9 in this example of reasoning processing, in actuality failure rate is decided by performing similar calculations using all of the rules shown in FIG. 43.

Figure 46:
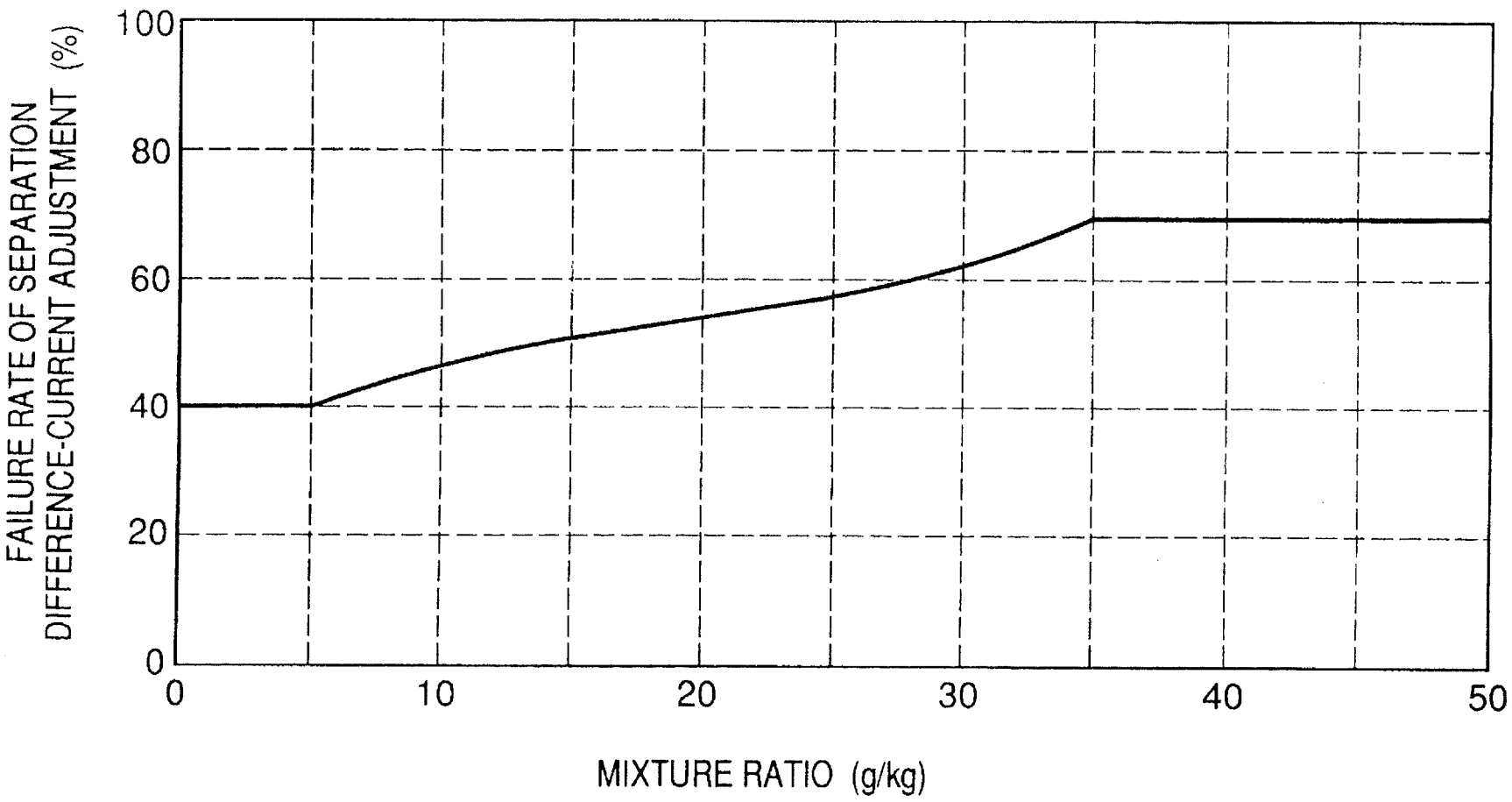
FIG. 46 is a diagram showing inferential results of the failure rate of an adjustment value of separation difference current plotted against a change in mixture ratio, where −90 is the adjustment value of separation difference current and −250 μA is the output value of separation difference current.

FIG. 46 illustrates the failure rate (fault rate) of the separation difference-current adjustment value plotted against a change in mixture ratio, where −90 is the separation difference-current adjustment value and −250 μA is the separation difference-current output value. As mentioned above, it will be understood that if the separation difference-current adjustment value is −90, then the failure rate will rise with a rise in the mixture ratio. In the eighth embodiment, a faulty separation difference-current adjustment, a faulty charging device and a faulty transfer material are inferred using the mixture ratio, separation difference-current adjustment value and separation difference-current output value. However, it is permissible to execute reasoning upon setting fuzzy rules based upon experience inclusive of latent-image information, development information, transfer information and information indicative of use of the main body of the apparatus.

<Ninth Embodiment>

The ninth embodiment relates to a method of inferring a failure location in a case where re-transfer occurs. In re-transfer, a developed image, which has been transferred to the transfer material by the separation charging device, is transferred again to the side of the photosensitive drum. In the ninth embodiment, the image forming apparatus and reasoning unit are similar to those of the eighth embodiment. Furthermore, the status quantities and inferential quantities are the same as those of the eighth embodiment, and the membership functions also are the same. That is, the status quantities are (1) mixture ratio, (2) separation difference-current adjustment value and (3) separation difference-current output value. The inferential quantities are (4) a faulty separation difference-current adjustment, (5) a faulty separation charging device and (6) a faulty transfer material. The fuzzy rules are as shown in FIG. 47.

The setting of the fuzzy rules is based upon experience. Specifically, if the mixture ratio is high, re-transfer latitude is large and stabilization is achieved. Accordingly, the probability of faulty transfer material is low and, as long as the separation difference current is not adjusted so as to make the separation difference-current value large, the probability of re-transfer is low. However, a cause of the occurrence of re-transfer under these circumstances is believed to be a high probability of abnormality in the separation charging device 211. In particular, in a case where the separation difference-current output value (the value of a control signal on the side of the controller) is small, this is a setting that is advantageous for re-transfer; hence, the probability that the separation charging device 211 is faulty is considered to be very high. Conversely, if the mixture ratio is low, the moisture content of the transfer material is low and therefore the probability that re-transfer will occur rises. Further, when the separation difference-current value is large, the probability that re-transfer will occur rises. Consequently, if the separation difference current is adjusted to be on the high side, this will cause a failure.

By executing fuzzy reasoning, which has been described in the eighth embodiment, using the above-mentioned fuzzy rules, it possible to infer the locations of failures relating to re-transfer.

<Tenth Embodiment>

The tenth embodiment deals with a method of inferring the probability of a fault in relation to the transfer charging device 210 as a cause of uneven density of a high density image along the axis of the drum. In the tenth embodiment, the image forming apparatus and reasoning unit are similar to those of the eighth embodiment and need not be described again.

The status quantities are (1) mixture ratio, (2) transfer-current adjustment value and (3) cumulative number of copying operations. The inferential quantities are (4) a faulty transfer-current adjustment and (5) a faulty transfer charging device. The transfer current becomes larger as a positive value of the transfer-current adjustment value becomes larger, with 0 serving as a reference. Conversely, the transfer current becomes smaller as a negative value of the transfer-current adjustment value becomes smaller. The cumulative number of copying operations is that counted from the last time the transfer charging device underwent maintenance.

Figure 48:
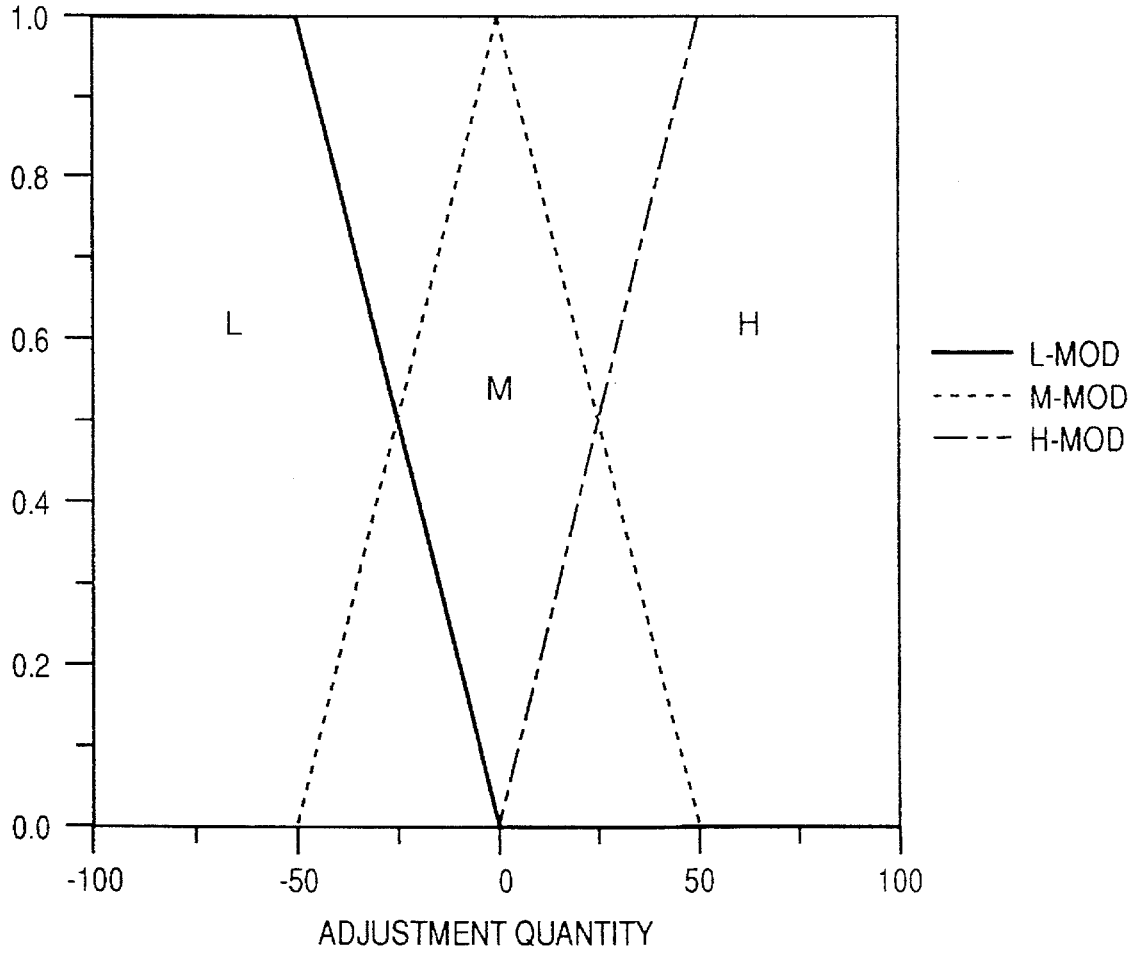
FIG. 48 is a diagram illustrating a membership function of the adjustment value of transfer current, which is an input status quantity in a tenth embodiment.
Figure 49:
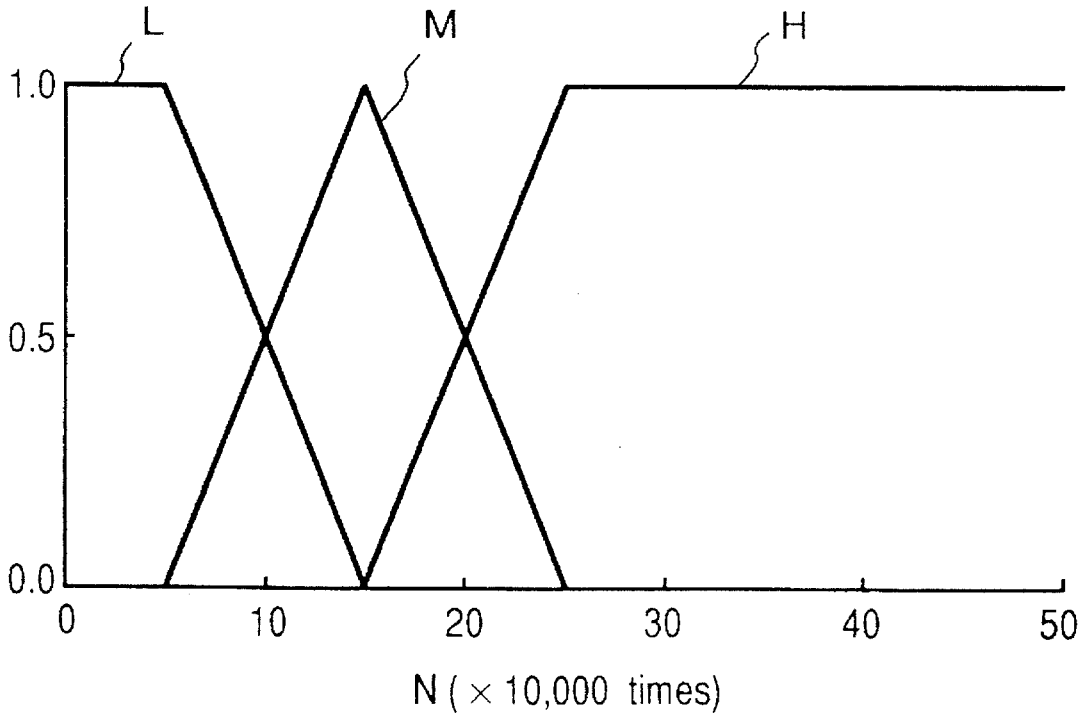
FIG. 49 is a diagram showing a membership function of a cumulative copy number, which is a status quantity used in the tenth embodiment.

The membership functions of mixture ratio are the same as those of the eighth and ninth embodiments. The membership functions of the transfer-current adjustment value and cumulative number of copying operations are illustrated in FIGS. 47 and 48, respectively. According to the membership functions of the transfer-current adjustment value shown in FIG. 48, the transfer-current adjustment value of the transfer charging device 210 takes on a value of from −100 to +100 and indicates the degree of membership in the sets L, M and H. In the membership functions of the transfer-current adjustment value shown in FIG. 49, the cumulative number of copying operations is plotted along the horizontal axis and indicates the degree of membership in the sets L, M and H. Further, the membership functions of faulty transfer-current adjustment and faulty transfer charging device are the same as those shown in FIG. 42. FIG. 50 shows the fuzzy rules used in the tenth embodiment.

The setting of the fuzzy rules is based upon experience. Specifically, if the mixture ratio is low, uneven discharge tends to occur owing contamination of the transfer charging device, and this leads to faulty partial transfer with respect to a high-density image. The result is uneven density in the axial direction of the drum. Accordingly, if the cumulative number of copying operations is large, the probability of a fault in the charging device rises. If the cumulative number of copying operations is not large and the transfer-current adjustment value is small, the probability of a faulty transfer-current adjustment rises.

By executing fuzzy reasoning, as described in the eighth embodiment, using the above-mentioned membership functions and fuzzy rules, it is possible to infer the locations of failures and locations of problems relating to faulty transfer Thus, in accordance with the eighth through tenth embodiments described above, if faults and problems relating to transfer and separation occur and the causes thereof are so numerous that judging the locations of failures is difficult, the probability of failures at locations considered to be faulty and problems involving adjusted values that have been set can be specified by fuzzy reasoning based upon input status quantities. Accordingly, in a case where maintenance is performed, the maintenance can be dealt with easily and accurately without necessarily requiring a high degree of knowledge and experience. As a result, apparatus downtime can be shortened.

As many apparently widely different embodiments of the present invention can be made without departing from the spirit and scope thereof, it is to be understood that the invention is not limited to the specific embodiments thereof except as defined in the appended claims.

What is claimed is:

1. An image forming apparatus comprising:

a corona discharge device for charging a surface of a photoreceptor;

first detecting means for detecting a value of a current supplied to said corona discharge device;

second detecting means for detecting a surface potential of the photoreceptor charged by said corona discharge device;

memory means for storing a membership function regarding the value of the current detected by said first detecting means, a membership function regarding the surface potential detected by said second detecting means, and a membership function regarding a deterioration rate of said corona discharge device; and reasoning means for receiving, as status quantities, the value of the current detected by said first detecting means and the surface potential detected by said second detecting means, and for inferring, by fuzzy reasoning, the deterioration rate of said corona discharge device based upon the input status quantities and each of the membership functions stored in said memory means.

2. The apparatus according to claim 1, wherein said memory means stores a fuzzy rule in accordance with which the deterioration rate of said corona discharge device (1) increases when the value of the current detected by said first detecting means increases, and (2) increases when the surface potential detected by said second detecting means decreases, and wherein said reasoning means infers, by fuzzy reasoning, the deterioration rate of said corona discharge device based upon the fuzzy rule.

3. The apparatus according to claim 1, wherein said second detecting means detects the surface potential when the photoreceptor is unexposed to light.

4. An image forming apparatus comprising:

a lamp for exposing an original to light;

transformer means for controlling a voltage applied to said lamp from a power supply;

first detecting means for detecting the voltage applied to said lamp;

second detecting means for detecting a surface potential of a photoreceptor on which a latent image of the original will be formed;

memory means for storing a membership function regarding a value of the voltage detected by said first detecting means, a membership function regarding the surface potential detected by said second detecting means, a membership function regarding a correction coefficient set in said transformer means, and a membership function regarding a rate of deterioration of said lamp; and reasoning means for receiving, as status quantities, the value of the voltage detected by said first detecting means, the surface potential detected by said second detecting means, and the correction coefficient set in said transformer means, and for inferring, by fuzzy reasoning, the deterioration rate of said lamp based upon the input status quantities and each of the membership functions stored in said memory means.

5. The apparatus according to claim 4, wherein said memory means stores a fuzzy rule in accordance with which the deterioration rate of said lamp (1) increases when the value of voltage detected by said first detecting means increases, (2) increases when the surface potential detected by said second detecting means increases, and (3) increases when the correction coefficient set in said transformer means increases, and wherein said reasoning means infers, by fuzzy reasoning, the deterioration rate of said lamp based upon the fuzzy rule.

6. The apparatus according to claim 4, wherein said second detecting means detects the surface potential of the photoreceptor in a case where said lamp exposes to light an image having a prescribed density.

7. The apparatus according to claim 6, wherein the image having the prescribed density is a white image.

8. An image forming apparatus comprising:

a lamp for exposing an original to light;

transformer means for controlling a voltage applied to said lamp from a power supply;

first detecting means for detecting the voltage applied to said lamp;

second detecting means for detecting a surface potential of a photoreceptor on which a latent image of the original will be formed;

memory means for storing a membership function regarding a value of the voltage detected by said first detecting means, a membership function regarding the surface potential detected by said second detecting means, a membership function regarding a correction coefficient set in said transformer means, and a membership function regarding an erroneous setting rate for the correction coefficient set in said transformer means; and reasoning means for receiving, as status quantities, the value of the voltage detected by said first detecting means, the surface potential detected by said second detecting means, and the correction coefficient set in said transformer means, and for inferring, by fuzzy reasoning, the erroneous setting rate for the correction coefficient set in said transformer means, based upon the input status quantities and each of the membership functions stored in said memory means.

9. The apparatus according to claim 8, wherein said memory means stores a fuzzy rule in accordance with which the erroneous setting rate (1) increases when the value of the voltage detected by said first detecting means increases, (2) increases when the surface potential detected by said second detecting means increases, and (3) increases when the correction coefficient set in said transformer means decreases, and wherein said reasoning means infers, by fuzzy reasoning, the erroneous setting rate based upon the fuzzy rule.

10. The apparatus according to claim 8, wherein said second detecting means detects the surface potential of the photoreceptor in a case where said lamp exposes to light an image having a prescribed density.

11. The apparatus according to claim 10, wherein the image having the prescribed density is a white image.

12. An image forming apparatus comprising:

a developer for developing a latent image, which has been formed on a photoreceptor, by using toner;

transformer means for controlling a voltage applied to said developer;

first detecting means for detecting the voltage applied to said developer;

second detecting means for detecting an amount of electric charge possessed by the toner used by said developer;

memory means for storing a membership function regarding a value of the voltage detected by said first detecting means, a membership function regarding the amount of electric charged detected by said second detecting means, and a membership function regarding a correction coefficient set in said transformer means; and reasoning means for receiving, as status quantities, the value of the voltage detected by said first detecting means and the amount of electric charge detected by said second detecting means, and for inferring, by fuzzy reasoning, the erroneous setting rate for the correction coefficient set in said transformer means, based upon the input status quantities and each of the membership functions stored in said memory means.

13. The apparatus according to claim 12, wherein said memory means stores a fuzzy rule in accordance with which the erroneous setting rate (1) increases when the value of the voltage detected by said first detecting means increases, and (2) increases when the amount of electric charge detected by said second detecting means decreases, and wherein said reasoning means infers, by fuzzy reasoning, the erroneous setting rate based upon the fuzzy rule.

14. The apparatus according to claim 12, wherein said first detecting means detects a DC voltage applied to said developer.

15. An image forming apparatus comprising:

a developer for developing a latent image, which has been formed on a photoreceptor, by using toner;

transformer means for controlling a voltage applied to said developer;

first detecting means for detecting the voltage applied to said developer;

second detecting means for detecting an amount of electric charge possessed by the toner used by said developer;

memory means for storing a membership function regarding a value of the voltage detected by said first detecting means, a membership function regarding the amount of electric charge detected by said second detecting means, and a membership function regarding a deterioration rate of the toner used by said developer; and reasoning means for receiving, as status quantities, the value of the voltage detected by said first detecting means and the amount of electric charge detected by said second detecting means, and for inferring, by fuzzy reasoning, the deterioration rate of the toner used by said developer, based upon the inputted status quantities and each of the membership functions stored in said memory means.

16. The apparatus according to claim 15, wherein said memory means stores a fuzzy rule in accordance with which the deterioration rate of the toner used by said developer (1) increases when the value of voltage detected by said first detecting means increases, and (2) increases when the amount of electric charge detected by said second detecting means decreases, and wherein said reasoning means infers, by fuzzy reasoning, the deterioration rate of the toner used by said developer based upon the fuzzy rule.

17. The apparatus according to claim 15, wherein said first detecting means detects a DC voltage applied to said developer.

18. An image forming apparatus comprising:

a transfer corona discharge device for transferring a toner image on a photoreceptor to a recording sheet;

adjusting means for adjusting a voltage applied to said transfer corona discharge device;

first detecting means for detecting a value of a current which flows into said transfer corona discharge device owing to the voltage adjusted by said adjusting means;

generating means for generating cumulative data representing a cumulative number of sheets recorded on or a cumulative time said transfer corona discharge device is in use;

second detecting means for detecting a humidity within said image forming apparatus;

memory means for storing a membership function regarding a value of the current detected by said first detecting means, a membership function regarding the cumulative data generated by said generating means, a membership function regarding the humidity detected by said detecting means, and a membership function regarding a deterioration rate of said transfer corona discharge device; and reasoning means for inferring, by fuzzy reasoning, the deterioration rate of said transfer corona discharge device based upon the value of the current detected by said first detecting means, the cumulative data generated by said generating means, and each of the membership functions stored in said memory means.

19. The apparatus according to claim 18, wherein said memory means stores a fuzzy rule in accordance with which the deterioration rate of said transfer corona discharge device (1) increases when the value of the current detected by said first detecting means decreases, (2) increases when the cumulative data generated by said generating means increases, and (3) increases when the humidity detected by said second detecting means rises, and wherein said reasoning means infers, by fuzzy reasoning, the deterioration rate of said transfer corona discharge device based upon the fuzzy rule.

20. The apparatus according to claim 18, wherein said generating means resets the cumulative data generated by said generating means when said transfer corona discharge device is replaced or cleaned.

21. The apparatus according to claim 18, wherein said generating means has a memory for storing the cumulative data generated by said generating means.

22. An image forming apparatus comprising:

a transfer corona discharge device for transferring a toner image on a photoreceptor to a recording sheet;

adjusting means for adjusting a voltage applied to said transfer corona discharge device;

first detecting means for detecting a value of a current which flows into said transfer corona discharge device owing to the voltage adjusted by said adjusting means;

generating means for generating cumulative data representing a cumulative number of sheets recorded on or a cumulative time said transfer corona discharge device is in use;

second detecting means for detecting a humidity within said image forming apparatus;

memory means for storing a membership function regarding a value of the current detected by said first detecting means, a membership function regarding the cumulative data generated by said generating means, a membership function regarding the humidity detected by said second detecting means, and a membership function regarding a correction coefficient set by said adjusting means; and reasoning means for inferring, by fuzzy reasoning, an erroneous setting rate for the correction coefficient set by said adjusting means based upon the value of the current detected by said first detecting means, the cumulative data generated by said generating means, the humidity detected by said second detecting means, and each of the membership functions stored in said memory means.

23. The apparatus according to claim 22, wherein said memory means stores a fuzzy rule in accordance with which the erroneous setting rate (1) increases when the value of the current detected by said first detecting means decreases, (2) increases when the cumulative data generated by said generating means increases, and (3) increases when the humidity detected by said second detecting means rises, and wherein said reasoning means infers, by fuzzy reasoning, the erroneous setting rate based upon the fuzzy rule.

24. The apparatus according to claim 22, wherein said generating means resets the cumulative data generated by said generating means when said transfer corona discharge device is replaced or cleaned.

25. The apparatus according to claim 22, wherein said generating means has a memory for storing the cumulative data generated by said generating means.

26. An image forming apparatus comprising:

latent image forming means for forming a latent image on a surface of a photoreceptor;

developing means for developing the latent image, which has been formed on the surface of the photoreceptor by said latent image forming means, by using developing material;

transfer means for transferring an image developed by said developing means to a recording medium;

first detection means for detecting a voltage ripple on the surface of the photoreceptor on which the latent image is formed by said latent image forming means;

second detection means for detecting a density ripple of the image developed by said developing means;

third detection means for detecting a density ripple of the image transferred to the recording medium by said transfer means;

memory means for storing a membership function regarding the voltage ripple detected by said first detection means, a membership function regarding the density ripple detected by said second detection means, a membership function regarding the density ripple detected by said third detection means, a membership function regarding a failure rate of said latent image forming means, a membership function regarding a failure rate of said developing means, and a membership function regarding a failure rate of said transfer means; and reasoning means for receiving, as status quantities, the voltage ripple detected by said first detection means, the density ripple detected by said second detection means, and the density ripple detected by said third detection means, and for inferring, by fuzzy reasoning, at least one of a failure rate of said latent image forming means, a failure rate of said developing means, and a failure rate of said transfer means, based upon respective ones of input status quantities and respective ones of the membership functions stored in said memory means.

27. An apparatus according to claim 26, wherein the photoreceptor comprises a rotator, said first detection means detects the voltage ripple on the surface of the photoreceptor along a rotation axis of the photoreceptor, said second detection means detects the density ripple of the image on the photoreceptor along the rotation axis, and said third detection means detects the density ripple of the image on the recording medium along the rotation axis.

28. An image forming apparatus comprising:

latent image forming means for forming a latent image on a photoreceptor;

developing means for developing the latent image which has been formed on the photoreceptor;

transfer means for transferring an image developed by said developing means to a recording medium;

detection means for detecting values of factors which influence a quality of an image transferred to the recording medium;

memory means which stores membership functions regarding the values of the factors and at least one of a membership function regarding a failure rate of said latent image forming means, a membership function regarding a failure rate of said developing means, and a membership function regarding a failure rate of said transfer means; and reasoning means for receiving, as status quantities, the value of the factors detected by said detection means, and for inferring, by fuzzy reasoning, at least one of a failure rate of said latent image forming means, a failure rate of said developing means, and a failure rate of said transfer means, based upon respective ones of the input status quantities and respective ones of the membership functions stored in said memory means.

29. An apparatus according to claim 28, wherein said detection means detects the values of the factors which influence a quality of an image transferred to the recording medium during processing by said latent image forming means, said developing means, and said transfer means.

30. A failure diagnosing method for an image forming apparatus having latent image forming means for forming a latent image on a photoreceptor, developing means for developing the latent image which has been formed on the photoreceptor, and transfer means for transferring an image developed by said developing means to a recording medium, said method comprising:

a detecting step for detecting values of factors which influence, in the latent image forming means, the developing means, and the transfer means, a quality of the image transferred to the recording medium, and for inputting the detected values as status quantities; and an inferring step for inferring, by fuzzy reasoning, at least one of a failure rate of the latent image forming means, a failure rate of the developing means, and a failure rate of the transfer means, based upon respective ones of the input status quantities and respective ones of membership functions stored in a memory which stores membership functions regarding the values of the factors and at least one of a membership function regarding a failure rate of the latent image forming means, a membership function regarding a failure rate of the developing means, and a membership function regarding a failure rate of the transfer means.

31. A method according to claim 30, wherein the values of the factors are detected in said detecting step during processing by the latent image forming means, the developing means, and the transfer means.

32. A failure diagnosing method for an image forming apparatus having latent image forming means for forming a latent image on a surface of a photoreceptor, developing means for developing the latent image which has been formed on the surface of the photoreceptor, and transfer means for transferring an image developed by said developing means to a recording medium, said method comprising the steps of:

a first detecting step for detecting a voltage ripple on a surface of the photoreceptor on which the latent image is formed by the latent image forming means;

a second detecting step for detecting a density ripple of the image developed by the developing means;

a third detecting step for detecting a density ripple of the image transferred to the recording medium by the transfer means;

a storing step for storing, in a memory means, a membership function regarding the voltage ripple detected in said first detecting step, a membership function regarding the density ripple detected in said second detecting step, a membership function regarding the density ripple detected in said third detecting step, a membership function regarding a failure rate of the latent image forming means, a membership function regarding a failure rate of the developing means, and a membership function regarding a failure rate of the transfer means; and a reasoning step for receiving, as status quantities, the voltage ripple detected in said first detecting step, the density ripple detected in said second detecting step, and the density ripple detected in said third detecting step, and for inferring, by fuzzy reasoning, at least one of a failure rate of the latent image forming means, a failure rate of the developing means, and a failure rate of the transfer means, based upon respective ones of the input status quantities and respective ones of the membership functions stored in the memory means.

33. A method according to claim 32, wherein the photoreceptor comprises a rotator, said first detecting step detects the voltage ripple on the surface of the photoreceptor along a rotation axis of the photoreceptor, said second detecting step detects the density ripple of the image on the photoreceptor along the rotation axis, and said third detecting step detects the density ripple of the image on the recording medium along the rotation axis.

34. An image forming apparatus comprising:

forming means for forming a latent image on a photoreceptor;

first detection means for detecting voltage distribution on the photoreceptor by detecting voltages at a plurality of positions on the latent image formed on the photoreceptor;

developing means for developing the latent image formed on the photoreceptor;

second detection means for detecting density distribution on the photoreceptor by detecting density at a plurality of positions on a developed image on the photoreceptor, which is obtained by developing the latent image by said developing means;

transfer means for transferring the developed image on the photoreceptor to a recording sheet;

third detection means for detecting density distribution on the recording sheet by detecting densities at a plurality of positions in the image transferred to the recording sheet;

memory means for storing a membership function regarding the voltage distribution on the photoreceptor detected by said first detection means, a membership function regarding the density distribution on the photoreceptor detected by said second detection means, a membership function regarding the density distribution on the recording sheet detected by said third detection means and a membership function regarding a failure rate of said forming means;

reasoning means for receiving, as status quantities, the voltage distribution on the photoreceptor detected by said first detecting means, the density distribution on the photoreceptor detected by said second detecting means and density distribution on the recording sheet detected by said third detecting means, and for inferring, by fuzzy reasoning, the failure rate of said forming means based upon the input status quantities and the membership functions stored in said memory means.

35. An apparatus according to claim 34, wherein said forming means forms a latent image corresponding to an image having a predetermined density.

36. An apparatus according to claim 35, wherein said forming means forms latent image by exposing standard density plate which has a predetermined density.

37. An apparatus according to claim 34, wherein said first detection means detects the voltage distribution along a driving axis of said photoreceptor.

38. An apparatus according to claim 34, wherein said second detection means detects the density distribution along a driving axis of said photoreceptor.

39. An apparatus according to claim 34, wherein said third detection means detects the density distribution along a right angle direction to a conveying direction of the recording sheet.

40. An apparatus according to claim 37, wherein said memory means further stores a membership function regarding a failure rate of said developing means, said reasoning means further infers, by fuzzy reasoning, the failure rate of said developing means.

41. An apparatus according to claim 40, wherein said memory means further stores a membership function regarding a failure rate of said transfer means, said reasoning means further infers, by fuzzy reasoning, the failure rate of said transfer means.

42. An image forming apparatus comprising:

forming means for forming a latent image on a photoreceptor;

first detection means for detecting voltage distribution on the photoreceptor by detecting voltages at a plurality of positions on the latent image formed on the photoreceptor;

developing means for developing the latent image formed on the photoreceptor;

second detection means for detecting density distribution on the photoreceptor by detecting density at a plurality of positions on a developed image on the photoreceptor, which is obtained by developing the latent image by said developing means;

transfer means for transferring the developed image on the photoreceptor to a recording sheet;

third detection means for detecting density distribution on the recording sheet by detecting densities at a plurality of positions in the image transferred to the sheet;

memory means for storing a membership function regarding the voltage distribution on the photoreceptor detected by said first detection means, a membership function regarding the density distribution on the photoreceptor detected by said second detection means, a membership function regarding the density distribution on the recording sheet detected by said third detection means and a membership function regarding a failure rate of said developing means;

reasoning means for receiving, as status quantities, the voltage distribution on the photoreceptor detected by said first detecting means, the density distribution on the photoreceptor detected by said second detecting means and density distribution on the recording sheet detected by said third detecting means, and for inferring, by fuzzy reasoning, the failure rate of said developing means based upon the input status quantities and the membership functions stored in said memory means.

43. An apparatus according to claim 42, wherein said forming means forms a latent image corresponding to an image having a predetermined density.

44. An apparatus according to claim 43, wherein said forming means forms a latent image by exposing standard density plate which has a predetermined density.

45. An apparatus according to claim 42, wherein said first detection means detects the voltage distribution along a driving axis of said photoreceptor.

46. An apparatus according to claim 42, wherein said second detection means detects the density distribution along a driving axis of said photoreceptor.

47. An apparatus according to claim 45, wherein said third detection means detects the density distribution along a right angle direction to a conveying direction of the recording sheet.

48. An apparatus according to claim 42, wherein said memory means further stores a membership function regarding a failure rate of said transfer means, said reasoning means further infers, by fuzzy reasoning, the failure rate of said transfer means.

49. An image forming apparatus comprising:

forming means for forming a latent image on a photoreceptor;

first detection means for detecting voltage distribution on the photoreceptor by detecting voltages at a plurality of positions on the latent image formed on the photoreceptor;

developing means for developing the latent image formed on the photoreceptor;

second detection means for detecting density distribution on the photoreceptor by detecting densities at a plurality of positions on a developed image on the photoreceptor, which is obtained by developing the latent image by said developing means;

transfer means for transferring the developed image on the photoreceptor to a recording sheet;

third detection means for detecting density distribution on the recording sheet by detecting densities at a plurality of positions in the image transferred to the recording sheet;

memory means for storing a membership function regarding the voltage distribution on the photoreceptor detected by said first detection means, a membership function regarding the density distribution on the photoreceptor detected by said second detection means, a membership function regarding the density distribution on the recording sheet detected by said third detection means and a membership function regarding a failure rate of said transfer means;

reasoning means for receiving, as status quantities, the voltage distribution on the photoreceptor detected by said first detecting means, the density distribution on the photoreceptor detected by said second detecting means and density distribution on the recording sheet detected by said third detecting means, and for inferring, by fuzzy reasoning, the failure rate of said transfer means based upon the input status quantities and the membership functions stored in said memory means.

50. An apparatus according to claim 49, wherein said forming means forms a latent image corresponding to an image having a predetermined density.

51. An apparatus according the claim 50, wherein said forming means forms a latent image by exposing standard density plate which has a predetermined density.

52. An apparatus according to claim 49, wherein said first detection means detects the voltage distribution along a driving axis of said photoreceptor.

53. An apparatus according to claim 49, wherein said second detection means detects the density distribution along a driving axis of said photoreceptor.

54. An apparatus according to claim 49, wherein said third detection means detects the density distribution along a right angle direction to a conveying direction of the recording sheet.

55. An apparatus according to claim 49, wherein said memory means further stores a membership function regarding a failure rate of said forming means, said reasoning means further infers, by fuzzy reasoning, the failure rate of said forming means.

56. An image forming apparatus comprising:

forming means for forming a latent image, said forming means having a photoreceptor, a corona charging device for charging the photoreceptor and exposure means for irradiating alight image to the photoreceptor;

first detecting means for detecting a surface voltage ripple on the photoreceptor by detecting voltages at a plurality of positions on the photoreceptor which is exposed with no light image by said exposure means;

second detection means for detecting a surface voltage ripple on the photoreceptor by detecting voltages at a plurality of positions on the photoreceptor which is charged and exposed with a light image corresponding to a predetermined density by said exposure means;

third detection means for detecting humidity in the image forming apparatus;

memory means for storing membership function regarding the surface voltage ripple detected by said first detection means, a membership function regarding the surface voltage ripple detected by said second detection means, a membership function regarding humidity detected by said third detection means and a membership function regarding a failure rate of said forming means; and reasoning means for receiving, as status quantities, the surface voltage ripple detected by said first detection means, the surface voltage ripple detected by said second detecting means and the humidity detected by said third detecting means, and inferring, by fuzzy reasoning, the failure rate of said forming means based upon the input status quantities and the membership functions stored in said memory means.

57. An apparatus according to claim 56, wherein said reasoning means infers, by fuzzy reasoning, each failure rate of said corona charging device, said exposure means and said photoreceptor, respectively.

58. An apparatus according to claim 57, wherein the membership function regarding a failure rate of said forming means includes membership functions for failure rate of corona charging device, said exposure means and said photoreceptor, respectively.

59. An image forming apparatus comprising:

developing means for developing a latent image formed on a photoreceptor by using toner;

first detection means for detecting a density ripple on the photoreceptor by detecting densities at a plurality of positions of a developed image which is obtained by latent image corresponding to a predetermined density by said developing means, said first detection means detects a plurality of positions along driving direction of the photoreceptor;

generating means for generating data indicating a number of sheets, which indicates an accumulated number of recorded sheet;

second detection means for detecting humidity of the image forming apparatus;

memory means for storing a membership function regarding the density ripple detected by said first detection means, a membership function regarding the data indicating the number of sheets generated by said generating means, a membership function regarding humidity detected by said second detection means and a membership function regarding a failure rate of said photoreceptor; and reasoning means for receiving, as status quantities, the density ripple detected by said first detection means, the data indicating the number of sheets generated by said generating means and the humidity detected by said second detecting means, and for inferring, by fuzzy reasoning, the failure rate of said photoreceptor based upon the input status quantities and the membership functions stored in said memory means.

60. An apparatus according to claim 59, wherein said first detection means detects a density of the developed image corresponding to white density image.

61. An apparatus according to claim 59, wherein said first detection means detects densities at a plurality of positions along a driving direction of the photoreceptor for each of a plurality of positions along the driving axis.

62. An image forming apparatus comprising:

developing means for developing a latent image formed on a photoreceptor by using toner;

first detection means for detecting a density ripple on the photoreceptor by detecting densities at a plurality of positions of a developed image which is obtained by developing a latent image corresponding to a predetermined density by said developing means, said first detection means detects a plurality of positions along driving direction of the photoreceptor;

generating means for generating data indicating a number of sheet, which indicates accumulated number of recorded sheet;

second detection means for detecting humidity of the image forming apparatus;

memory means for storing a membership function regarding the density ripple detected by said first detection means, a membership function regarding the data indicating the number of sheets generated by said generating means, a membership function regarding humidity detected by said second detection means and a membership function regarding a failure rate of said developing means; and reasoning means for receiving, as status quantities, the density ripple detected by said first detection means, the data indicating the number of sheets generated by said generating means and the humidity detected by said second detecting means, and for inferring, by fuzzy reasoning, the failure rate of said developing means based upon the input status quantities and the membership functions stored in said memory means.

63. An apparatus according to claim 62, wherein said first detection means detects density of the developed image corresponding to white density image.

64. An apparatus according to claim 62, wherein said first detection means detects densities of a plurality of positions along a driving direction of the photoreceptor for each of a plurality of positions along the driving axis.

65. An apparatus according to claim 62, wherein said memory means further stores a membership function regarding a failure rate of said photoreceptor, and said reasoning means further infers the failure rate of said photoreceptor.

* * * * *

UNITED STATES PATENT AND TRADEMARK OFFICE

CERTIFICATE OF CORRECTION

PATENT NO. : 5,610,689

DATED : March 11, 1997

INVENTORS : Yuji Kamiya, et al.

It is certified that error appears in the above-identified patent and that said Letters Patent is hereby corrected as shown below:

COLUMN 6

Line 27, "has" should read --have--.

COLUMN 10

Line 13, "upon" should be deleted.

COLUMN 30

Line 5, "owing" should read --owing to--; and
Line 17, "transfer" should read --transfer.--.

COLUMN 32

Line 32, "charged" should read --charge--.

COLUMN 37

Line 61, "claim 37," should read --claim 34,--.

COLUMN 39

Line 60, "alight" should read --a light--.

UNITED STATES PATENT AND TRADEMARK OFFICE

CERTIFICATE OF CORRECTION

PATENT NO. : 5,610,689

DATED : March 11, 1997

INVENTORS : Yuji Kamiya, et al.

It is certified that error appears in the above-identified patent and that said Letters Patent is hereby corrected as shown below:

COLUMN 40

Line 42, "sheet;" should read --sheets;--.

COLUMN 41

Line 13, "sheet," should read --sheets,--; and
Line 14, "sheet;" should read --sheets;--.

Signed and Sealed this

Sixteenth Day of September, 1997

*Attest:*

*Attesting Officer*

BRUCE LEHMAN

*Commissioner of Patents and Trademarks*